US011473337B2

(12) United States Patent
Laporta

(10) Patent No.: US 11,473,337 B2
(45) Date of Patent: Oct. 18, 2022

(54) SYSTEM FOR DETECTING THE STATUS OF A WINDOW OR DOOR ASSEMBLY

(71) Applicant: Giovanni Laporta, Watford (GB)

(72) Inventor: Giovanni Laporta, Watford (GB)

(73) Assignee: Giovanni Laporta, Watford (GB)

( * ) Notice: Subject to any disclaimer, the term of this patent is extended or adjusted under 35 U.S.C. 154(b) by 767 days.

(21) Appl. No.: 16/336,216

(22) PCT Filed: Sep. 22, 2017

(86) PCT No.: PCT/GB2017/052845
§ 371 (c)(1),
(2) Date: Mar. 25, 2019

(87) PCT Pub. No.: WO2018/055398
PCT Pub. Date: Mar. 29, 2018

(65) Prior Publication Data

US 2019/0234110 A1 Aug. 1, 2019

(30) Foreign Application Priority Data

Sep. 23, 2016 (GB) ..... 1616246

(51) Int. Cl.
*E05B 47/00* (2006.01)
*E05B 39/00* (2006.01)
(Continued)

(52) U.S. Cl.
CPC ..... *E05B 47/0038* (2013.01); *E05B 7/00* (2013.01); *E05B 39/00* (2013.01); *G08B 13/08* (2013.01);
(Continued)

(58) Field of Classification Search
CPC ..... E05B 47/00; E05B 47/0038; E05B 7/00; E05B 39/00; E05B 2045/0615;
(Continued)

(56) References Cited

U.S. PATENT DOCUMENTS 11,002,061 B1 * 5/2021 Maiga ..... E05B 47/026
11,081,250 B2 * 8/2021 Harmon ..... A47B 55/00
(Continued)

FOREIGN PATENT DOCUMENTS

CA 2810219 A1 * 10/2013 ..... G08B 13/08
EP 0743410 A2 11/1996
(Continued)

OTHER PUBLICATIONS

European Patent Office, International Search Report with Written Opinion issued in Application PCT/GB2017/052845, dated Jan. 12, 2018, 16 pages, European Patent Office, Rijswijk, Netherlands.
(Continued)

*Primary Examiner* — Suzanne L Barrett
(74) *Attorney, Agent, or Firm* — Traverse Legal, PLC

(57) ABSTRACT

A system for detecting the position of at least one moveable element of a window or door, the system comprising: at least one sensor for sensing a magnetic field, the at least one sensor being configured such that the magnetic field sensed changes as said moveable element moves; and a processor configured to receive output signals associated with the sensed magnetic field and to determine the position of said moveable element; wherein the system is configured to operate in a calibration mode and a normal mode, wherein in the calibration mode the system is configured to register at least an output value from said sensor when said moveable element is at a first predetermined position as a corresponding first reference value and wherein in the normal mode the processor means is configured to use the first reference value in determining the position of the at least one moveable element.

19 Claims, 36 Drawing Sheets

(51) Int. Cl.

| | |
|---|---|
| ***E05B 7/00*** | (2006.01) |
| ***G08B 13/08*** | (2006.01) |
| *E05B 45/06* | (2006.01) |
| *E05C 9/02* | (2006.01) |

(52) U.S. Cl.
CPC . *E05B 2045/063* (2013.01); *E05B 2045/0615* (2013.01); *E05B 2047/0065* (2013.01); *E05B 2047/0067* (2013.01); *E05B 2047/0068* (2013.01); *E05B 2047/0069* (2013.01); *E05C 9/02* (2013.01)

(58) Field of Classification Search
CPC ..... E05B 2045/063; E05B 2047/0065; E05B 2047/0068; E05B 2047/0069; G08B 13/08; E05C 9/02
USPC ..... 70/276
See application file for complete search history.

(56) References Cited

U.S. PATENT DOCUMENTS

| | | | | |
|---|---|---|---|---|
| 2009/0102649 | A1 | 4/2009 | Diener et al. | |
| 2014/0001779 | A1 | 1/2014 | Bedoian et al. | |
| 2015/0330140 | A1 | 11/2015 | Kincaid et al. | |
| 2015/0348385 | A1 | 12/2015 | Lamb et al. | |
| 2016/0054148 | A1 | 2/2016 | Misfatto | |
| 2016/0189506 | A1 | 6/2016 | Peterson et al. | |
| 2017/0227386 | A1* | 8/2017 | Campero | G01D 18/00 |
| 2019/0228622 | A1* | 7/2019 | Dial, IV | G08B 13/08 |
| 2020/0105124 | A1* | 4/2020 | Nichols, Sr. | G01R 33/0206 |

FOREIGN PATENT DOCUMENTS

| | | | | |
|---|---|---|---|---|
| EP | 3498947 | B1 * | 2/2020 | E05B 47/0615 |
| EP | 3754138 | A1 * | 12/2020 | E05B 45/083 |
| EP | 3885514 | A1 * | 9/2021 | E05B 47/00 |
| GB | 2528468 | A | 7/2014 | |
| WO | WO-2015007969 | A1 * | 1/2015 | H04L 12/2838 |
| WO | WO-2015017805 | A1 * | 2/2015 | G08B 13/08 |
| WO | 2016196583 | A1 | 8/2016 | |

OTHER PUBLICATIONS

United Kingdom Intellectual Property Office, UK Search Report issued in Application GB1616246.3, dated Jan. 16, 2017, 1 page.
United Kingdom Intellectual Property Office, UK Search Report issued in Application GB1715463.4, dated Mar. 20, 2018, 1 page.

* cited by examiner

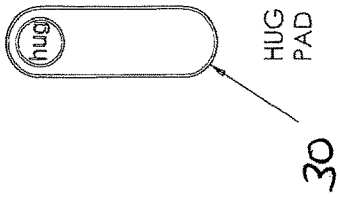
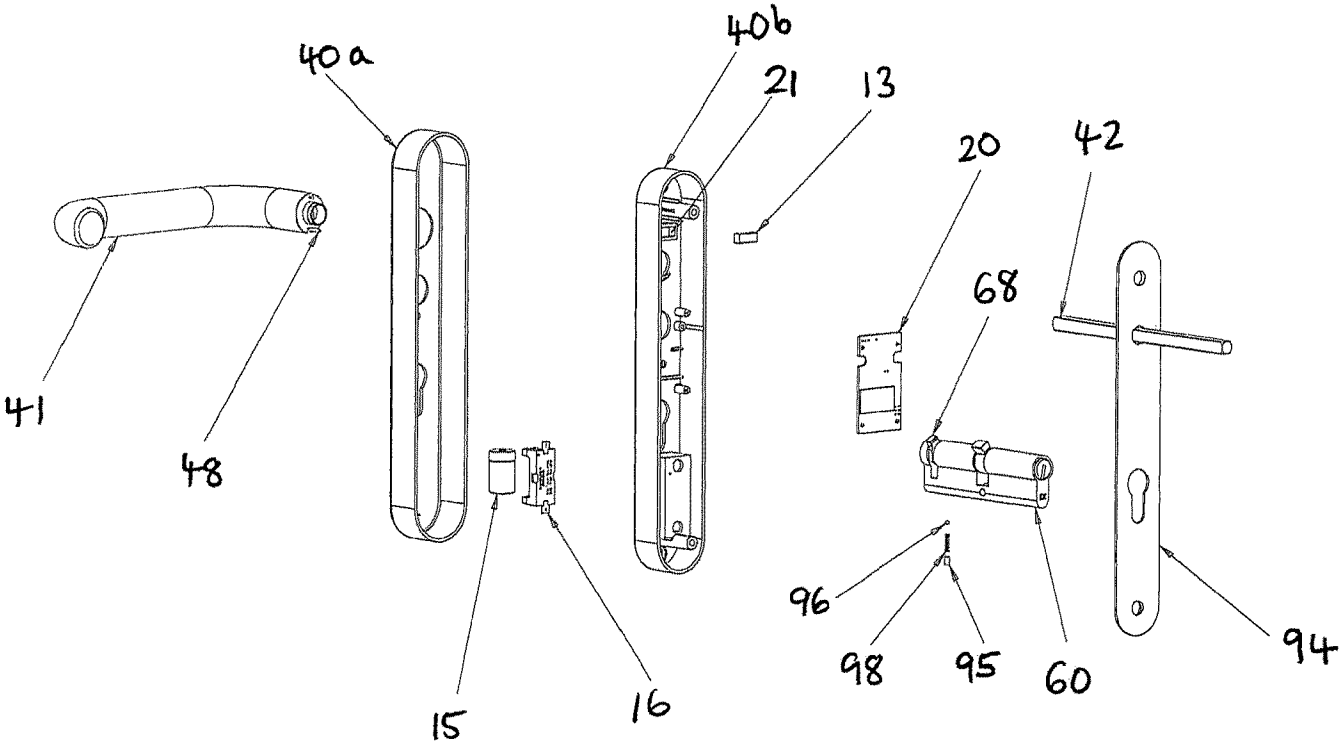
Fig. 4

OPEN

CLOSED

BACK

FRONT

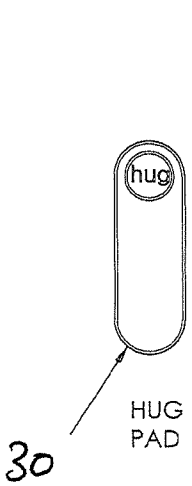
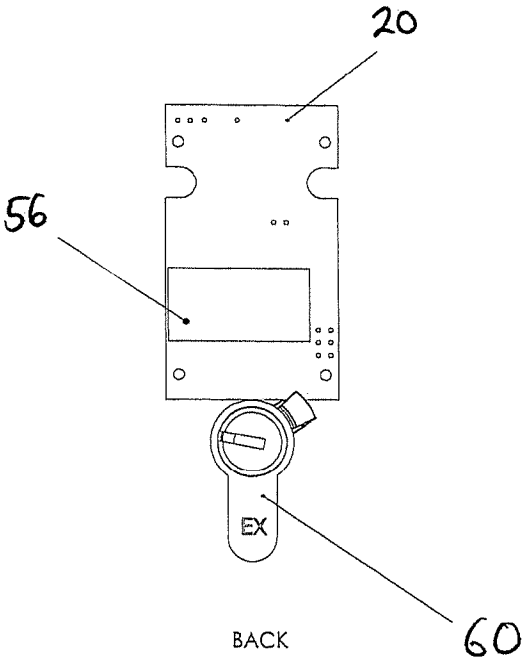
Fig. 8B
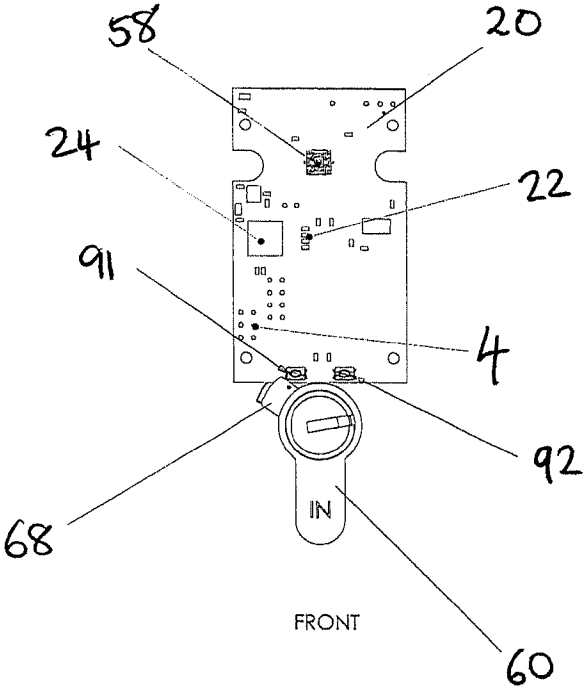
Fig. 8A

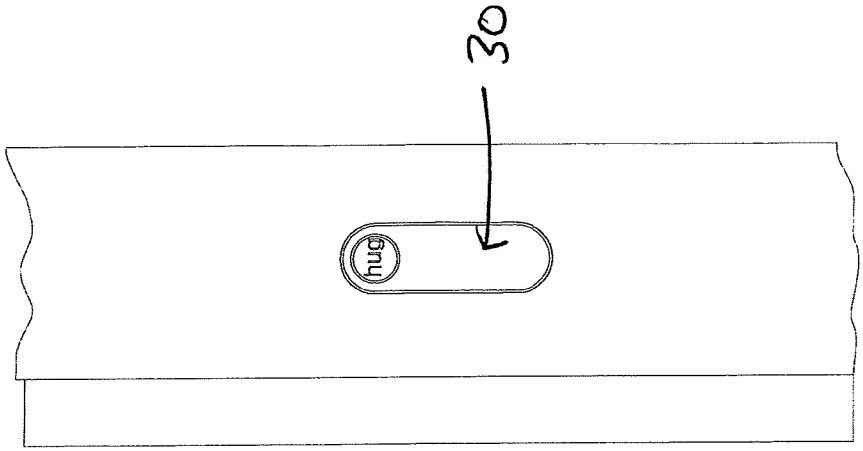
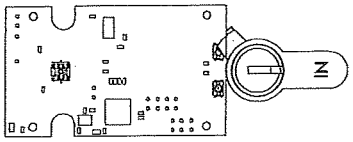
FIG C
Fig. 9C
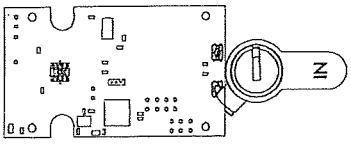
FIG B
Fig. 9B
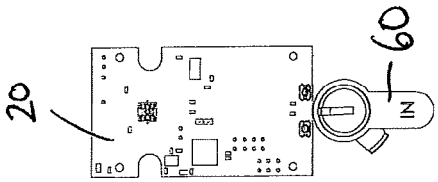
FIG A
Fig. 9A

BUILT INTO HANDLE
(Hugpad into handle)

LOCK LATCH (PRESS BUTTON (A) TO RELEASE)
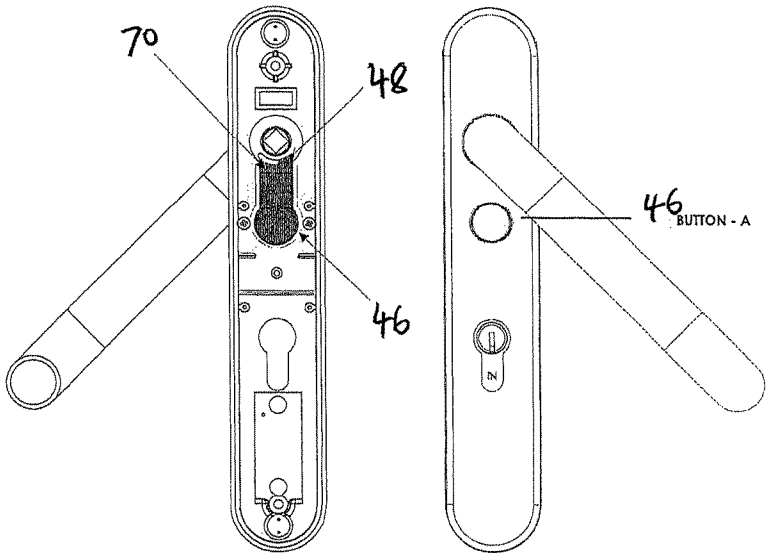
FRONT Fig. 20D
BACK Fig. 20C
CHILD SECURITY LATCH (PRESS BUTTON (A)TO RELEASE)
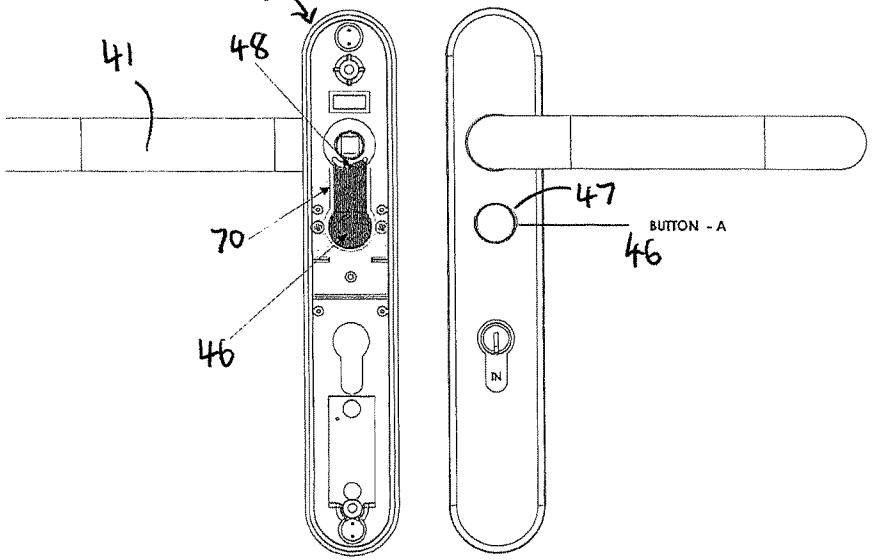
FRONT Fig. 20B
BACK Fig. 20A
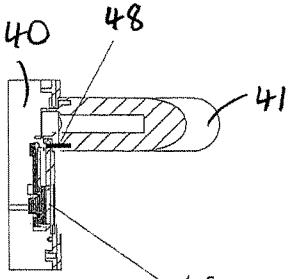
OPEN Fig. 20F
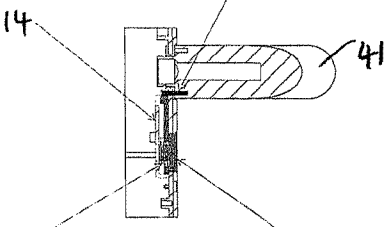
SHUT Fig. 20E
SECTION VIEW
No 20

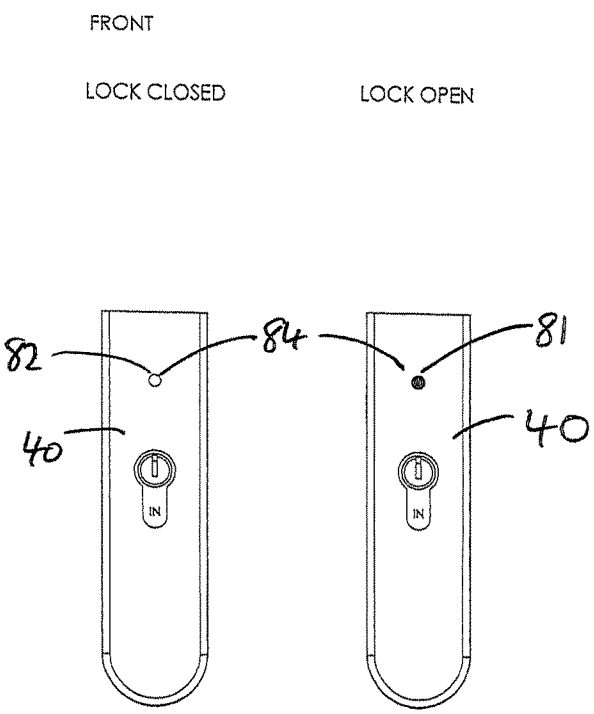
FIG D
Fig. 23D
FIG E
Fig. 23E
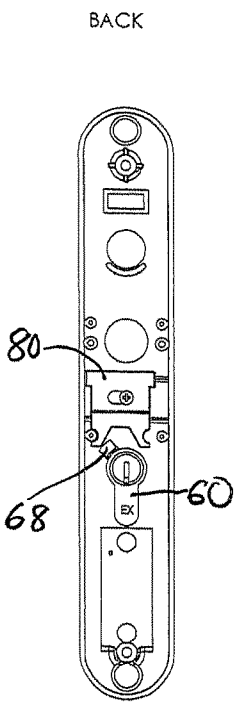
FIG C
Fig. 23C
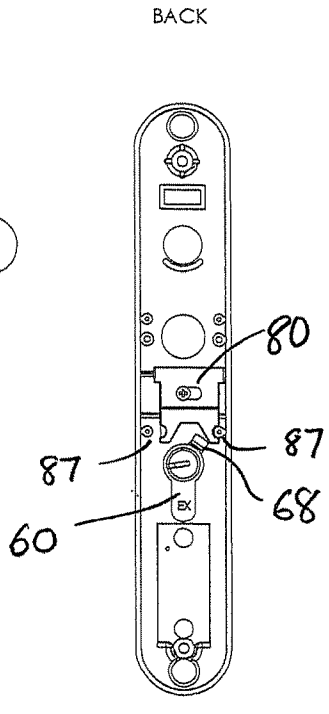
FIG B
Fig. 23B
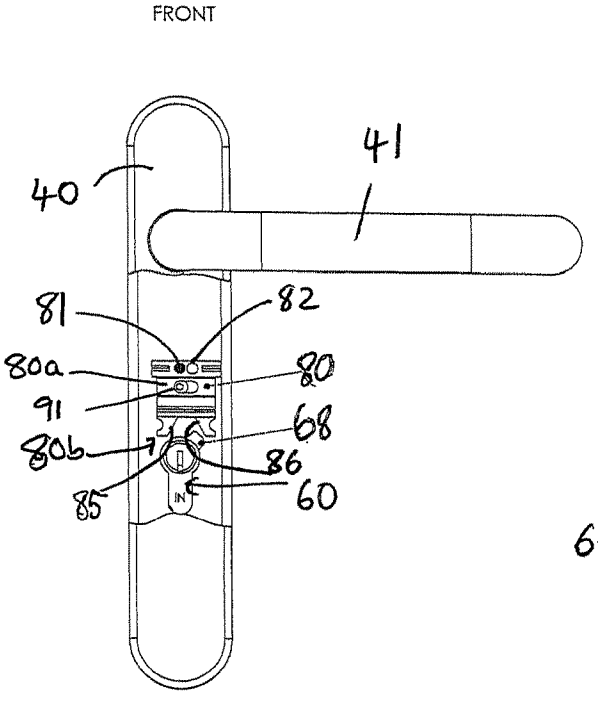
FIG A
Fig. 23A

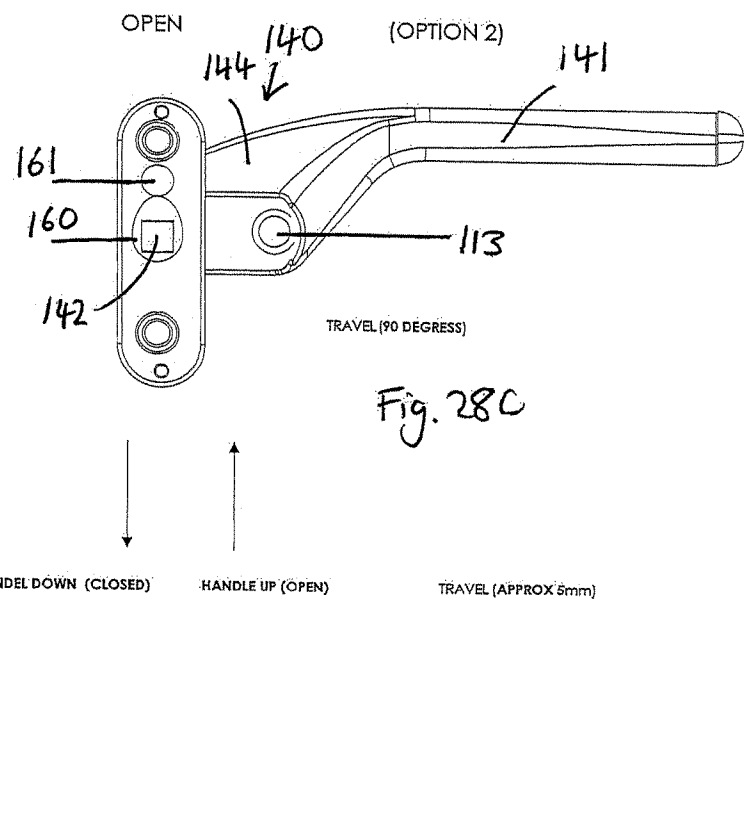
Fig. 28C
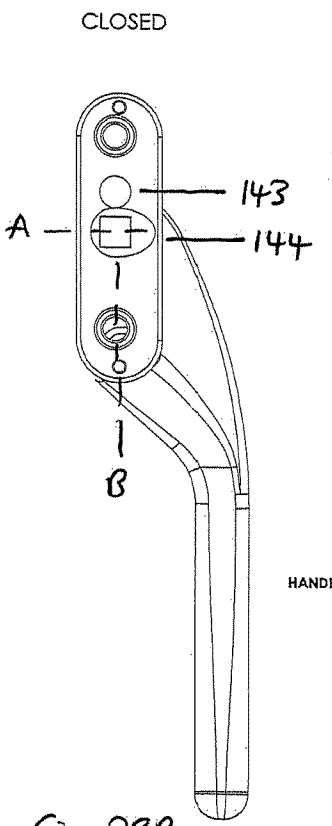
Fig. 28B
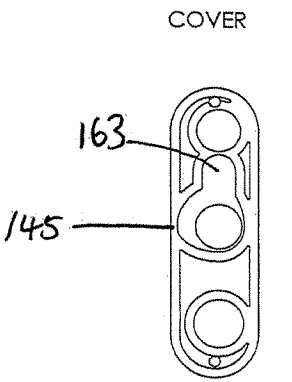
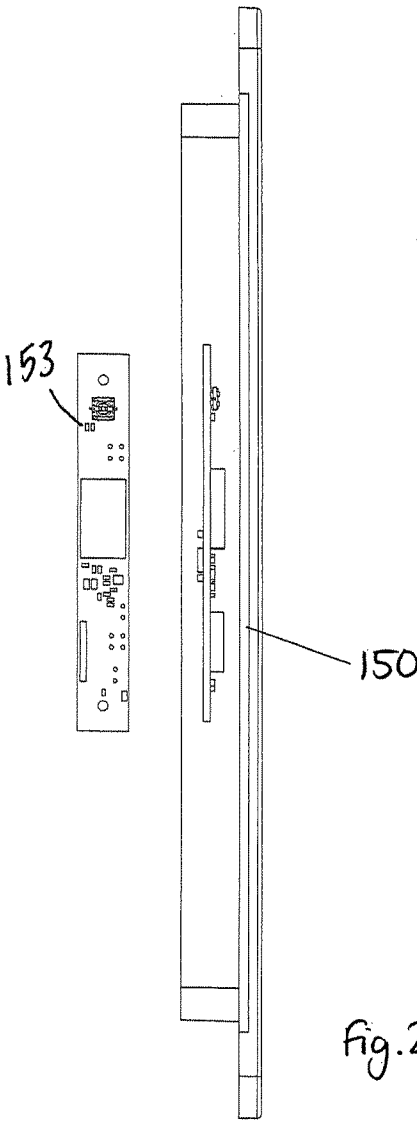
Fig. 28A

Key Locked

Key Unlocked

SYSTEM FOR DETECTING THE STATUS OF A WINDOW OR DOOR ASSEMBLY

FIELD OF THE INVENTION

The present invention relates to security systems and devices for windows and doors. The invention also relates to methods employing such systems or devices.

BACKGROUND TO THE INVENTION

Detection systems that detect whether a door/window has been opened are available. Such detection systems include a magnet and a reed switch. The magnet is installed onto the leaf and the reed switch onto the frame, or vice versa. The reed switch is activated when the magnet is proximate to the reed switch (i.e. when the door/window is closed). A disadvantage with such systems is that they are only able to detect whether a leaf is open or closed, not how far the leaf has been opened. Security systems which improve upon existing reed switch systems for detecting whether a door/window has been opened and optionally monitor other attributes of the door/window and optionally offer other security features would be desirable.

SUMMARY OF THE INVENTION

According to a first aspect of the invention there is provided a system for detecting the position of at least one moveable element of a window or door assembly, the system comprising:

at least one sensor for sensing a magnetic field, the at least one sensor being configured such that the magnetic field sensed changes as the at least one moveable element moves; and processor means configured to receive output signals associated with the sensed magnetic field from the sensor and to determine the position of the at least one moveable element;

wherein the system is configured to operate in a calibration mode and a normal mode, wherein in the calibration mode the system is configured to register at least an output value from the at least one sensor when the at least one moveable element is at a first predetermined position as a corresponding first reference value and wherein in the normal mode the processor means is configured to use at least the first reference value in determining the position of the at least one moveable element.

The sensor can sense changes in the earth's magnetic field as the moveable element moves. For example, the sensor may be mounted to the moveable element. Alternatively the sensor can sense a reference magnetic field of a magnetic field generator, the sensor and magnetic field generator moving relative to one another as the moveable element moves.

The moveable element of a window or door may be an element such as a window/door leaf, a window/door handle, or a window/door locking element. The sensor is suitably configured to output signals associated with the measured magnetic field from the earth's magnetic field or generated by a reference magnetic field of at least one magnetic field generator. The sensor may for example output magnetic field values as output values. The processor means is configured to provide an output indicating the position of the moveable element relative to a support.

The processor means may be a microprocessor or electrical circuit means. The processor/electrical circuit means may be configured to provide an output indicating if the leaf is at the predetermined position.

By means of calibration of the system, the system is suitably able to detect and therefore indicate if the moveable element is in certain predetermined discrete positions. For example, if the moveable element is a door or window handle, the system, in normal mode, may be able to detect and indicate whether the handle is open or closed. In such an embodiment, if the sensor is located on the door/window frame, the sensor may also be able to detect and indicate the position of the door/window leaf that the handle is on, e.g. to detect whether it is closed, slightly open (e.g. a nightvent position) or more than slightly open etc.

According to a further aspect of the invention there is provided a system for detecting the position of at least one moveable element of a window or door assembly, the system comprising:

at least one sensor for sensing a magnetic field, the at least one sensor being configured such that the magnetic field sensed changes as the at least one moveable element moves; and processor means configured to receive output signals associated with the measured magnetic field from the sensor and to determine the position of the at least one moveable element.

Said at least one moveable element may be a window or door leaf, in which case the system may be used to detect the position of the leaf (i.e. open or closed etc). Said at least one moveable element may alternatively be an element which moves during operation of a latch mechanism associated with the window or door that allows opening and closing of the leaf. In this case, the system may be used to detect the position of the moveable element which moves during operation of the latch mechanism and therefore determine the status of the latch mechanism (i.e. secured or unsecured etc). The system may be configured to monitor the position of more than one different moveable element of a window or door assembly.

Preferably the system further comprises at least one magnetic field generator, one of said at least one magnetic field generator and at least one sensor being mounted to the moveable element in use and the other of the at least one magnetic field generator and at least one sensor being mounted to a reference structure that the moveable element is moveable relative to.

In some embodiments one of the at least one magnetic field generator and the sensor may be mounted to a window/door frame and the other may be mounted to a window/door leaf, directly or indirectly. If mounted indirectly, they may be mounted to an element that is mounted to the leaf or frame for example. The reference structure may be any support structure that the moveable element moves relative to, such as the leaf, frame, a wall, or other suitable structure as may be suitable for the particular embodiment in question.

Preferably the system includes memory for storing output values provided by the at least one sensor. The system's memory can store one or more output values provided from the at least one sensor when the system is in the calibration mode or can store any reference value derived from the at least one output value.

Preferably said at least a first reference value is a function of the output value registered when said at least one moveable element is at said first predetermined position.

Preferably in the calibration mode the system is configured to register as reference values an output value from the at least one sensor when said at least one moveable element is positioned at each of at least two different predetermined positions, and wherein the processor means is configured to establish calibration parameters, using the reference values, that correlate magnetic field output from the at least one sensor when the system is in the normal mode with a known position of the at least one moveable element and wherein in the normal mode the processor means is configured to provide an output indicating the position of the at least one moveable element.

The system's memory can store the output value from the at least one sensor in the calibration mode and/or the calibration parameters that are established from the reference values obtained when the moveable element is at the at least two different predetermined positions.

The predetermined positions that a window or door leaf as the moveable element can be registered in relative to the frame may be a closed position and a particular open position, such as a 45° open position (if it is a casement window) or the night-vent position (defined by a night vent keep mounted to the frame for receiving a locking element mounted to the leaf, in order to maintain the leaf at a position which is slightly open to allow ventilation).

Preferably in the calibration mode the system is configured to register as reference values an output value from the at least one sensor when the at least one moveable element is positioned at each of plurality of different predetermined positions, and wherein the processor means is configured to establish calibration parameters, using the reference values, that correlate magnetic field output from the at least one sensor when the system is in the normal mode with a known position of the at least one moveable element and wherein in the normal mode the processor means is configured to provide an output indicating the position of the at least one moveable element.

The system can be calibrated by moving the moveable element to a plurality of different predetermined positions when in the calibration mode and registering the output of the sensor at those positions to establish the calibration parameters.

Preferably the system further comprises a user interface

Preferably the user interface is configured for providing a signal to the processor means indicative of when the at least one moveable element is in a predetermined position. This facility is for use during the calibration mode in order to register the moveable element at the or each predetermined position. For example, when the system is in the calibration mode, the moveable element can be moved to a predetermined position and once in the predetermined position the user can cause a signal to be provided to the processor means indicative of when the moveable element is in the predetermined position via suitable interaction with the user interface. The user interface may be a switch means or a touch screen interface or the like and may be a device that is remote from the leaf and frame. The system may include wireless transmission means, such as RF transmission means, to allow transmission of the signal indicative of when the leaf is in a predetermined position from the user interface to the processor means.

Preferably the at least one moveable element is a leaf of a door or window, the leaf being moveable relative to a frame between closed and open positions, one of said at least one magnetic field generator and at least one sensor being mounted to the leaf and the other being mounted to the reference structure.

Preferably in the calibration mode the system is configured to register an output from the at least one sensor when the leaf is at the closed position.

Preferably in the calibration mode the system is configured to register an output value from the at least one sensor when the leaf is at a slightly open or night vent position.

The system may be further configured to register an output from the at least one sensor when the leaf is at an open position, such as a position which is further open than the night vent position or when the leaf is open at a particular predetermined angle relative to the frame.

Preferably the system further comprises a handle assembly to allow opening and closing of the leaf, the handle assembly comprising a handle casing from which extends a handle grip wherein one of the at least one magnetic field generator and at least one sensor is mounted within the handle casing and the other of the at least one magnetic field generator and at least one sensor is mounted to the reference structure.

Mounting of the magnetic field generator or sensor within the handle casing provides a pre-defined location for that element on the leaf, which makes installing, including calibration, of the system easier.

Preferably the at least one moveable element is configured to move upon movement of a handle that is moveable between open and closed positions to allow opening and closing of a leaf of the window or door.

Preferably the moveable element is mounted to the leaf of the window or door. The moveable element may be the handle grip or it may be a locking drive rail of a locking mechanism such as an espagnolette locking mechanism for example.

Preferably the moveable element is a handle grip moveable between open and closed positions to allow opening and closing of a leaf of the window or door, one of said at least one magnetic field generator and at least one sensor being mounted to the handle grip in use and the other being mounted to the reference structure in use.

Preferably in the calibration mode the system is configured to register an output from the at least one sensor when the handle is in a closed position.

Preferably in the calibration mode the system is configured to register an output from the at least one sensor when the handle is in an open position.

Preferably the system further comprises a locking mechanism having a locking drive rail that can be driven between a locked position and an unlocked position, one of said at least one magnetic field generator and at least one sensor being mounted to the locking drive rail in use and the other being mounted to the reference structure in use.

Preferably in the calibration mode the system is configured to register an output from the at least one sensor when the locking drive rail is in a locked position.

Preferably in the calibration mode the system is configured to register an output from the at least one sensor when the locking drive rail is in an unlocked position.

Preferably the moveable element is configured to be moveable in use within three coordinate axes. A magnetic field generator or sensor mounted to a leaf of a window or door may move within two coordinate axes as the leaf is opened and closed, however a magnetic field generator or sensor mounted to a moveable element on the leaf that is configured to move upon movement of a handle will move within three coordinate axes as the moveable element moves relative to the leaf and as the leaf itself moves. The moveable element may be a handle grip or locking drive rail for example. The system is configured to detect the position of the moveable element in three coordinate axes. For example, the sensor may be a three axis magnetometer.

Preferably wherein the processor is configured to use at least one value relating to a dimension of the leaf as an input in determining the position of the leaf.

Preferably the system is configured to allow a user to input at least one value relating to a dimension of the leaf. The system may include a user interface for inputting at least one dimension of the leaf or it may include a programming port for receiving an input relating to a dimension of the leaf. The user interface may include a data input interface. The data input interface may be a key pad or touch screen or other suitable interface. For a casement window, the dimension of the leaf from the hinged edge to the edge that engages the jamb may be input into the system for example. Input of such a dimension assists in extrapolating expected output values of the sensor when the leaf is at or near a fully open position, even if the leaf was not registered at such an extent of opening during the calibration process. This means that the same system can more easily be used with different sizes of leaf.

According to a further aspect of the invention there is provided a method for calibrating a system for detecting the position of a moveable element of a door or window, the system comprising at least one sensor for sensing a magnetic field, the at least one sensor being configured such that the sensed magnetic field changes as the moveable element moves, and processor means configured to receive signals associated with the sensed magnetic field from the sensor, the system being configured to operate in a calibration mode or a normal mode, the method comprising:

when the system is in calibration mode, registering an output from the at least one sensor when the moveable element is at a first predetermined position.

If the moveable element is not already in the predetermined position, prior to registering the output from the sensor, the moveable element should be moved to the predetermined position.

The above method may be for calibrating a system having any of the features as described above.

Preferably system further comprises a user interface for providing a signal to the processor means indicative of when the at least one moveable element is in a predetermined position, the method further comprising the step of using the user interface to provide a signal to the processor means indicative of when the at least one moveable element is at the first predetermined position in order to register the output from the at least one sensor.

Preferably the method further comprises the step of using the user interface to provide a signal to the processor means indicative of when the at least one moveable element is in a series of at least two predetermined positions to register the output from the at least one sensor in each predetermined position.

The method may be carried out for a plurality of predetermined positions.

Preferably the method comprises:

when the system is in calibration mode, registering an output from the at least one sensor, when the window or door is in each of at least the following conditions, in any order:

(a) the leaf is closed and the handle is closed;

(b) the leaf is closed and the handle is open;

(c) the leaf is open.

The method may further include registering an output from the at least one sensor when (d) the leaf is in a slightly open or nightvent position.

Preferably the at least one moveable element is a leaf of a door or window, the leaf being moveable relative to a frame between closed and open positions, one of said at least one magnetic field generator and at least one sensor being mounted to the leaf and the other being mounted to the reference structure, the system further including a secondary detection system for detecting a status of the window or door and providing an output indicating the status.

Preferably the secondary detection system is configured to determine whether the leaf is in a status in which it can be freely opened from outside.

In other words the secondary detection system can provide an output to the system indicating whether the door or window is secure from the outside. For a door, this may be an indication as to whether the door is locked or unlocked. For a window that does not have a handle on the outside, this may be an indication as to whether the window handle is open or closed or whether a locking drive rail is latched in a locked position or unlatched in an unlocked position.

Preferably the system is configured to operate in a low power mode or a normal power mode. Whilst the system is in a low power mode the at least one sensor may cease from sensing magnetic field values or may sense magnetic field values less frequently than in a normal power mode. By converting the system to a low power mode if the secondary detection system indicates that the leaf is closed, the handle is closed, or the leaf latch is engaged for example, power can be saved. If the secondary detection system provides an output indicating that the leaf has been opened, the handle has been opened or the leaf latch is disengaged, then the sensor can be converted from a low power mode to a normal power mode. The system may be configured to convert from normal power mode to low power mode if the secondary detection system provides a predetermined output. Similarly the system may be configured to convert from low power mode to normal power mode if the secondary detection system provides a predetermined output. The system may also be configured to convert from low power mode to normal power mode if a door bell is rung, in which case the system includes means for receiving an input from the doorbell.

Preferably the secondary detection system detects whether the leaf is in an open or closed position and provides an output indicating whether the leaf is in an open or closed position, the processor means being configured to maintain the system in, or convert the system to, a low power mode if the secondary detection system indicates the leaf is in a closed position.

Preferably the system further comprises a handle assembly comprising a handle grip for actuating a latch mechanism to allow opening or closing of the leaf, wherein the secondary detection system detects whether the handle grip is in an open position or a closed position, the processor means being configured to maintain the system in or convert the system to a low power mode if the secondary detection system indicates the handle is in a closed position.

Preferably the secondary detection system comprises at least one magnetic field generator and at least one sensor for sensing the magnetic field generated by the at least one magnetic field generator, one of said at least one magnetic field generator and sensor being configured to be mounted such that it is moveable upon movement of the handle and the other of which is configured to be mounted such that it is non-moving upon movement of the handle.

The magnetic field generator and sensor of the secondary detection system may comprise the same magnetic field generator and sensor for determining the position of a leaf as the moveable element. Alternatively the system may have, for example, a pair of sensor and a magnet or a pair of magnets and a sensor arranged accordingly, one on the frame, one fixed relative to the leaf and one on a moveable element that moves upon movement of the handle.

Preferably one of said at least one magnetic field generator and at least one sensor is mounted to the handle grip in use.

The other of said at least one magnetic field generator and at least one sensor may be mounted to the frame. Said one of the at least one magnetic field generator and sensor that is mounted to the handle is mounted at a location that is distanced from the handle pivot axis. In this way the magnetic field generator or sensor will rotate along an arc as the handle is rotated. The processor means may be configured to receive signals associated with the measured magnetic field from the sensor to determine whether the handle is in the closed position or open position. The sensor may be a magnetometer or other suitable sensor. Preferably the magnetic field generator is a magnet mounted to the handle and the sensor is a magnetometer mounted to the frame. Preferably the sensor is mounted in a housing that is mounted to the frame.

Preferably the handle assembly further comprises a spindle connected to the handle grip such that as the handle grip is rotated, the spindle rotates, the handle assembly further comprising a cam and a cam follower, the cam being mounted around the spindle such that as the spindle rotates, the cam rotates, wherein the cam follower is moveable due to rotation of the cam, the cam follower comprising either said magnetic field generator or said sensor. Rotation of the handle causes rotation of the spindle, causing rotation of the cam mounted around the spindle, thereby causing the cam follower to move linearly. When the handle is in the closed position the cam follower is in a first position and when the handle is in the open position the cam follower is in a second position, linearly displaced from the first position. The handle assembly may be part of a system further comprising processor means configured to receive signals associated with the measured magnetic field from the sensor to determine whether the handle is in the closed position or open position. The sensor may be a magnetometer or other suitable sensor. Preferably the magnetic field generator is a magnet mounted in the base plate and the sensor is a magnetometer mounted to the frame. Preferably the sensor is mounted in a housing that is mounted to the frame.

Preferably the system further comprises a locking mechanism for the leaf, the locking mechanism comprising a locking drive rail and a drive mechanism whereby the locking drive rail can be driven by movement of the handle between a locked position and an unlocked position, wherein the secondary detection system comprises a sensed element and a sensor for detecting the position of the sensed element, one of said sensed element and sensor being mounted to the locking drive rail in use. The other of the sensed element and sensor may be mounted to the frame.

Preferably said sensed element is a magnetic field generator and said sensor is configured to sense a magnetic field generated by the magnetic field generator. The system may include processor means configured to receive signals associated with the measured magnetic field from the secondary sensor to determine whether the locking drive rail is in the locked position or unlocked position. By monitoring the magnetic field measured by the sensor the system can provide an output as to whether the locking drive rail is in the locked position or unlocked position and therefore whether the handle is in an open position or a closed position (since movement of the locking drive rail is driven by movement of the handle). The sensor may be a magnetometer or reed switch or other suitable sensor. Preferably the magnetic field generator is a magnet mounted to the locking drive rail and the sensor is a magnetometer mounted to the frame. Preferably the sensor is mounted in a housing that is mounted to the frame.

Preferably the system further comprises a locking mechanism for the leaf, the locking mechanism comprising a locking drive rail and a drive mechanism whereby the locking drive rail can be driven between a locked position and an unlocked position by movement of the handle, the locking mechanism further comprising a projection and a sensor for sensing the projection, one of which is mounted to the locking drive rail in use.

Preferably the projection is mounted to the locking drive rail in use and the sensor is mounted to the frame in use.

Preferably the sensor is a switch.

The sensor is suitably some sort of mechanical means for sensing the projection, such as a mechanical switch that is activated if the protrusion passes over the switch, for example a rocker switch that is caused to move to a first position by movement of the projection in a first direction and that is caused to move to a second position by movement of the projection in the other direction.

Preferably the window or door has a latch mechanism to allow opening and closing of the leaf, the latch mechanism being moveable between a secured configuration and an unsecured configuration, the system further comprising at least one magnetic field generator, one of said at least one magnetic field generator and at least one sensor being mounted to the leaf in use and the other being mounted to a reference structure that the leaf moves relative to in use, wherein in the calibration mode the system is configured to register a first output from the at least one sensor when the leaf is in the closed position and when the latch mechanism is in the unsecured configuration and a second output from the at least one sensor when the leaf is in the closed position and the latch mechanism is in the secured configuration.

It has been found that simply with a one of a magnetic field generator and sensor mounted somewhere on the leaf and the other mounted on a reference structure that the leaf moves relative to, that the system can be calibrated to indicate not only the position of the leaf (open or closed etc), but also to indicate whether the leaf is secured or unsecured relative to the frame (e.g. by a locking bolt that secures the leaf relative to the frame). By calibrating the system prior to use, the small change in position of the leaf relative to the reference structure between a secured configuration and an unsecured configuration can be detected.

Preferably the latch mechanism is operated using a handle assembly having a handle grip, the handle grip being moveable between a closed position, in which the latch mechanism is in its secured configuration, and an open position, in which the latch mechanism is in its unsecured configuration, and wherein in the calibration mode the system is configured to register a first output from the at least one sensor when the leaf is in the closed position and the handle is in the open position and a second output from the at least one sensor when the leaf is in the closed position and the handle is in the closed position. Following calibration, with a one of a magnetic field generator and sensor mounted somewhere on the leaf and the other mounted on a reference structure that the leaf moves relative to, it is possible to determine using the system whether the handle is open or closed, simply by monitoring the position of the leaf.

According to a further aspect of the invention there is provided a detection assembly for a window or door, the window or door having a leaf and a frame, the leaf being moveable relative to the frame between a closed position and an open position, the window or door having a latch mechanism to allow opening and closing of the leaf, the window or door including at least one moveable element which moves relative to a reference structure during operation of the latch mechanism, the assembly comprising:

at least one sensed element; and at least one sensor for detecting at least one position of the sensed element; one of said at least one sensed element and sensor being configured for mounting to the moveable element, the other of the at least one sensed element and at least one sensor being configured for mounting to the reference structure such that a position of the moveable element relative to the reference structure can be detected.

Suitably one of the at least one sensed element and at least one sensor is configured to be moveable upon operation of the latch mechanism and the other is configured to be non-moving upon operation of the latch mechanism. The other of said sensed element and sensor that is configured to be non-moving upon movement of the latch mechanism is preferably configured to be mounted to a support that is fixed relative to the moveable element during operation of the latch mechanism such as the window/door frame or the window/door leaf. The assembly may be configured to detect the position of the moveable element within a continuous range of possible positions or to detect whether it is at at least one predetermined discrete position. For example, the assembly may be configured to detect whether the moveable element is at either of two positions. The term latch mechanism as used herein can refer to any mechanism involved in latching a leaf to a frame, which may include a holding means for holding a leaf relative to a frame such as latch, a lockable latch or a lock mechanism etc.

Preferably the sensed element is a magnetic field generator and the sensor is configured to sense the magnetic field generated by the at least one magnetic field generator.

The sensor is configured to output signals from which the position of the sensed element relative to the sensor can be derived. One of the at least one sensed element and at least one sensor may be mounted to a moveable element that is mounted to the leaf and the other may be mounted to the frame such that the position of the moveable element relative to the frame (when it is in close enough proximity to the frame) and also of the leaf can be detected.

Preferably the assembly further comprises processor means configured to receive output signals from the sensor, the processor being configured to determine a position of the moveable element.

The processor means may be configured to determine whether the moveable element is generally located at at least one particular position relative to the support, which can provide an indication as to the status of the latch mechanism (for example, as latched or unlatched).

Preferably one of the at least one sensed element and at least one sensor is configured for mounting to the leaf, the processor means being configured to determine a position of the moveable element relative to the reference structure, at least when the leaf is in the closed position, and the processor means also being configured to determine a position of the leaf relative to the frame.

The moveable element that moves relative to the reference structure during operation of the latch mechanism can move independently of the leaf and the leaf can move independently of the moveable element (if the latch mechanism is unlatched). If the moveable element is mounted to the leaf to move relative to the leaf during operation of the latch mechanism, the moveable element will move with the leaf when the leaf moves. The detection assembly is configured to determine the position of both the moveable element (at least when the leaf is in the closed position) and the leaf relative to the frame. The processor means is suitably configured to determine a position of the moveable element relative to the reference structure, at least when the leaf is in the closed position or when the leaf is in close proximity to the frame. Preferably the moveable element is configured to be moveable in use within three coordinate axes. Preferably the detection assembly is configured to detect at least a position of the moveable element in three coordinate axes. For example, the sensor may be a three axis magnetometer.

Preferably the moveable element moves in a first degree of freedom or set of degrees of freedom during operation of the latch mechanism and the moveable element moves in a second degree of freedom or set of degrees of freedom during opening and closing of the leaf, the processor being configured to detect the position of the moveable element within the first degree of freedom or set of degrees of freedom, at least when the leaf is closed, and also configured to detect the position of the moveable element within the second degree of freedom or set of degrees of freedom.

Preferably the moveable element is mounted to the leaf in use.

Preferably said at least one moveable element which moves during operation of the latch mechanism is a handle for actuating the latch mechanism, the handle having a handle grip which is mountable pivotally via a pivot axis to the leaf or frame such that it can be rotated about the pivot axis between a closed position and an open position, one of said at least one sensed element and sensor being configured for mounting to the handle grip in use.

One of said sensed element and sensor may be mounted to the handle grip and the other of said sensed element and sensor may be mounted to a reference structure such as the handle casing or the frame for example. Said one of the at least one sensed element and sensor that is mounted to the handle grip may be mounted at a location that is distanced from the handle pivot axis. In this way the sensed element or sensor will rotate along an arc as the handle is rotated. In this way the sensed element or sensor that is mounted to the handle grip will change position when the handle is rotated. The handle assembly may be part of a system further comprising processor means configured to receive output signals from the sensor to determine whether the handle is in the closed position or open position. The sensed element may be a magnetic field generator and the sensor may be configured to sense the magnetic field generated by the magnetic field generator. In some embodiments the sensed element is a magnetic field generator such as a magnet and is mounted on the handle grip in use and the sensor is a magnetometer mounted to the frame in use. In such embodiments the sensor may be mounted in a housing that is mounted to the frame in use. In other embodiments the detection assembly is a mechanical switch built into the back plate of the handle, the switch being configured to actuate when the handle is opened and closed. The detection assembly is suitably configured to detect whether the handle grip is in an open or closed position.

Preferably the handle assembly is for actuating a latch mechanism to allow opening and closing of the leaf, the handle assembly comprising a handle grip mountable pivotally via a pivot axis to the leaf or frame such that the handle grip can be rotated about the pivot axis between a closed position and an open position, the handle assembly comprising a detection assembly according any aspect described above, one of said at least one sensed element and sensor being mounted to the handle grip in use and the other being mounted to said reference structure.

Preferably the handle assembly is for actuating a latch mechanism to allow opening and closing of the leaf, the handle assembly comprising a handle grip mountable pivotally via a pivot axis to the leaf or frame such that the handle can be rotated about the pivot axis between a closed position and an open position, the handle assembly comprising a detection assembly according any aspect described above, the handle assembly further comprising a spindle connected to the handle grip such that as the handle grip is rotated, the spindle rotates, the handle assembly further comprising a cam and a cam follower, the cam being mounted around the spindle in use such that as the spindle rotates, the cam rotates, wherein the cam follower is moveable due to rotation of the cam, the cam follower comprising or having mounted thereto either said sensed element or said sensor.

Preferably the sensed element is a magnet and the sensor is a magnetometer or other sensor configured to sense the magnetic field generated by the sensed element.

Preferably one of said at least one sensed element and at least one sensor is configured for mounting to a locking drive rail of a locking mechanism that is part of the latch mechanism and the other of said at least one sensed element and at least one sensor is configured for mounting to the reference structure in use.

In some embodiments the reference structure that the other of the sensed element or sensor is mounted to in use is the frame. The locking drive rail is driven by movement of a handle of the window or door to move relative to the leaf longitudinally along the axis of the locking drive rail between locked and unlocked positions.

According to a further aspect of the invention there is provided a locking mechanism for a door or window comprising a locking drive rail and a drive mechanism whereby the locking drive rail is driven by movement of a handle, the locking mechanism further comprising a detection assembly according to any aspect of the detection assembly as described above, one of said at least one sensed element and at least one sensor being mounted to the locking drive rail in use and the other of said at least one sensed element and at least one sensor being mounted to the reference structure in use.

Preferably the locking drive rail has locking pins connected thereto in use. The locking pins are carried by the locking drive rail to move linearly as the locking drive rail moves. Alternatively or in addition to the locking pins the locking drive rail may have other elements for latching the window or door to the frame when the locking drive rail is in its locked position such as one or more latch, deadbolt, mushroom headed cam, or hook.

Preferably said at least one sensed element is a magnetic field generator and said at least one sensor is configured to sense a magnetic field generated by the magnetic field generator.

The locking drive rail preferably has an elongate axis, the locking drive rail being moveable parallel with its axis in use between a locked position and an unlocked position, the sensor being configured to detect movement of the sensed element as one of the sensed element and sensor moves back and forth along the locking drive rail axis during operating of the locking mechanism.

Preferably said at least one moveable element which moves during operation of the latch mechanism is a holding means, the holding means being moveable between a secured position and an unsecured position, one of said at least one sensed element and sensor being configured for mounting to the holding means in use. A magnet is suitably built into the holding means. The locking mechanism can be used as part of a monitoring system, incorporating a processor which is configured to receive output signals from the sensor, to monitor if the holding means is in its unsecured position or has been thrown.

Preferably said holding means is adapted for cooperating with a keep in use to secure the leaf to the frame.

Preferably said holding means is a locking bolt for cooperating with a keep in use to secure the leaf to the frame.

Preferably the holding means comprises a recess for mounting said at least one sensed element or sensor therein. Suitably the recess is shaped and sized to receive the sensed element.

Preferably the detection assembly further comprises a holding means moveable between a secured position and an unsecured position, one of said at least one sensed element and at least one sensor being mounted to the holding means in use and the other of said at least one sensed element and at least one sensor being mounted to the reference structure in use.

According to a further aspect of the invention there is provided a holding means for use with a detection assembly as described above wherein the holding means comprises a recess for receiving said at least one sensed element or sensor.

Preferably the holding means has a sensed element or sensor mounted in said recess.

Preferably said latch mechanism comprises a keep and a holding means for cooperating with the keep to secure the leaf to the frame, the holding means being moveable between an unsecured position and a secured position, the keep comprising a recess for receiving the holding means when the holding means is in the secured position, wherein said moveable element is arranged in or over the keep such that the moveable element is caused to move from a first position to a second position when the holding means is moved from an unsecured position to a secured position, and wherein one of said at least one sensed element and sensor is configured for mounting to the moveable element of the keep in use. By monitoring the position of the moveable element associated with the keep, the status of the holding means (secured or unsecured) can be determined.

According to a further aspect of the invention there is provided a keep for a door or window, the door or window having a leaf and a frame, the door or window having a latch mechanism to allow opening and closing of the leaf, the latch mechanism comprising a holding means for cooperating with the keep to secure the leaf to the frame, the holding means being moveable between an unsecured position and a secured position, the keep comprising a recess for receiving the holding means when the holding means is in the secured position, the keep further comprising a moveable element which is moveable between a first position and a second position and sensing means for sensing whether the moveable element is in at least one of the first position or the second position, the moveable element being caused to move from the first position to the second position when the holding means moves from the unsecured position to the secured position.

The location of the moveable element when it is in the second position may vary, for example depending on how far into the keep the holding means extends when in its secured position, which may vary depending on thermal expansion or contraction of the leaf for example.

In preferred embodiments the keep has a keep housing, the recess being in the keep housing.

Preferably the moveable element is biased towards the first position.

Preferably the moveable element is biased towards the first position by at least one spring.

In preferred embodiments said at least one spring is a compression spring. Suitably the spring is a helical compression spring.

Preferably the moveable element is configured to move away from the leaf as it moves from its first position to its second position.

Preferably the moveable element comprises a plate, the plate being located within the recess in the keep in use.

Preferably the sensing means comprises one of a sensed element and sensor for detecting at least one position of the sensed element, wherein the other of the sensed element and sensor is mounted to a reference structure such that the position of the moveable element relative to the reference structure can be detected. The reference structure may be the frame of the leaf or a wall close to the leaf for example.

Preferably the keep further comprises a detection assembly as described above.

Preferably said sensed element or sensor is configured for mounting to the moveable element of the keep. The sensed element is preferably a magnetic field generator mounted to the moveable element of the keep in use, such that the magnetic field generator is carried by the moveable element as it moves.

Preferably the sensing means comprises a switch for detecting at least one position of the moveable element.

Preferably the switch is a push switch. The push switch is suitably activated when the moveable element is in its second position. The switch is preferably a momentary switch that only remains activated while the switch is being pushed by the moveable element.

Preferably the switch comprises first and second resilient armatures that contact one another when the moveable element is in its second position. The first and second resilient armatures of the switch preferably each extend outwards from a switch base when the moveable element is in its first position and allow for the armatures to contact one another to activate the switch when the moveable element is within a range of continuous positions, to allow for variability in the location of the moveable element when in its second position (e.g. to account for thermal expansion/contraction in the door assembly).

Preferably the recess of the keep has a base, the switch being mounted to the base of the recess in use.

According to a further aspect of the invention there is provided a keep for use with a detection assembly as described above.

According to a further aspect of the invention there is provided a system for detecting a position of at least one moveable element of a window or door as described above, the window or door having a leaf and a frame, the leaf being moveable relative to the frame between a closed position and an open position, the window or door having a latch mechanism to allow opening and closing of the leaf, said moveable element moving relative to a reference structure during operation of the latch mechanism, the system further comprising a detection assembly, handle assembly or locking mechanism as described above, wherein said at least one sensed element is a magnetic field generator and said at least one sensor is configured for sensing a magnetic field generated by the at least one magnetic field generator, one of said at least one magnetic field generator and at least one sensor being configured for mounting to the at least one moveable element, the other being configured for mounting to the reference structure such that the position of the moveable element relative to the reference structure can be detected, the system further comprising processor means configured to receive output signals associated with the sensed magnetic field from the sensor and to determine the position of the moveable element, wherein the system is configured to operate in a calibration mode and a normal mode, wherein in the calibration mode the system is configured to register at least an output value from the at least one sensor when the at least one moveable element is at a first predetermined position as a first reference value and wherein in the normal mode the processor means is configured to use at least the first reference value in determine the position of the at least one moveable element.

Suitably any suitable aspect of the detection assembly as described above can be combined with the system for detecting a position of at least one moveable element of a window or door as described above.

The system can optionally be used to determine the position of both the leaf and the moveable element that moves during operation of the latch mechanism (at least when it is in close enough proximity to the sensor), the calibration mode allowing the system to be fine-tuned such that it is sensitive enough to determine the position of the moveable element which moves during operation of the latch mechanism, even if the movement of the movement is small.

In some embodiments one of the magnetic field generator and sensor is configured for mounting to the moveable element and the other is configured for mounting to the frame, and the moveable element is on the leaf (for example the moveable element may be a handle grip or locking drive rail of a locking mechanism). The sensor is able to detect the position of the moveable element relative to the leaf (when the leaf is in close enough proximity to the sensor) whereby the status of the latch mechanism can be determined (for example as latched or unlatched) and is able to detect the position of the leaf.

In other embodiments the system may have more than one magnetic field generator or more than one sensor. For example, the system may have a first magnetic field generator mounted to the moveable element, the moveable element being on the leaf, a second magnetic field generator mounted to the frame and a sensor mounted to the leaf such that the sensor can detect relative movement between the sensor and the first magnetic field generator and between the sensor and the second magnetic field generator. Alternatively the system may have a first sensor mounted to the moveable element, the moveable element being on the leaf, a second sensor mounted to the frame and a magnetic field generator mounted to the leaf such that the sensors can detect relative movement between the magnetic field generator and the first sensor and between the magnetic field generator and the second sensor.

According to a further aspect of the invention there is provided a locking mechanism for a door or window comprising a locking drive rail and a drive mechanism whereby the locking drive rail can be driven by movement of a handle for the door or window, the locking mechanism further comprising a magnetic field generator mounted on the locking drive rail in use.

Typically the locking mechanism will be configured such that the locking drive rail is moved linearly upwards by movement of the handle to a locked position. In such systems friction should maintain the locking drive rail in the locked position, however the weight of the system may cause the locking drive rail to drop out of the locked position, towards the unlocked position. The inventor has discovered that where a magnet is mounted on the locking drive rail (for example as the magnetic field generator in a sensor system of the present invention or otherwise), it has an advantage of retaining the locking drive rail in the unlocked position via magnetic attraction between the magnet and other ferrous parts of the window/door system, preventing the locking drive rail from dropping under gravity.

According to a further aspect of the invention there is provided a locking mechanism for a door or window comprising a locking drive rail and a drive mechanism whereby the locking drive rail can be driven by movement of a handle, the locking mechanism further comprising a projection and a sensor for sensing the projection, one of which is mounted to the locking drive rail in use and the other of which is mounted to a reference structure in use.

Preferably the sensed element is a projection and the sensor is configured for sensing at least one position of the projection, one of the projection and sensor being mounted to the locking drive rail in use and the other of which is mounted to the reference structure in use.

Preferably the projection is mounted to the locking drive rail in use and the sensor is mounted to the frame in use.

Preferably the sensor is a switch.

Preferably the locking drive rail has an elongate axis, the locking drive rail being moveable parallel with its axis in use between a locked position and an unlocked position, the sensor being configured to detect movement of the projection back and forth along the locking drive rail axis.

Preferably the sensor is configured to detect movement of the projection upon opening or closing of the leaf.

According to a further aspect of the invention there is provided a locking mechanism for a door or window, the locking mechanism comprising a locking drive rail and a drive mechanism whereby the locking drive rail can be driven by movement of a handle between a locked position and an unlocked position, the locking mechanism further comprising first and second pairs of interengageable mating elements, the first pair being configured to engage when the locking drive rail is in a locked position and the second pair being configured to engage when the locking drive rail is in an unlocked position.

The engagement of the first pair of interengageable mating elements with one another when the locking drive rail is in the locked position and similarly for the second pair when the locking drive rail is in the unlocked position provides a tactile indicator to the user that the locking drive rail is in its respective positions as the user can feel when the respective pairs of mating elements are engaged/disengaged.

Preferably the first and second pairs of interengageable mating elements each comprise mating elements that are configured to engage releasably via a snap-fit action.

Preferably each of the first and second pairs of interengageable mating elements comprises a male element and a female element, one of which is fixed relative to the leaf or frame and the other of which moves with the locking drive rail as the locking drive rail moves between its locked and unlocked positions.

Preferably each male element is barbed and each corresponding female element is correspondingly shaped to receive a barbed male element.

Preferably the locking mechanism further comprises a block mounted to or integral with the locking drive rail in use, the block having first and second ends at opposite ends of a block axis, the block being arranged in use with the block axis parallel with the elongate axis of the locking drive rail, the block having an element of the first pair of interengageable mating elements disposed at one of the first and second ends of the block and an element of the second pair of interengageable mating elements disposed at the other of the first and second ends of the block, the locking mechanism further comprising the other element of each pair of interengageable mating elements fixed relative to the leaf or frame and distanced from one another by a predetermined distance such that the first pair of interengageable mating elements engage when the locking drive rail is in the locked position and the second pair of interengageable mating elements engage when the locking drive rail is in the unlocked position.

Preferably the locking mechanism further comprises a casing to house the drive mechanism for the locking drive rail and wherein the interengageable mating elements which are fixed relative to the frame or leaf are mounted to or integral with casing for the drive mechanism.

According to a further aspect of the invention there is provided a cylinder lock comprising:

- a cylinder lock housing having a first bore for receiving a first rotatable lock driving member for rotation within the first bore;
- a first cam co-axial with and connectable to the first rotatable lock driving member for rotation therewith, the first cam being a locking cam adapted to operate a locking mechanism on rotation of the first cam; and
- a second cam co-axial with and connectable to the first rotatable lock driving member for rotation therewith, the second cam being a lock status indicator cam adapted to be operatively associated with lock status indicating means for indicating the locked or unlocked state of the cylinder lock.

Cylinder locks are known which typically have a cam that is actuated by a lock driving member which drives the cam and thereby actuates a locking bolt or other locking mechanism for locking a door or other leaf. Two examples of common lock cylinders are the "Euro Profile cylinder" and the "Scandinavian Oval cylinder". The lock driving member which drives the cam may be a key operated mechanism or a thumbturn mechanism. A drawback with existing cylinder locks is that it is difficult to determine whether the lock is in the locked or unlocked state without manually trying to open the leaf that the cylinder lock is mounted to.

The first rotatable lock driving member may be a cylindrical lock drum or plug. The cylinder lock has a first locked condition in which rotation of the first rotatable lock driving member has caused the first cam to put the locking mechanism into a locked state and a first unlocked condition in which rotation of the first rotatable lock driving member has caused the first cam to put the locking mechanism into an unlocked state. The lock status indicating means indicates whether the lock is in the first locked condition or first unlocked condition. In other words, the lock status indicating means can indicate the locked or unlocked state of the cylinder lock following operation of the first cam by the first rotatable lock driving member. It is common for people, when they are indoors, to wonder whether their doors with cylinder locks are locked or not, as they can be closed but unlocked and there is typically no way to determine if the lock is in the locked state or not without manually trying to open the door handle. For example, at night it is important to check external doors are locked or when leaving the house through the main door, a person may wish to check that other doors are locked before they leave the house.

The cylinder lock may be for use with a multipoint locking mechanism for a window or door. The cylinder lock embodying the invention can be retro-filled to any door/window to operate an existing lock mechanism such as a multi-point lock mechanism and also can be integrated into door/window production without modification to door preparation. Additional lock status indicating means can be provided in the handle which is mounted onto the door/window.

Preferably the second cam is spaced apart from the first cam along the axis of the cylinder lock.

Preferably the second cam comprises a radially projecting protrusion.

The radial projecting protrusion may be a lever. The first cam also comprises a radially projecting lever arm which operates a locking mechanism on rotation of the first cam (i.e. locking and unlocking of the locking mechanism is controlled via rotation of the first cam).

Preferably the second cam comprises a body portion and a radially projecting protrusion extending from the body portion.

Preferably the body portion of the second cam is C-shaped.

Preferably the body portion of the second cam is adapted to be mounted around the first rotatable lock driving member.

Where the body portion of the second cam is C-shaped it may be attachable to the cylindrical body of the first rotatable lock driving member via snap action.

Preferably the cylinder lock further comprises a first rotatable lock driving member mounted in the first bore.

The first rotatable lock driving member is suitably operatively connectable in use to the first cam and operatively connected in use to the second cam. The first rotatable lock driving member may be a cylindrical lock drum or plug that can be removed/replaced when servicing the cylinder lock.

Preferably the cylinder lock housing has a second bore for receiving a second rotatable lock driving member for rotation within the second bore.

In this case the cylinder lock is a double cylinder lock wherein the lock can be operated from either side of the leaf. The first bore for receiving the first rotatable lock driving member is at one end of the housing and the second bore for receiving the second rotatable lock driving member is at the other end of the housing. The first cam is co-axial with and connectable to the second rotatable lock driving member for rotation therewith, such that the second rotatable lock driving member can also drive the first cam.

According to a further aspect of the invention there is provided a lock assembly comprising a cylinder lock according to any aspect described above, the lock assembly further comprising lock status indicating means operatively associated with the second cam for indicating the locked or unlocked state of the cylinder lock.

Preferably the lock assembly is adapted such that at least part of the lock status indicating means is visible in use to visually indicate the locked or unlocked state of the cylinder lock.

Preferably the lock status indicating means comprises a cam follower which is moveable due to movement of the second cam.

The cam follower preferably converts rotary movement of the second cam to linear movement.

Preferably a portion of the cam follower is visible in use, whereby movement of the second cam causes the portion of the cam follower which is visible to alter in order to visually indicate the locked or unlocked state of the cylinder lock.

Preferably the cam follower comprises at least a locked indicium and an unlocked indicium thereon, the assembly being adapted such that the locked indicium is visible when the cylinder lock is in a locked state and the unlocked indicium is visible when the cylinder is in an unlocked state.

The locked indicium can be one colour and the unlocked indicium may be another colour. Suitably the locked indicium is exposed through a viewing aperture of the lock assembly when the cylinder lock is in a locked state and the unlocked indicium is exposed through the viewing aperture when the cylinder is in an unlocked state.

Preferably the cam follower comprises a body having a recess therein, the recess having opposing inner sides, whereby movement of the rotatable lock driving member to a locked state causes the protrusion of the second cam to engage one side, displacing the cam follower such that the locked indicium is exposed and whereby movement of the rotatable lock driving member to an unlocked state causes the protrusion of the second cam to engage the other side of the recess in the body, displacing the cam follower such that the unlocked indicium is exposed.

The recess may be a notch. Suitably movement of the rotatable lock driving member to a locked state causes the protrusion of the second cam to engage one side of the recess in the cam follower, displacing the cam follower such that the locked indicium is exposed through the viewing aperture and whereby movement of the rotatable lock driving member to an unlocked state causes the protrusion of the second cam to engage the other side of the recess in the cam follower, displacing the cam follower such that the unlocked indicium is exposed through the viewing aperture.

Preferably the lock assembly further comprises a cover plate which can be mounted on a window or door, the cover plate having a viewing aperture through which the lock status indicating means is visible in use to visually indicate the locked or unlocked state of the cylinder lock.

The cover plate may also have an opening for the cylinder lock. A portion of the cam follower may be visible through the viewing aperture in use, whereby movement of the second cam causes the portion of the body which is visible through the viewing aperture to alter in order to visually indicate the locked or unlocked state of the cylinder lock.

Preferably the cam follower is slidably coupled to part of the lock assembly.

The cam follower is preferably a slider. The body is coupled to the plate by a fixing which is received in an elongate slot in the body, the axis of the slot being parallel with the direction of sliding of the body as it moves between indicating a locked and unlocked state.

Preferably the lock status indicating means includes sensor means for sensing direction of movement of the second cam. Using such embodiments, if a person is about to leave the house by the front door, but wants to check if the back door, in another room, is locked, they do not need to manually go to the back door, but can check its status on a user interface for example.

Preferably the sensor means comprises a direction switch configured to output a first detection signal corresponding to a first movement direction of the second cam and a second detection signal corresponding to a second movement direction of the second cam.

Preferably the sensor means comprises first and second sensors, each of the sensors adapted to sense the movement of the second cam as it moves past the respective sensor, the first and second sensors being arranged adjacent one another such that when the second cam rotates in a clockwise direction the first sensor and then the second sensor will sense the second cam sequentially and when the second cam rotates in an anticlockwise direction, the second sensor then the first sensor will sense the second cam sequentially.

Preferably the lock assembly further comprising processor means adapted to provide an output indicating the direction of rotation of the second cam.

The processor means preferably provides an output indicating the direction of rotation of the second cam based on determining whether it passes the first switch followed by the second switch or vice versa. The direction of rotation of the second cam indicates whether the first rotatable lock driving member is rotating to lock or unlock the locking mechanism, thus indicating the locked or unlocked state. The processor means can be configured to generate a lock status signal that indicates whether the lock is in the locked or unlocked state. The assembly may include wireless transmission means, such as RF transmission means, to send the lock status signal to receiver means that is operatively associated with user display means for displaying the lock status to a user.

Preferably the sensor means comprises first and second switches.

The switches may be mechanical switches that are activated if the second cam rotates over the switch, for example rocker switches which are activated by engagement of the second cam with the switch as the second cam is rotated. The sensors may alternatively employ alternative means for sensing movement of the second cam, such as magnetic means.

According to a further aspect of the invention there is provided a cylinder lock comprising:

a first cylinder housing having a first bore;

a first rotatable lock driving member mounted in the first bore and adapted for rotation within the first bore, the first rotatable lock driving member having a plurality of detents arranged radially around its outside;

the cylinder lock further comprising a first ball bearing which is arranged to be biased into engagement with one of the plurality of detents on the outside of the first rotatable lock driving member.

In use the ball bearing engages with the detent which is adjacent the ball bearing, depending on the rotational position of the first rotatable lock driving member. When the first rotatable lock driving member is rotated, it rotates relative to the ball bearing such that the ball bearing is forced to engage in successive adjacent detents of the plurality of detents as the first rotatable lock driving member is rotated. This provides an audible sound, such as an audible click sound, as the first rotatable lock driving member is rotated which indicates to the user that the lock is being driven. As well as an audible sound, there may also be a tactile sensation caused by the ball bearing engaging with successive adjacent detents of the plurality of detents. The biased engagement of the ball bearing with a detent on the outside of the first rotatable lock driving member may also deter undesired rotation of the locking driving member.

Preferably the first rotatable lock driving member has a plurality of detents arranged radially around its outside, the cylinder lock further comprising a first ball bearing which is arranged to be biased into engagement with one of the plurality of detents on the outside of the first rotatable lock driving member.

Preferably the ball bearing is biased by a spring which urges the ball bearing towards the first rotatable lock driving member. The detents are preferably recessed areas in the outside surface of the first rotatable lock driving member shaped to receive the ball bearing therein.

Preferably each detent is an elongate channel having an axis parallel with the rotational axis of the first rotatable lock driving member. The first rotatable lock driving member is therefore easy to install for alignment with the ball bearing.

Preferably the first rotatable lock driving member is configured to receive a key for rotating the first rotatable lock driving member.

Preferably the first rotatable lock driving member includes a projecting knob. The projecting knob allows for thumb turn operation According to a further aspect of the invention there is provided a system, detection assembly, handle assembly, or locking mechanism according to any aspect as described above further comprising a cylinder lock or lock assembly according to any aspect as described above.

In the various systems, assemblies and locking mechanisms of the present invention, the at least one magnetic field generator is preferably a magnet. The magnetic field generator may be a permanent magnet. Alternatively the magnetic field generator may be an electromagnet. Preferably a magnetic field generator housing is provided receiving said at least one magnetic field generator, the magnetic field generator housing being mountable to the at least one moveable element or a reference structure. The at least one sensor for sensing a magnetic field is preferably a magnetometer. A sensor housing for receiving said at least one sensor is preferably provided, the sensor housing being mountable to the at least one moveable element or a reference structure. The sensor housing may also house further components such as at least one of a battery, wireless communication means, processor means. Processor means is preferably provided. Preferably the processor means is configured to determine the position of the moveable element. Such embodiments are preferably configured to generate an output indicating the position of the at least one moveable element. Wireless transmission means are preferably provided to send the output signal to receiver means associated with a status indicator means. The user interface may have user display means and/or other means for signalling an output to the user, such as an alarm. A user interface is preferably provided. A comprising a memory is preferably provided. The electronic systems, assemblies and mechanisms herein are preferably is battery powered but alternatively may be mains powered.

According to a further aspect of the invention there is provided a handle assembly for a window or door, the handle assembly comprising a handle grip, a casing, the handle grip being rotatable relative to the casing between a closed position and an open position, a stop member received in the casing in use, the stop member being moveable between a blocking position, in which the handle is prevented from moving from its closed position to its open position, and a non-blocking position in which the handle is free to move from its closed position to its open position, and and a push button mounted in the casing and operative to effect movement of the stop member from its blocking position to its non-blocking position.

The stop member suitably prevents turning of the handle grip in its opening direction. The push button mounted to the casing is depressed directly by the user in order to effect movement of the stop member from its blocking position to its non-blocking position. The handle assembly may be for actuating a latch of a door to allow opening and closing of the door, the handle being moveable between a closed position in which the latch maintains the door in a closed position and an open position in which the latch is unlatched to allow opening of the door. The handle is rotatably mounted to the casing in use.

Preferably the push button or at least part of the push button is integral with the stop member.

Preferably the push button is operatively coupled to the stop member.

Preferably the assembly further comprises a protruding member extending from the handle, the protruding member being engageable with the stop member when the stop member is in its blocking position, thereby preventing the handle from rotating from its closed position to its open position.

Preferably the protruding member is a pin extending from the handle.

Preferably the protruding member extends from the handle and through an aperture in the casing.

Preferably the stop member includes a recess, the recess being engageable with an element of the handle assembly that moves as the handle grip is moved between its closed and open positions when the stop member is in its blocking position, and the recess of the stop member being displaced from engagement with said element when the stop member is in its non-blocking position.

Preferably the recess is shaped to engage with the protruding member.

Preferably the handle assembly further comprises a spindle that is rotated on rotation of the handle grip, the spindle having a cut-out portion of smaller diameter than a blockable portion of the spindle between the cut-out portion and the door or window when installed therein, the recess aligning with the blockable portion of the spindle when the stop member is in the blocking position, the recess being shaped to receive the blockable portion of the spindle therein and to prevent rotation of the spindle by engagement of the blockable region of the spindle with the recess, the recess aligning with the cut-out portion of the spindle when the stop member is in the non-blocking position, the cut-out portion being shaped such that the spindle is rotatable when the recess is aligned with the cut-out portion.

Preferably the stop member moves to a recessed position relative to the handle as it moves from its blocking position to its non-blocking position.

Preferably the stop member is moveable translationally between its blocking and non-blocking positions.

Preferably the assembly further comprises biasing means arranged to bias the stop member towards the blocking position.

Preferably the biasing means comprises a spring.

Preferably the handle assembly comprises a cylinder lock or lock assembly according to any aspect of the cylinder lock/lock assembly invention described above.

References herein to sensing the position of a moveable element may refer to determining of the position of the moveable element among one, two or more discrete positions. For example, two or more discrete positions may correspond to closed and open positions of a leaf or handle, or of locked and unlocked positions of a locking mechanism that the moveable element is part of.

References herein to mounting of any first element to any second element encompass direct or indirect mounting (e.g. the mounting of the first element to a third element which is mounted to the second element).

BRIEF DESCRIPTION OF THE DRAWINGS

Embodiments of the invention will now be described by way of example only, with reference to the accompanying drawings, in which:

FIG. 4 shows an exploded external perspective view of the handle assembly of FIG. 3;

FIG. 8A shows the cylinder lock and electronic lock status indicating means of the assembly of FIG. 6A from an internal side;

FIG. 8B shows the cylinder lock and electronic lock status indicating means of FIG. 8A but from the external side;

FIG. 9A shows the cylinder lock and electronic lock status indicating means of the assembly of FIG. 6A from the internal side, with the second cam of the cylinder lock in a first position;

FIG. 9B shows the apparatus shown in FIG. 9A but with the second cam of the cylinder lock moving to a second position;

FIG. 9C shows the apparatus shown in FIG. 9A but with the second cam of the cylinder lock in a second position;

FIG. 20A shows a back view of the handle assembly of FIG. 19A, the handle assembly shown non-exploded and with the handle in a closed position;

FIG. 20B shows a front view of the handle assembly of FIG. 20A;

FIG. 20C shows a back view of the handle assembly of FIG. 20A with the handle in an open position;

FIG. 20D shows a front view of the handle assembly of FIG. 20C;

FIG. 20E shows a cross-sectional view of the handle assembly of FIG. 20A with the push button undepressed;

FIG. 20F shows a cross-sectional view of the handle assembly of FIG. 20A with the push button depressed;

FIG. 23A shows a front view of the handle assembly of FIG. 21 from the internal side with the handle casing partially cut away to reveal the cylinder lock and lock status indicating means with the cylinder lock in an unlocked state;

FIG. 23B shows a back view of the handle assembly of FIG. 23A with the cylinder lock in a locked state;

FIG. 23C shows a back view of the handle assembly of FIG. 23A with the cylinder lock in an unlocked state;

FIG. 23D shows a partial view of the assembly of FIG. 23A with the cylinder lock in an unlocked state;

FIG. 23E shows the assembly of FIG. 23E with the cylinder lock in a locked state;

FIG. 28A shows a diagrammatic side view of a sensor unit for mounting to a uPVC window or door, showing the housing cut away to reveal the PCB and a front view of the PCB is also shown;

FIG. 28B shows a rear view of an espagnolette handle with cam and cam follower in a closed position with a cover plate exploded from it;

FIG. 28C shows an unexploded rear view of the espagnolette handle of FIG. 28B with the handle in an open position;

DESCRIPTION OF THE PREFERRED EMBODIMENTS

Figure 1:
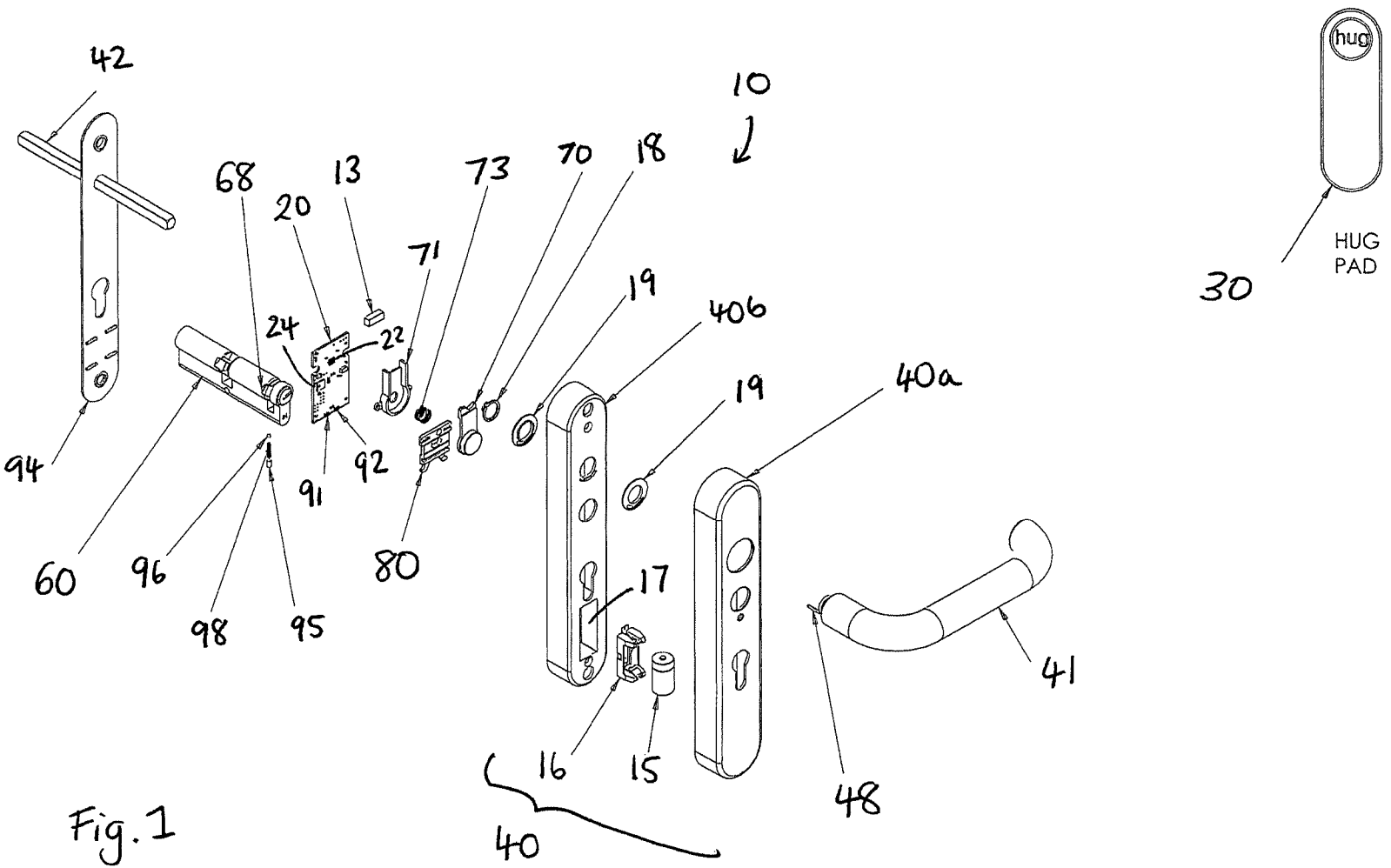
FIG. 1 shows an exploded internal perspective of a door handle assembly according to an embodiment of the invention.
Figure 2:
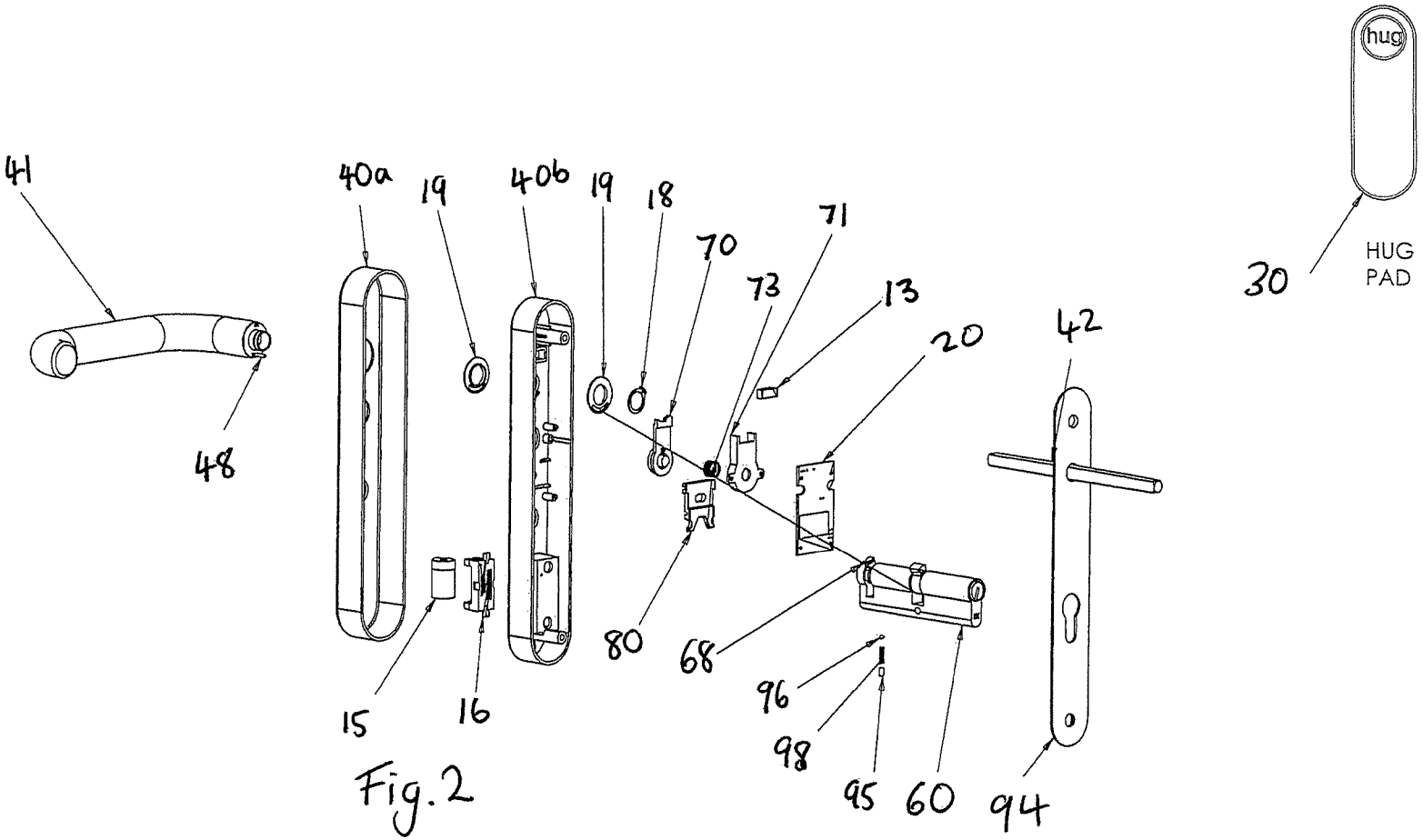
FIG. 2 shows an exploded external perspective view of the door handle assembly of FIG. 1.
Figure 3:
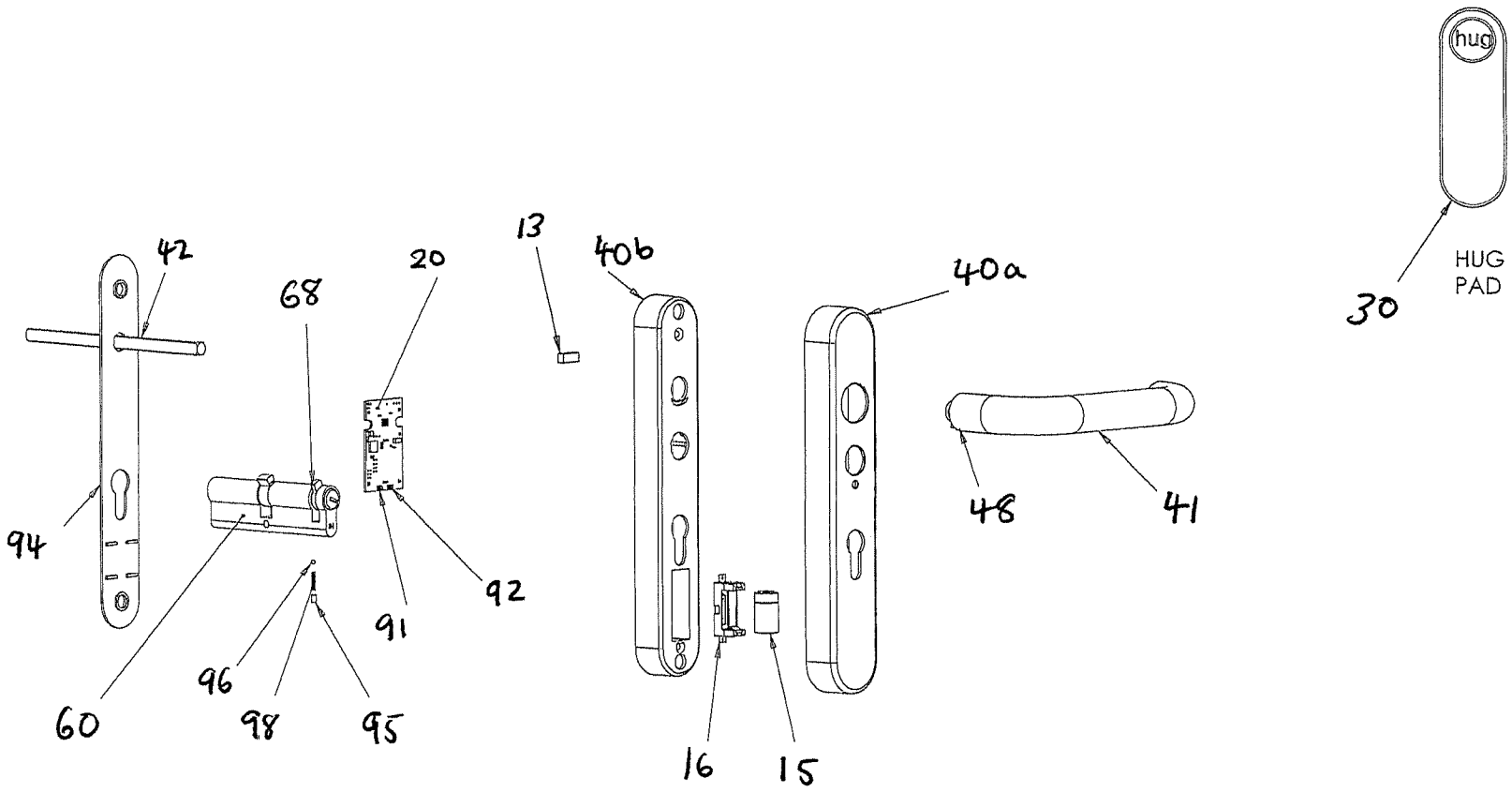
FIG. 3 shows an exploded internal perspective view of the handle assembly of FIG. 1 including an improved cylinder lock.

The present embodiments represent currently the best ways known to the applicant of putting the invention into practice. But they are not the only ways in which this can be achieved. They are illustrated, and they will now be described, by way of example only. Common features between the assemblies of the different figures are referenced by common reference numerals.

Calibration Mode

Referring to various of the figures, a system for detecting the position of a moveable element of a door or window will be described. The system in FIG. 1 includes a handle assembly 10, shown in exploded form in FIG. 1, and a magnet housing 30 shown to the side in FIG. 1, the magnet housing 30 containing a magnet (not visible in FIG. 1). The primary elements which interact to allow determination of the position of the leaf are the magnet in the housing 30 and a magnetometer 22 on a sensor unit 20 comprising a printed circuit board (PCB) which is housed within the handle assembly 10 in use.

Figure 5B:
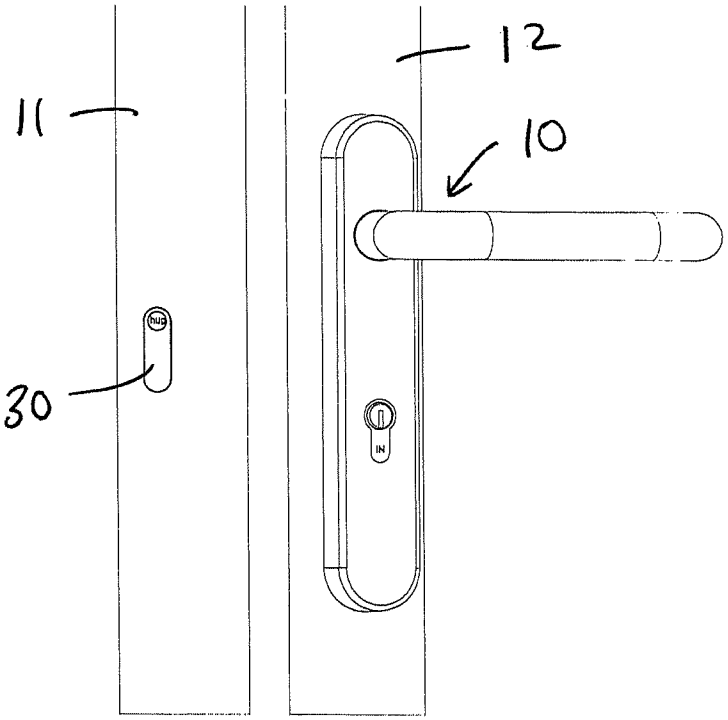
FIG. 5B shows the handle assembly of FIG. 5B, the door being in an open position.
Figure 5A:
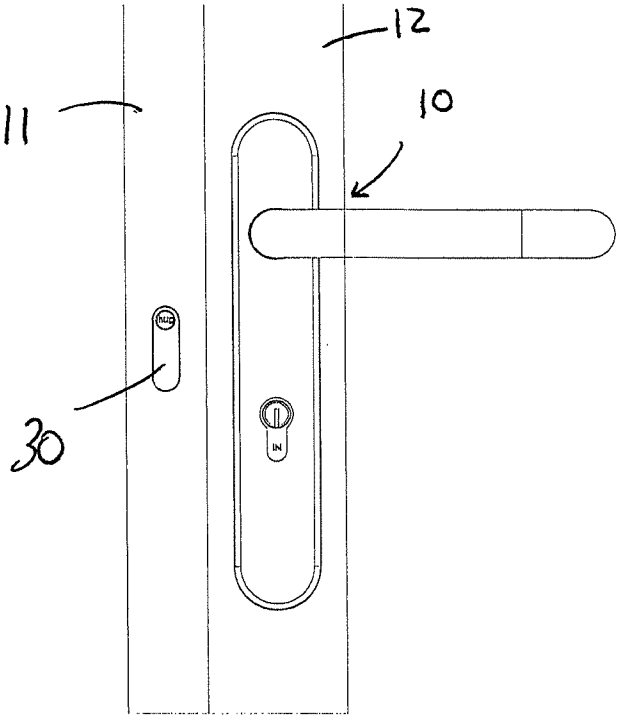
FIG. 5A shows a view of the handle assembly mounted on a door, the door being in the closed position.
Figure 6B:
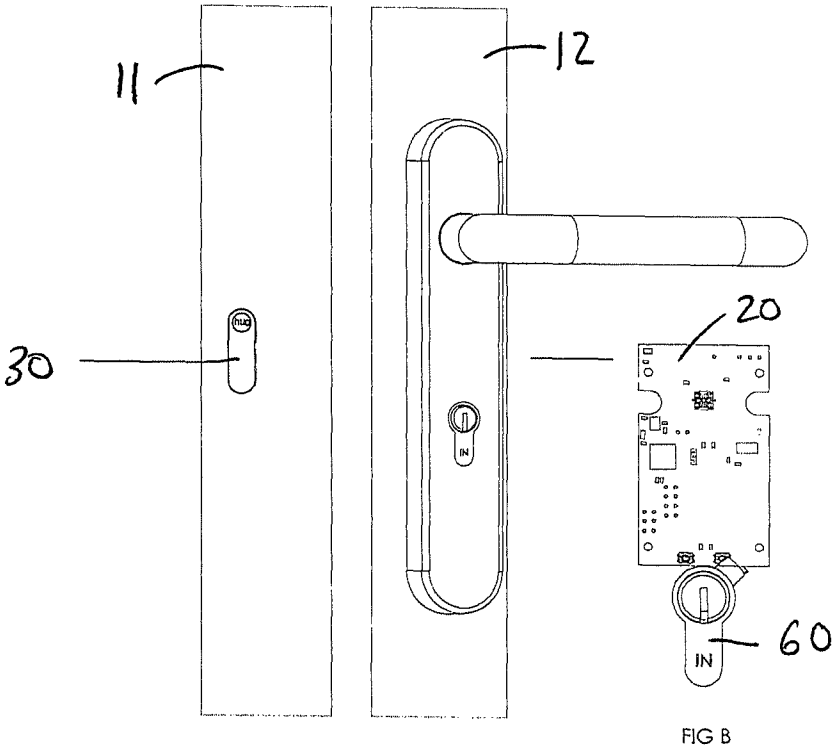
FIG. 6B shows the handle assembly of FIG. 6A mounted on a door, the door being in an open position.
Figure 6A:
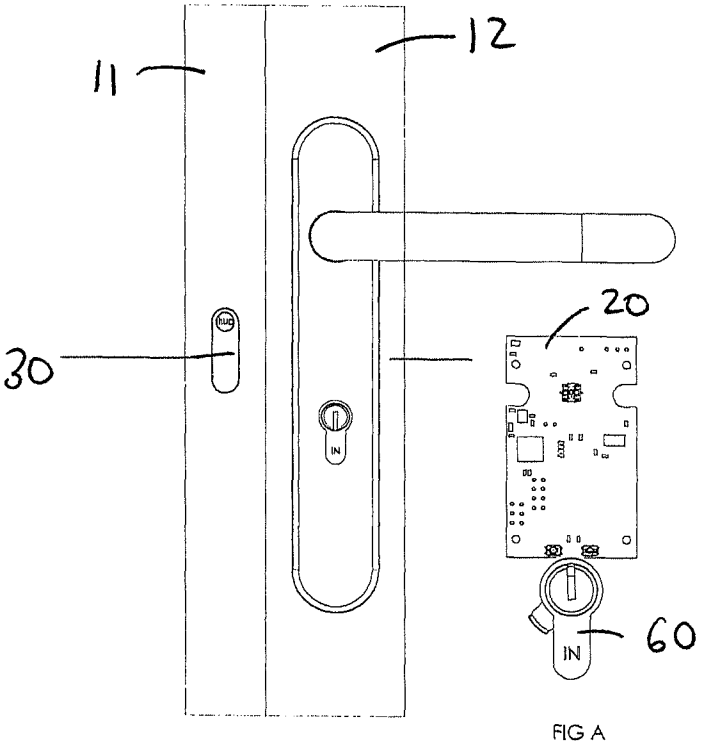
FIG. 6A shows the handle assembly of FIG. 1 mounted on a door, the door being in the closed position, and the cylinder lock with electronic lock status indicating means shown exploded from the handle assembly for ease of viewing.
Figure 13B:
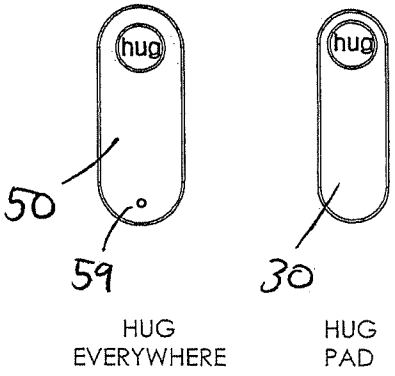
FIG. 13B shows a front view of the sensor unit and magnet housing.
Figure 13A:
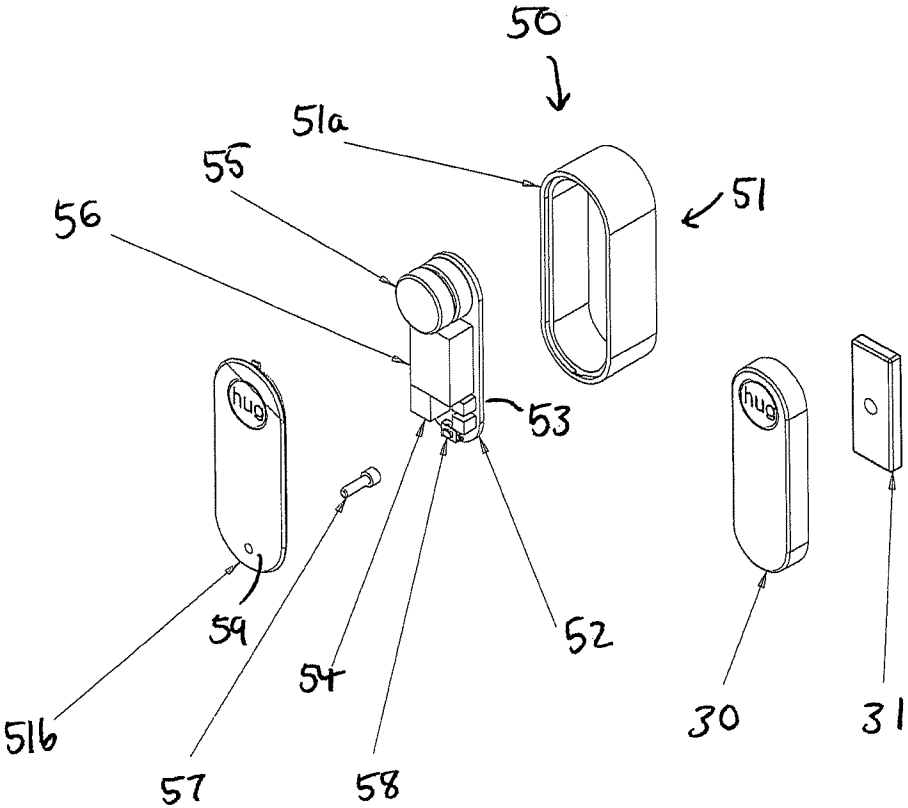
FIG. 13A shows an exploded perspective view of a sensor unit and magnet housing.
Figure 14B:
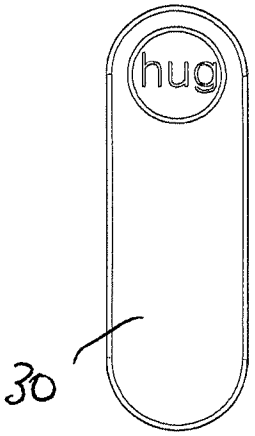
FIG. 14B shows a front view of the magnet housing.
Figure 14A:
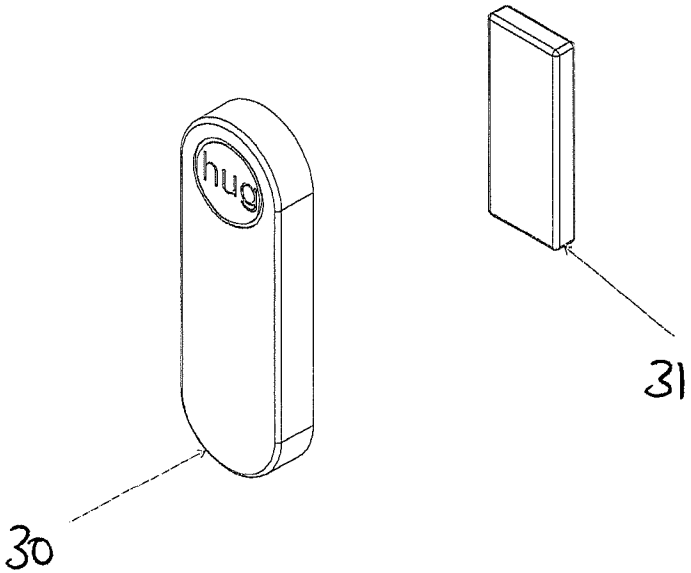
FIG. 14A shows an exploded perspective view of the magnet housing.
Figures 15A, 15B:
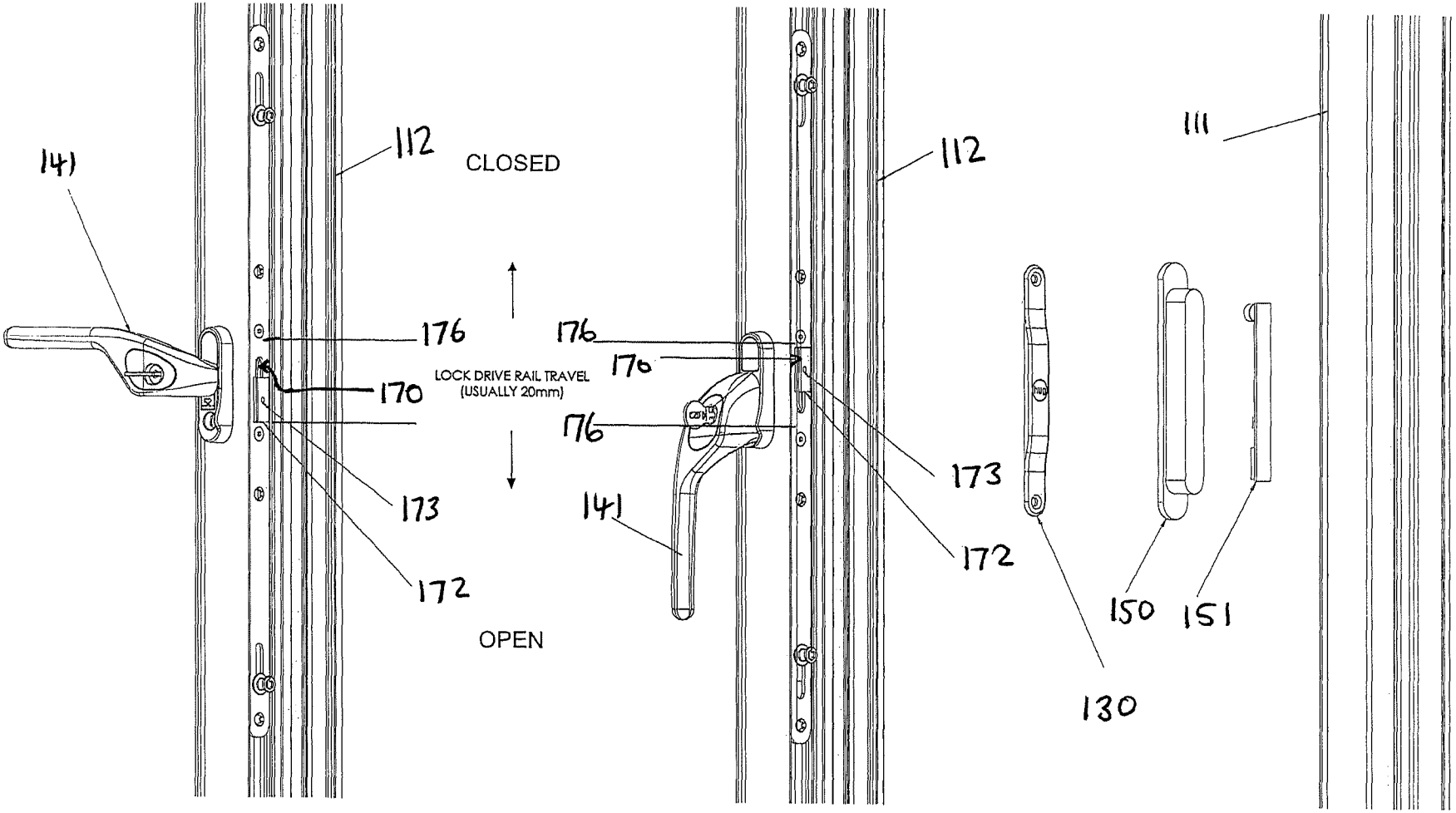
FIG. 15A shows an espagnolette assembly mounted on a window sash, the handle in an open position.
FIG. 15B shows the assembly of FIG. 15A with the handle in a closed position and also shows part of the window frame and sensor unit exploded from it.

Referring to FIGS. 5A and 5B, the system is shown in use with the handle assembly 10 mounted to a door leaf 12 and the magnet housing 30 is shown mounted to the door frame 11. The leaf 12 is moveable relative to the frame 12 between closed and open positions. The magnet housing 30 is mounted such that it is adjacent to the handle assembly 10 when the leaf is closed. FIG. 13 shows the magnet housing 30 exploded from the magnet 31 it houses. In this embodiment the housing 30 is in the form of a cover for the magnet 31, with the magnet to be housed between the housing 30 and the frame 11, however in other embodiments the housing 30 may fully encompass the magnet 31, or the magnet 31 may be configured to mount directly to the frame 11. The magnetometer 22 in the handle assembly 10 senses the magnetic field generated by the magnet in the housing 30 and uses this detection as a basis for determining the position of the leaf relative to the frame.

Figure 29A:
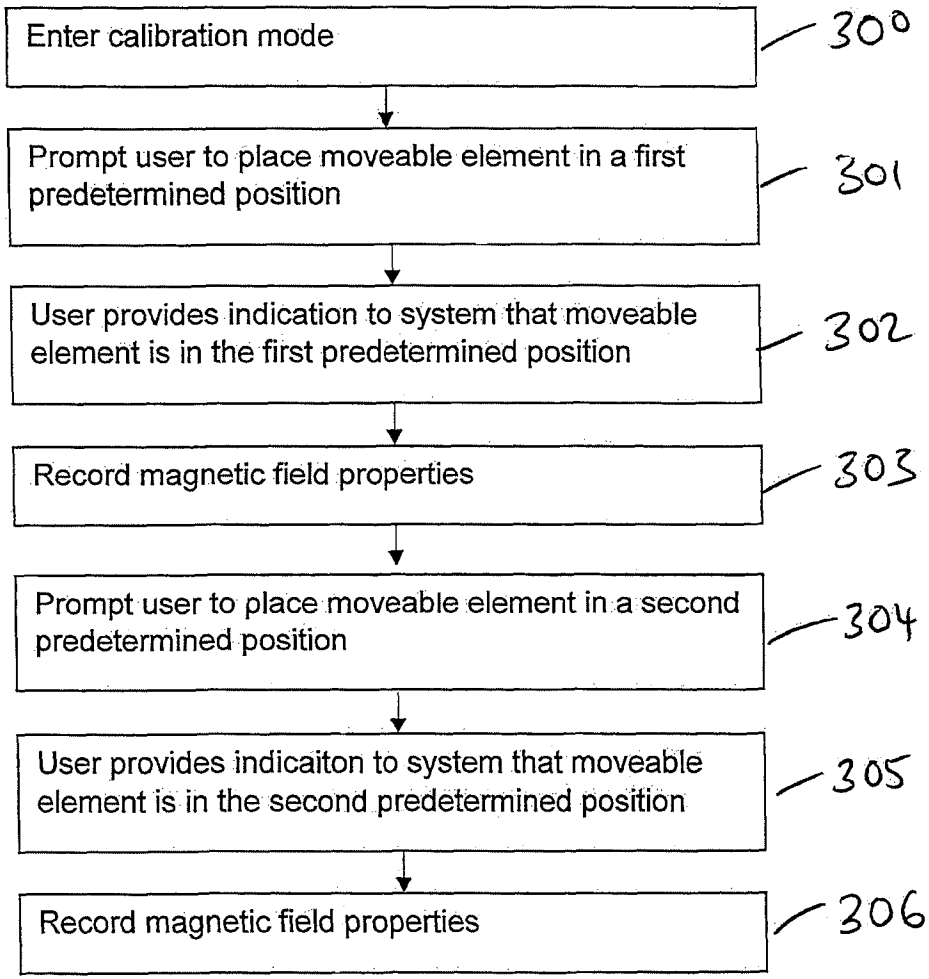
FIG. 29A shows a basic flow diagram illustrating a method for calibrating a detection system.

The system is configured to operate in a calibration mode and a normal mode. The system is operated in calibration mode initially when setting up the system. FIG. 29A is a basic diagram illustrating the basic initial steps for calibrating the system. For the sake of simplicity, the calibration mode will be explained in relation to calibration for detection of the position of a door or window leaf, however it will be understood that the detection system can be calibrated and used to detect the position of any moveable element of a window or door, such as a handle or a locking device, such as a locking drive rail. At 300, in order to calibrate the system the user places the system into calibration mode by providing a signal to a processor 24 using a user interface 23 (see also the schematic diagram in FIG. 29C). In such embodiments, the system has a user interface for providing a signal to a processor 24 within the sensor unit 20 to enter the calibration mode. Such a user interface may comprise a push button or a remote device with keypad or touchscreen etc. The system includes transmission means, preferably wireless transmission means, which in this embodiment is RF transmission means, to communicate between the user interface and the sensor unit 20. Alternatively, the calibration mode may be entered automatically after a battery is first installed and/or when the sensor unit 20 switched on for the first time. Once the system is in calibration mode, at 301 the user is prompted by the system to position the leaf in a first predetermined position, such as a closed position, or an open position, via the user interface or some other indicator means.

After the user has placed the leaf in the first predetermined position, at 302 the user provides an indication to the processor 24 via the user interface 23 that the leaf has been placed into the first predetermined position. Alternatively the indication that the leaf is in the predetermined position may be automatically determined by the system by determining that the magnetic field sensed by the magnetometer has been stable for a predetermined time period. At 303, the processor 24 then records one or more properties of the magnetic field produced by the magnet 31 as sensed by the magnetometer 22 and stores at least one of the properties or values derived therefrom in a memory 25. At 304-306, after the system has registered the leaf in the first predetermined position the steps repeat in relation to a second predetermined position as shown in FIG. 29A. Registering the leaf in one or two predetermined positions may be sufficient to calibrate the system, or registration in a third or further predetermined positions may be required, in which case the steps would be repeated for the further predetermined position(s).

The leaf may be moved and registered in a series of different predetermined positions as part of the process of calibrating the system. For example, a hinged leaf may be registered in the closed position, a night vent/slightly open position and a 90 degree open position etc. The processor uses the output signals recorded by the magnetometer at each predetermined position to establish calibration parameters that can then be used when the system is operating in normal mode following calibration to correlate the magnetic field output from the magnetometer when the system is in the normal mode with a known position of the leaf.

After calibration, the user may cause the system to enter a normal mode via the user interface or this may occur automatically after the calibration steps have been completed. In the normal mode the processor 24 periodically determines one or more magnetic field properties sensed by the magnetometer 22 and compares it or them to the values/calibration parameters stored in the memory to determine the position of the leaf 12. The processor 24 is configured to provide an output indicating the position of the leaf 12. This output can be provided to the user via a status indicator 26 (which may be the user interface 23 for example). The output indicating the position of the leaf may be transmitted to the user interface via the wireless transmission means. The position status indicated by the system may not be an exact position, but may be a general indication or position, e.g. the system may indicate that the leaf is closed, in night-vent position or open (open being any further open than the night-vent position), an indication that the leaf is positioned within certain ranges of position and/or an indication as to which of certain discrete positions the leaf is positioned at.

Referring to FIG. 1, the handle assembly 10 comprises a cover plate or handle casing 40 from which extends a handle grip or shank 41 configured to turn a spindle 42 within the handle casing 40. In this embodiment the magnetometer 22 is mounted within the handle casing 40. This aids in calibrating the system and improves tamper resistance of the system. For example, in the system of FIG. 1, the magnetometer 22 is mounted between the handle casing 40 and a back plate 94. Alternatively the magnetometer may be mounted between the handle casing 40 and the leaf.

Figure 10B:
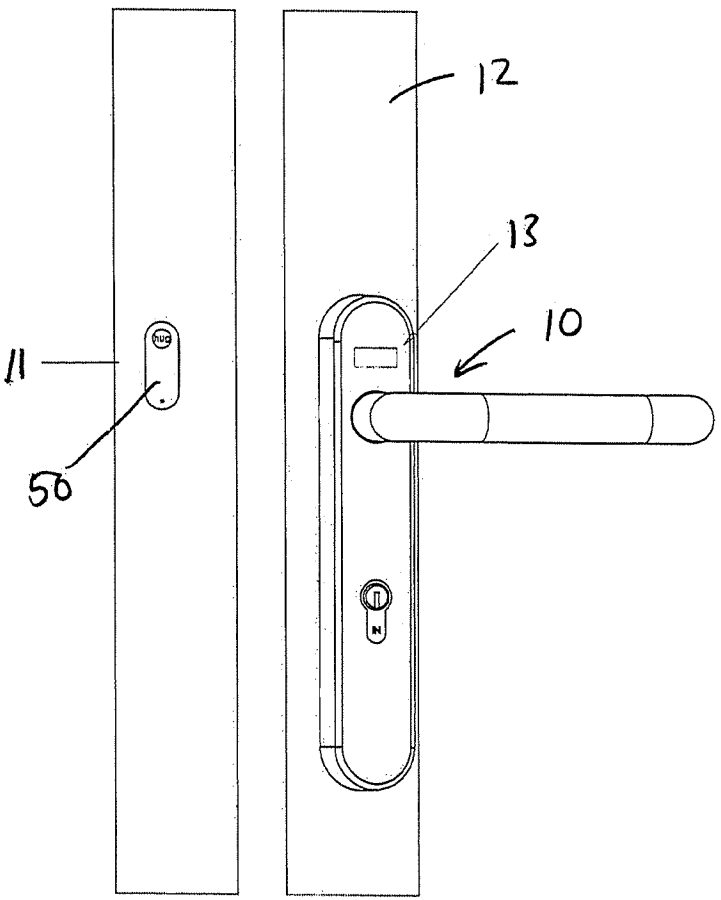
FIG. 10B shows the handle assembly of FIG. 10A, the door being in an open position.
Figure 10A:
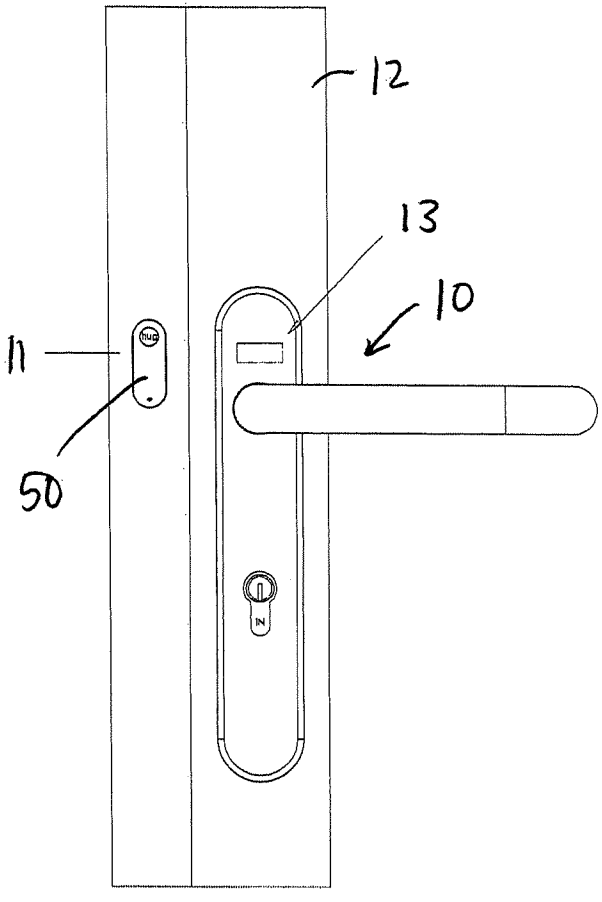
FIG. 10A shows a view of a handle assembly mounted on a door, the door being in the closed position, the handle assembly being like that of FIG. 5A but the handle casing has a magnet built into it.
Figure 11B:
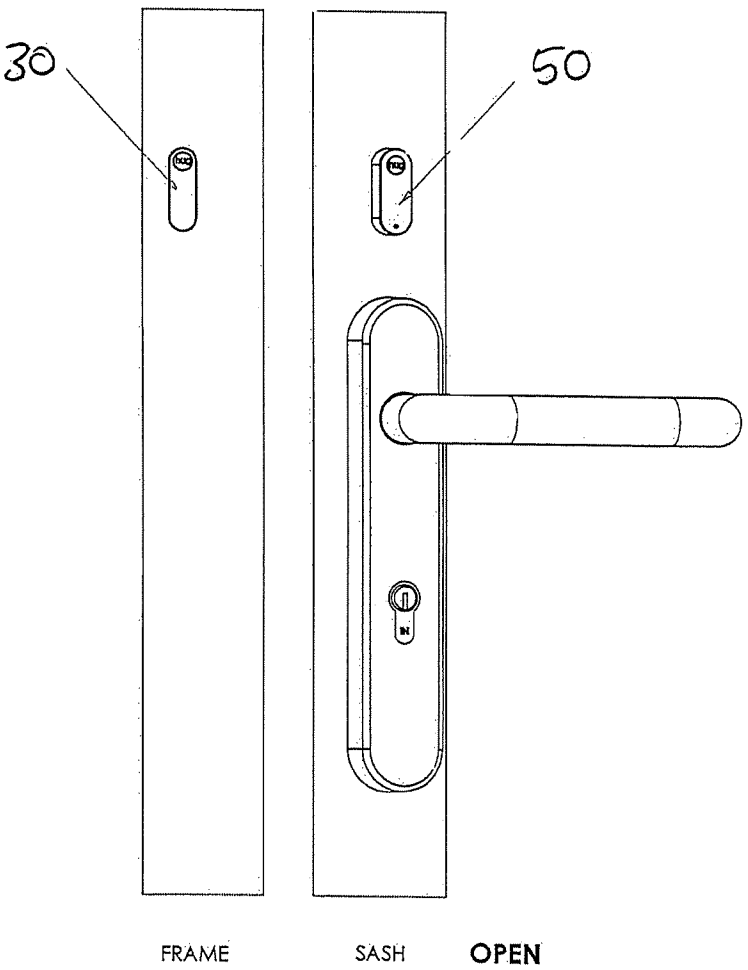
FIG. 11B shows the handle assembly of FIG. 11A, the door being in an open position.
Figure 11A:
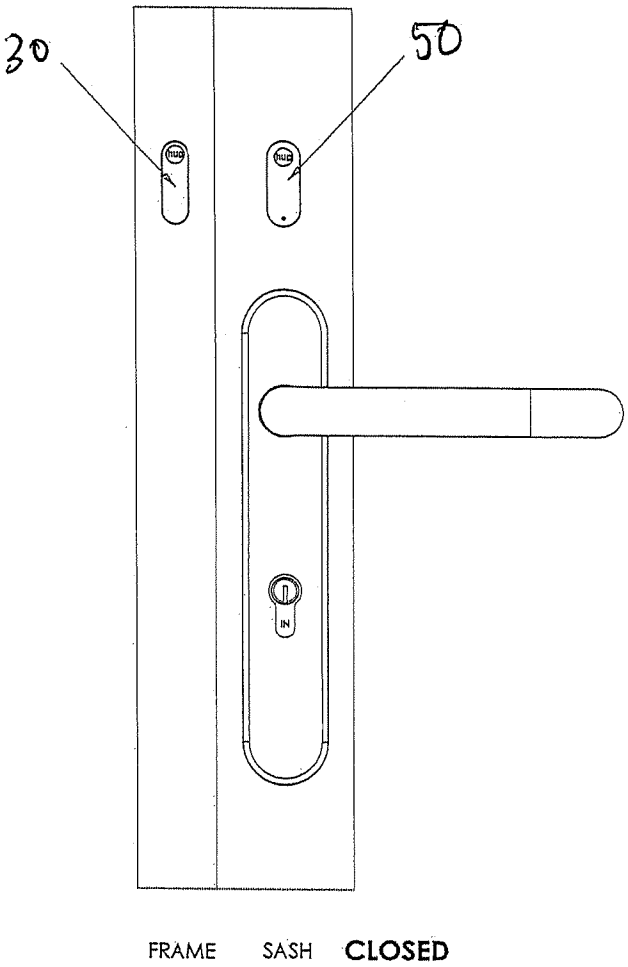
FIG. 11A shows a view of a handle assembly mounted on a door, the door being in the closed position, the handle assembly being like that of FIG. 5A but with a magnet mounted to the frame and a sensor unit mounted to the door.
Figure 12B:
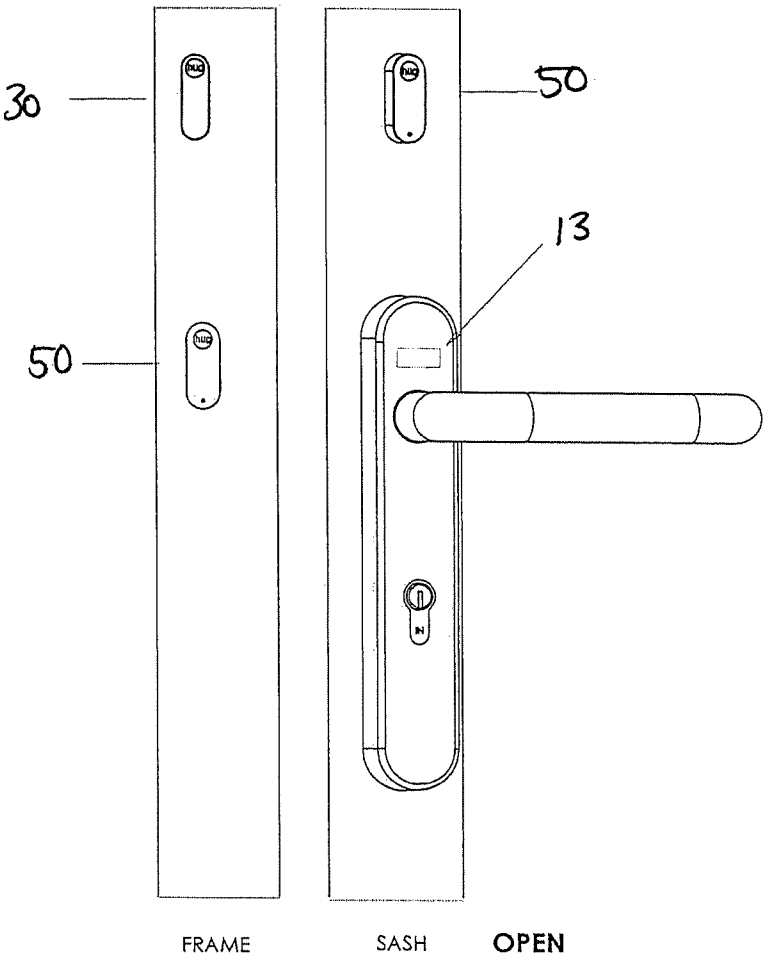
FIG. 12B shows the handle assembly of FIG. 12A, the door being in an open position.
Figure 12A:
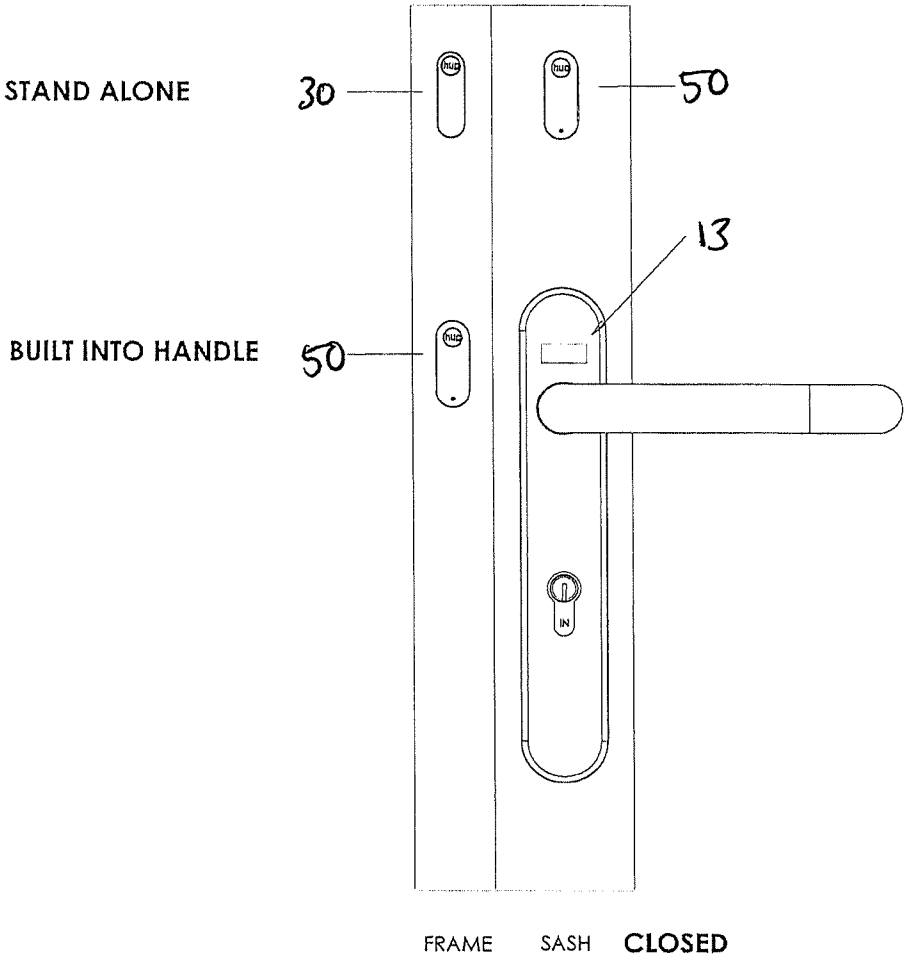
FIG. 12A shows a handle assembly mounted on a door in a closed position and the options for arrangement of a magnet and corresponding sensor, the handle casing shown with a magnet built into it and a sensor mounted on the door jamb adjacent to the magnet and showing above a magnet mounted on the door jamb and a sensor unit mounted adjacent to it on the door as an alternative option.

In other embodiments the magnet may be housed within the handle casing 40 and the magnetometer may be configured for mounting on the frame 11. A sensor unit 50 that may be used for mounting on the frame for embodiments in which the magnet is in the handle assembly 10 and the magnetometer is mounted to the frame is shown in FIG. 13. The sensor unit 50 comprises a sensor housing 51 comprising a base 51*a* and a cover 51*b*. The housing 51 houses a PCB 52 with magnetometer 53 (not visible in FIG. 13), processor 54, battery or batteries 55 to power the sensor unit, and RF communications unit 56. The sensor unit 50 also has a synchronise button 57 and a reset switch 58. The synchronise button 57 may be used during calibration mode. The cover 51*b* of the housing 51 may be hingedly connected to the base 51*a* so that if the cover 51*b* is depressed, this depresses the synchronise button 57, for example to indicate to the system that the leaf is in a predetermined position to register the leaf in that position during calibration mode. The reset button 58 may be used to reset the system, i.e. to erase the calibration settings. The reset button 58 may be activated using a pin or other thin object via a small hole 59 in the cover 51*b*. Referring to FIGS. 10A and 10B, the sensor unit 50 is mounted to the frame adjacent the handle assembly 10. The magnet for generating a magnetic field to be sensed by the sensor unit 50 to determine the position of the leaf 12 is housed within the handle casing of the handle assembly 10. Referring to FIGS. 1, 10A and 10B, a magnet 13, which is housed near the top of the handle casing 40 when assembled is illustrated. The magnet 13 is indicated by a rectangular outlines in FIGS. 10A and 10B, however preferably the magnet 13 would be fully mounted within the casing 40 of the handle assembly and therefore would not be visible. The magnet 13 is received in a dedicated magnet recess 21 in the handle casing 40, visible in FIG. 4.

Referring to FIGS. 8A and 8B, a close-up view of the sensor unit 20 that is housed in the handle casing 40 in use is shown. The alternative sensor unit 50 for mounting to the frame in other embodiments wherein the magnet is housed in the handle 40 will include similar elements to the sensor unit 20. As well as the magnetometer 22 and processor 24, the sensor unit 20 includes a programming port 4 whereby the system is programmable. Certain parameters can be set by a user during set up of the system and input to the system using the programming port 4. For example, the system may be configured to use one or more parameters of the leaf which it is to monitor the status of. Such parameters may include a dimension of the leaf, for example for a hinged door, the dimension of the leaf from the hinged edge to the edge that engages the jamb may be used as an input parameter for the system. Input of one or more dimensions of the leaf assists in extrapolating expected output values of the magnetometer 22, 53 when the leaf is at or near a fully open position, even if the leaf was not registered at such an extent of opening during the calibration process. This means that the same system can more easily be used with different sizes of leaf. The sensor unit 20 may include an LED or other suitable means to provide any suitable visual indications to the user. Referring to FIG. 1, the sensor unit 20 is powered by a battery 15. The battery 15 is held within the assembly by a battery holder 16 and both the battery 15 and battery holder 16 are received in use in a recess 17 in an inner cover plate 40*b*. The sensor unit 20 (and other components of the system as will be described later) may alternatively be powered by mains power.

Figure 16B:
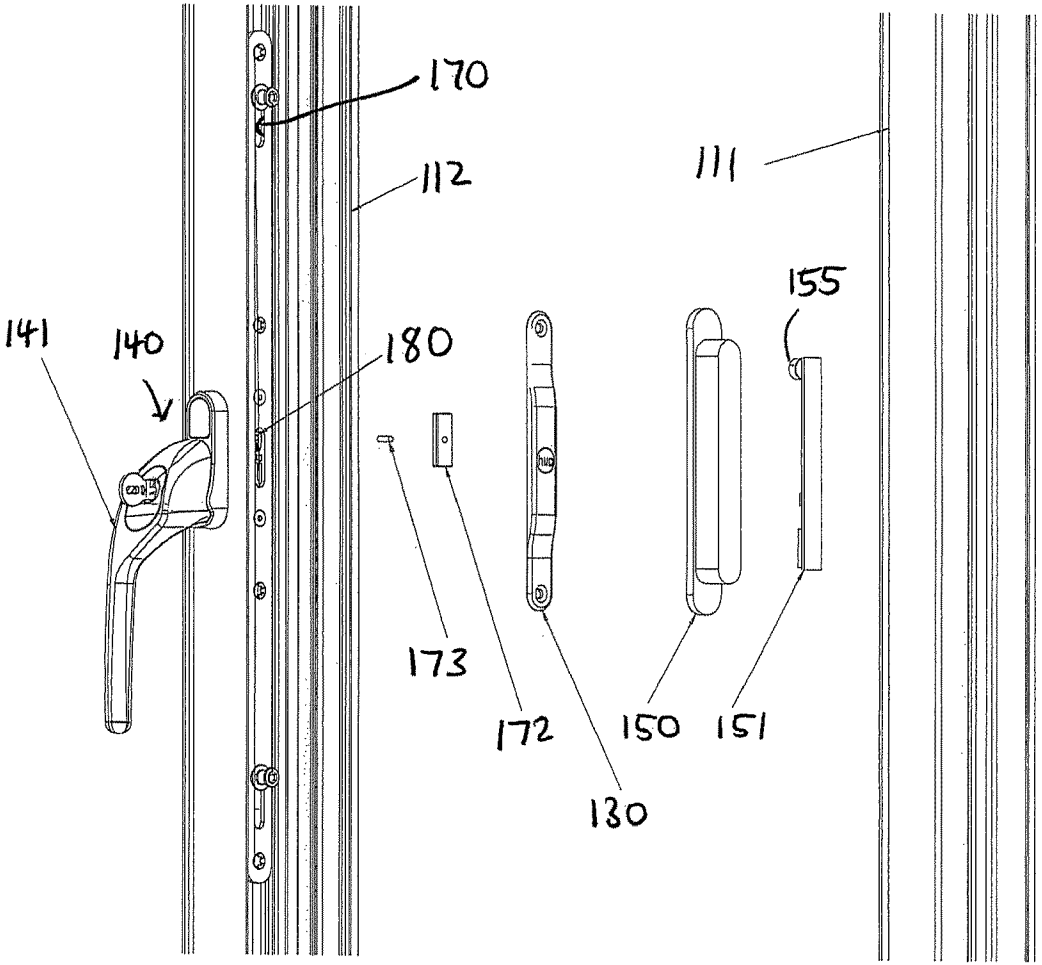
FIG. 16B shows the assembly of FIG. 16A with the handle in a closed position and a magnet and drive pin exploded from the sash and also shows part of the window frame and sensor unit exploded from it.

Referring to FIG. 16B, a similar system for determining the position of a window sash is shown. It will be understood that the terms leaf and sash can be used interchangeably. The window system has a sensor unit 150 which includes a magnetometer and other components similar to the sensor unit 50 described above. The sensor unit 150 is for mounting to the window frame 111. The window system has a magnet housing 130 for mounting to the window sash 112 which houses a magnet 172. As with the door system, the magnet housing 130 and sensor unit 150 are mounted such that they are in close proximity to each other when the sash 112 is in the closed position. The magnetometer 22 in the sensor unit 150 senses the magnetic field generated by the magnet in the magnet housing 130 and uses this detection as a basis for determining the position of the sash 112 relative to the frame 111. As with the door system, the magnet and sensor can swap positions, i.e. the sensor unit 150 may be mounted to the sash 112 and the magnet housing 130 may be mounted to the frame 111. The window position detection system is configured to be calibrated similarly to the door position detection system.

In prior art detection systems that use a magnet and reed switch to detect whether a window or door leaf is closed or open, it is possible to tamper with the detection system by placing a magnet in proximity to the reed switch. While the magnet is adjacent the reed switch, the reed switch will provide an output indicating that the leaf is closed, even if the leaf has been opened. In the present system, by means of the system for calibration by registering the leaf at at least one, preferably two or three different positions, this resists tampering of the kind described. The present system is finely tuned during calibration to differentiate different magnetometer readings and ascribe a corresponding leaf position to different magnetometer readings, and a benefit of the present system is that placement of a magnet near the magnetometer will not cause the system to indicate that the leaf is closed, as the system will only indicate that the leaf is closed if the magnetometer output is within a predetermined range of the output registered during calibration. The present system has improved resistance to tampering. Furthermore, as the system can be calibrated to register the magnetometer readings when the leaf is at certain predetermined positions, if a magnet is placed in proximity to the magnetometer, the magnetometer reading will not correspond to any of the expected outputs corresponding to various leaf positions and therefore the system can be configured to recognise that the system is being tampered with and to provide a warning signal indicating possible tampering with the leaf.

In some embodiments the system may include a vibration sensor such as an accelerometer. The vibration sensor senses any vibration imparted to the support that the vibration sensor is mounted to and causes an alarm (e.g. an audible alarm or visual indication of some sort) to be operated if vibration over a predetermined threshold is sensed. This provides a warning of a possible intruder or tampering with the leaf.

When the leaf position detection system (i.e. for a window or a door) is in normal mode, it may be configured to operate in a low power mode or a normal power mode. In the low power mode the magnetometer may cease from sensing magnetic field parameters or may sense magnetic field parameters less frequently than in the normal power mode. The system preferably includes a secondary detection system (in addition to the primary detection means for detecting the position of the leaf using the magnetometer 22, 53 and magnet 31, 13), the output of the secondary detection system being usable to determine which power mode to operate the system in: low power mode or normal power mode. The secondary detection system may detect whether the handle is closed or that the leaf latch is engaged; if so, the system can be converted to, or maintained in, the low power mode to save power. An indication of whether the handle is closed or whether the leaf latch is in a locked state is a secondary indication that the leaf is closed and therefore power can be saved by refraining from monitoring the leaf position using the magnetometer as often. If the secondary detection system detects that the handle has been opened or that the leaf latch has been moved to an unlocked state, then the secondary detection system can provide an output to the system accordingly, in response to which the system may convert to normal power mode. Various means for windows and doors will be described, which are useful as a secondary detection system and which are also useful independently as part of an overall security monitoring system.

By means of the calibration mode, a system having one of a sensed element and sensor on the leaf and the other on the frame or other suitable reference structure that the leaf moves relative to, can be calibrated to determine not only whether the leaf is open or closed, but also to determine whether the leaf is secured or unsecured relative to the frame. In many door or window assemblies the leaf or frame has an elongate seal that is arranged to be compressed between the leaf and the frame when the leaf is in the closed position. When a holding means, such as a locking bolt, on the leaf or the frame is extended from an unsecured position into a secured position wherein it extends into a keep on the other of the leaf or the frame, this further compresses the seal, bringing the leaf closer to the frame. The position of the leaf relative to the reference structure changes slightly as the holding means moves between in the secured position and the unsecured position and these two different positions of the leaf can be detected using the sensed element and sensor. The system can therefore be calibrated to determine whether a latch mechanism is in a secured configuration or an unsecured configuration.

In order to calibrate the system in order to determine whether a latch mechanism is in a secured configuration or an unsecured configuration, with the system in calibration mode the user is prompted by the system to position the leaf in the closed position with the latch mechanism in the unsecured configuration. Once the door or window assembly is in this configuration the user provides an indication to the processor via the user interface that the assembly has been placed into a first predetermined configuration. The processor then records one or more properties of the magnetic field produced by the magnet as sensed by the magnetometer. After the system has registered the assembly with the leaf closed and the latch mechanism in an unsecured configuration, the steps are repeated but with the leaf closed and the latch mechanism in a secured configuration. This establishes calibration parameters that can be used when the system is operating in normal mode following calibration to correlate the magnetic field output from the magnetometer when the system is in the normal mode to accurately determine the position of the leaf relative to the reference structure and therefore to determine, with the leaf closed, whether a latch mechanism is in a secured configuration or an unsecured configuration. For example, for a window assembly, the system can be calibrated to determine whether, when the window leaf is closed, the handle is open (with pins on the drive rail unsecured in their corresponding keeps) or closed (with pins on the drive rail secured in their corresponding keeps). The calibration steps can of course be carried out in a different order (i.e. registering the leaf in a secured configuration and then registering it in an unsecured configuration). By providing a system that is configured to be calibrated in this way, it is possible to determine whether the leaf is secured to the frame or not, without a separate detection system separately monitoring the means for securing the leaf to the frame.

Magnet in Handle to Activate Sensor Switch

Referring to FIGS. 28A-C, a handle assembly 140 is shown that incorporates a detection means for detecting whether the handle is open or closed that could be used with primary detection means for determining the position of an associated window sash and/or may be used independently for security monitoring. The handle assembly 140 comprises a handle grip 141 which is pivotally mounted to a base plate 143 via a nose portion 144. The handle grip 141 is configured to move a locking device or turn a spindle 142. The handle grip 141 includes a magnet 113 mounted to the rear side of the nose portion 144 that overlies the base plate 143 when the handle grip 141 is in the closed position. The magnetic field generated by the magnet 113 in the handle grip 141 is sensed by a magnetometer 153 in a sensor housing 150 which is mounted in a fixed position near the handle grip 141, such as on a window frame member that is near the handle assembly 140 when the sash is closed. The magnetometer 153 uses the detection of the magnetic field generated by the magnet 113 as a basis for determining whether the handle grip 141 is in a closed position or an open position. The system can be calibrated by registering the handle in open/closed positions as described above in relation to the leaf position detection system. The magnet 113 is mounted at a location distanced away from the handle pivot axis (i.e. spaced from the spindle 142) so that the magnet rotates along the path of an arc as the handle grip 141 is rotated between the closed position and an open position wherein the handle grip 141 is oriented 90 degrees to its closed position. The magnet 113 will therefore be distanced further away from the frame mounted magnetometer 153 when the handle grip is in the open position 141 than when the handle grip is in the closed position, which can be detected by the magnetometer 153 and appropriate output signals from a processor in the sensor unit 150 may be provided to indicate the status of the handle grip 141 to the user and/or as input signals as part of a broader monitoring system. Instead of locating a magnet in the handle, a magnetometer may be located in the handle and a magnet may be mounted to the frame.

FIGS. 28B-C show an alternative means for detecting whether the handle grip 141 is open or closed comprising a cam 160 and cam follower 161. Typically either the cam 160 with cam follower 161 or the magnet 113 would be present in the handle assembly 140, not both, however both are shown in FIGS. 28B-C for ease of illustration. Rotation of the handle grip 141 causes linear movement of the cam follower 161. In this embodiment the cam follower 161 is a magnet. The magnetometer 153 in the sensor unit 150 mounted in proximity at a fixed position such as to the window frame can detect whether the cam follower magnet 161 is in a first position or a second position, thus the sensor unit 150 is able to provide an output indicating whether the handle grip 141 is open or closed.

The cam 160 is a rotary cam mounted around the spindle 142 and within the base plate 143 such that as the spindle 142 is rotated by movement of the handle grip 141, the cam 160 rotates. The cam 160 is generally egg/pear shaped with a broad curved end and a narrow curved end. The cam 160 is mounted around the spindle 142 with its rotational axis closer to the broad curved end of the cam 160. The cam 160 has a longitudinal axis A between its broad curved end and its narrow curved end. The cam follower 161 is located adjacent to the cam 160 and the cam follower 161 projects into a linear guide channel 163 formed in a cover plate 145 that is arranged between the base plate 143 and the sash when assembled. The cam follower 161 is movable back and forth along the guide channel 163 between a first position and a second position. When the handle grip 141 is in the closed position as shown in FIG. 28B, the axis A of the cam 160 is orthogonal to a longitudinal axis B of the base plate 143 and the cam follower 161 is in a first position. As the handle grip 141 is moved into an open position, the cam 160 pushes the cam follower 161 into a second position, further away from the spindle 142 as shown in FIG. 28C, with the axis A of the cam 160 aligned with the longitudinal axis B of the base plate 143 when the handle grip 141 is in the open position. When the handle grip 141 is moved back to the closed position, the cam 160 is no longer urging the cam follower 161 into the second position, and the cam follower 161 falls back into the first position under gravity.

Instead of being magnetic, the cam follower 161 may comprise a moveable magnetometer and a magnet may be mounted non-movably to the frame or sash.

The magnetometer in this embodiment and in other embodiments described herein is preferably a three axis magnetometer that is able to detect the position of the corresponding magnet in three coordinate axes. The three axis magnetometer will therefore output the sensed X, Y, and Z components of the magnetic flux vector present at the magnetometer. This allows the magnetometer to detect the relative position of the magnet in two coordinate axes as the leaf is opened and closed and also in a third coordinate axis as the handle is moved. The magnetometer can sense the direction that a magnet has moved in the particular coordinate axes. Therefore, a single magnetometer can be mounted to a central frame post for example to monitor the position of magnets associated with left and right hand window handles on left and right hand windows.

Figure 29B:
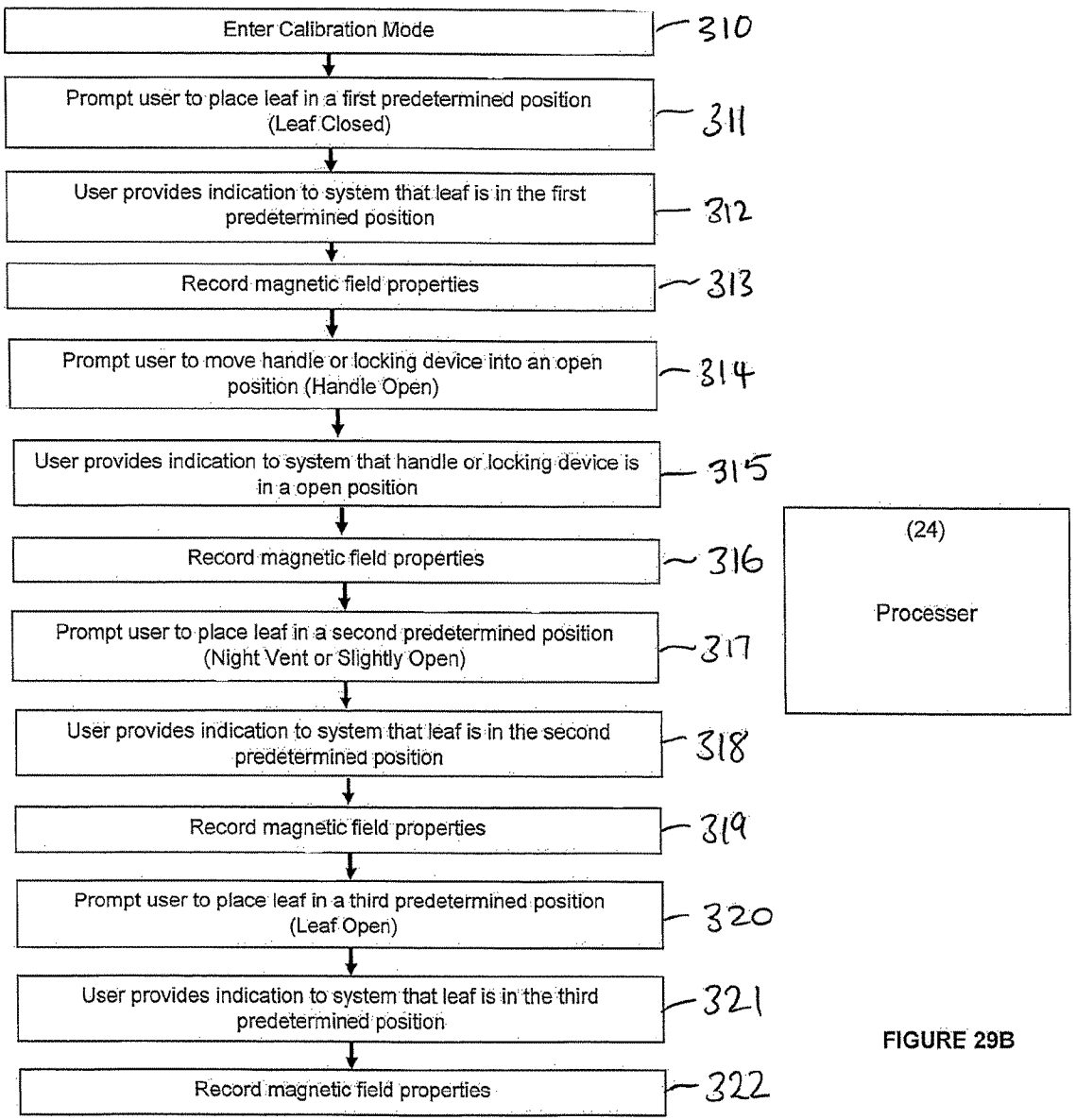
FIG. 29B shows a more detailed flow diagram illustrating a method for calibrating a detection system.
Figure 29C:
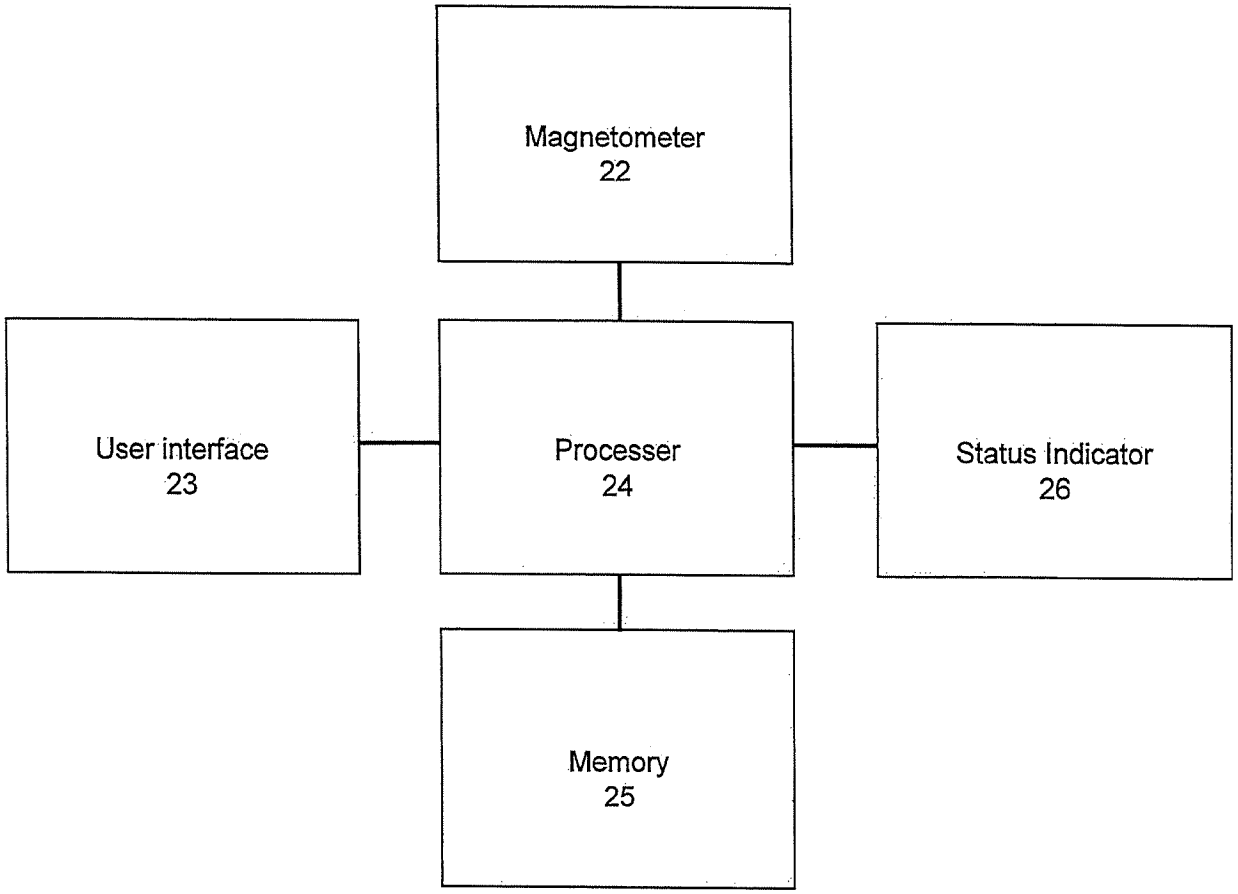
FIG. 29C is a functional block diagram showing some of the elements of the detection system

The magnet 113, 161 mounted to the handle assembly in the embodiments of FIGS. 28A to 28C may also be the magnet used to detect the position of the window or door leaf, since the magnet mounted to the handle moves as the leaf is opened and closed. The system can be calibrated in a similar way as described above to register certain predetermined positions for the leaf and handle to aid in determining their positions during the normal mode of the detection system. Referring to FIG. 29B, a flow diagram showing the steps of a calibration process for use with an assembly such as that of FIG. 28A, 28B or 28C is shown. Similar to the basic process shown in FIG. 29A, at 310 the system is entered into calibration mode. At 311 the user is prompted by the system to position the leaf in a first predetermined position, which in this example is a closed position. At 312 the user provides an indication to the system that the leaf is in the first predetermined position. At 313 the system then records the magnetic field properties at that first predetermined position. At 314 the user is prompted to move the handle into a predetermined position, which in this example is an open position (or alternatively if the magnet is located on a locking device on the leaf, such as those described later, rather than the handle, the user will be prompted to unlock the locking device). At 315 the user provides an indication to the system that the handle is in the open position. At 316 the system then records the magnetic field properties with the magnet at that predetermined position (with leaf closed and handle open). At 317-319, steps 311-313 are repeated for a second predetermined position for the leaf (e.g. night vent position). At 320-322, steps 311-313 are repeated for a third predetermined position for the leaf (open position). Once the system has been calibrated, the magnetometer 153 can be used to determine the position of the leaf and the status of the handle as open or closed. A similar calibration system can be used for the detection systems described below. The calibration steps would be the same for an assembly in which a sensor is mounted to the handle and a magnet is mounted to the frame.

In slightly modified embodiments the system may have more than one magnet or more than one magnetometer for use in detecting the position of the leaf and the handle (or other moveable element that moves when the leaf latch is operated). For example, the system may have a first magnet mounted to a moveable part of the handle, a second magnet mounted to the frame and a magnetometer mounted to the leaf such that the magnetometer can detect relative movement between the magnetometer and the first magnet and between the magnetometer and the second magnet. Alternatively the system may have a first magnetometer mounted to a moveable part of the handle, a second magnetometer mounted to the frame and a magnet mounted to the leaf such that the magnetometers can detect relative movement between the magnet and the first magnetometer and between the magnet and the second magnetometer.

Magnet in Locking Drive Rail to Activate Sensor Switch

Figure 16A:
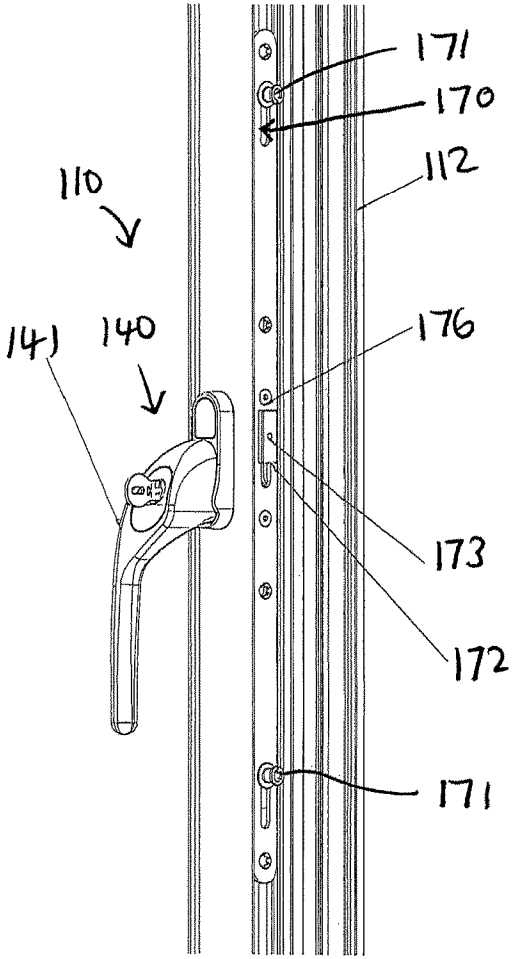
FIG. 16A shows the assembly of FIG. 15A mounted on a window sash, the handle in a closed position.

Referring to FIG. 16A, a locking assembly 110 is shown mounted to a window sash 112, the locking assembly 110 including a handle assembly 140 and a lock drive assembly for driving locking pins 171. The drive assembly comprises a faceplate 176 and a locking drive rail 170 (just visible in FIG. 16A through a slot in the faceplate 176) having locking pins 171 (in this embodiment two locking pins) connected thereto and a locking drive rail mechanism (not fully visible in FIG. 16) for driving linear movement of the locking pins 171, upon movement of the handle grip 141, to engage the locking pins 171 in corresponding catches on the window or door frame (not shown). The lock assembly 110 further comprises a sensed element and a sensor for sensing the sensed element, one of said sensed element and sensor being mounted to the locking drive rail 170 and the other being mounted to the window frame in use. In this embodiment the sensed element is a magnet 172. Referring to FIG. 16B, the sensor is a magnetometer which is mounted with other electronic components such as a battery 155 on a PCB 151 in a sensor unit 150. The sensor unit 150 is for mounting to the window frame 111. The magnet 172 is mounted to the faceplate 176 and is attached with a steel pin 173 to the locking drive rail 170. The magnet 172 is then enclosed by a housing cover plate 130 shown exploded from the magnet in FIG. 16B (or in alternative more simple embodiment the magnet 172 can be attached directly to the drive rail 170). The sensor unit 150 is mounted to the frame 111 adjacent the magnet 172.

As the handle grip 141 is moved from a closed position as shown in FIG. 16A to an open position, the drive mechanism causes the locking drive rail 170 to move down relative to the sash 112 (or in alternative embodiments the mechanism may be configured to drive the locking drive rail 170 up on opening of the handle) and the magnet 172 mounted to the locking drive rail 170 therefore also moves down. The magnetometer in the sensor housing 150 senses the magnetic field generated by magnet 172 mounted to the locking drive rail. The magnetic field properties sensed by the magnetometer will differ depending on the position of the magnet 172 attached to the locking drive rail 170 and the sensed magnetic field properties can be used as a basis for determining whether the handle grip 141 is in a closed position or an open position and hence whether the or locking device 110 is in a locked or unlocked position.

The assembly 110 can optionally be calibrated as described above in relation to the handle assembly 140. The assembly 110 can be used, as described above in relation to the handle assembly 140, to detect the position of not only the locking drive rail, but also of the leaf that the locking drive rail is mounted to.

Magnet/Sensor in Locking Bolt

Figure 30B:
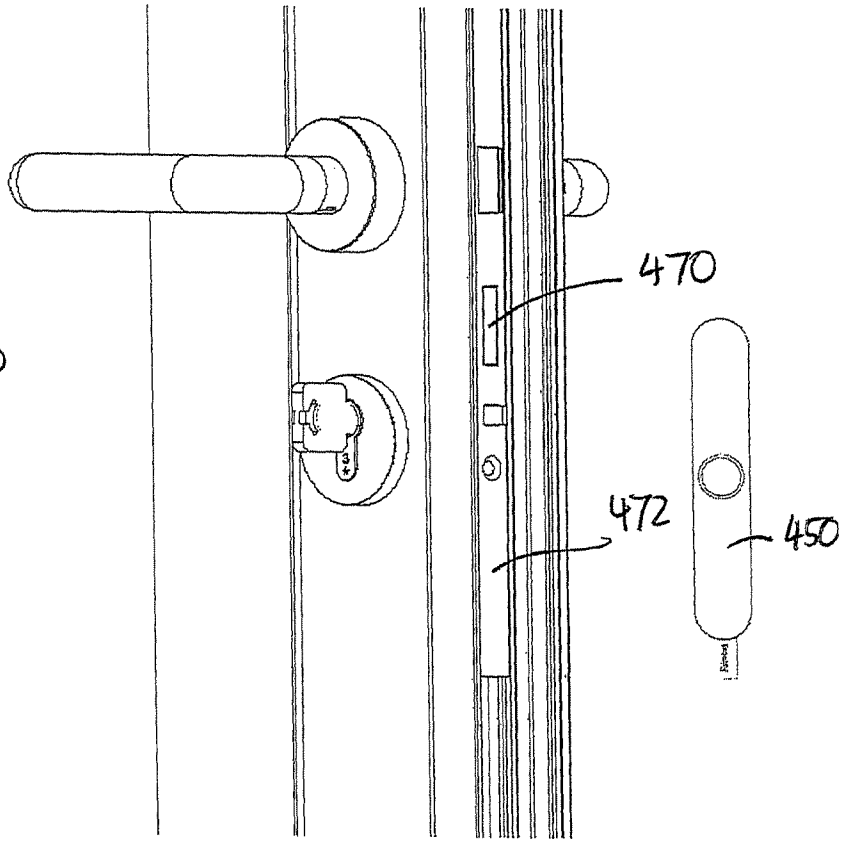
FIG. 30B shows the locking assembly of FIG. 30A with the lock mechanism in an unsecured configuration.
Figure 30A:
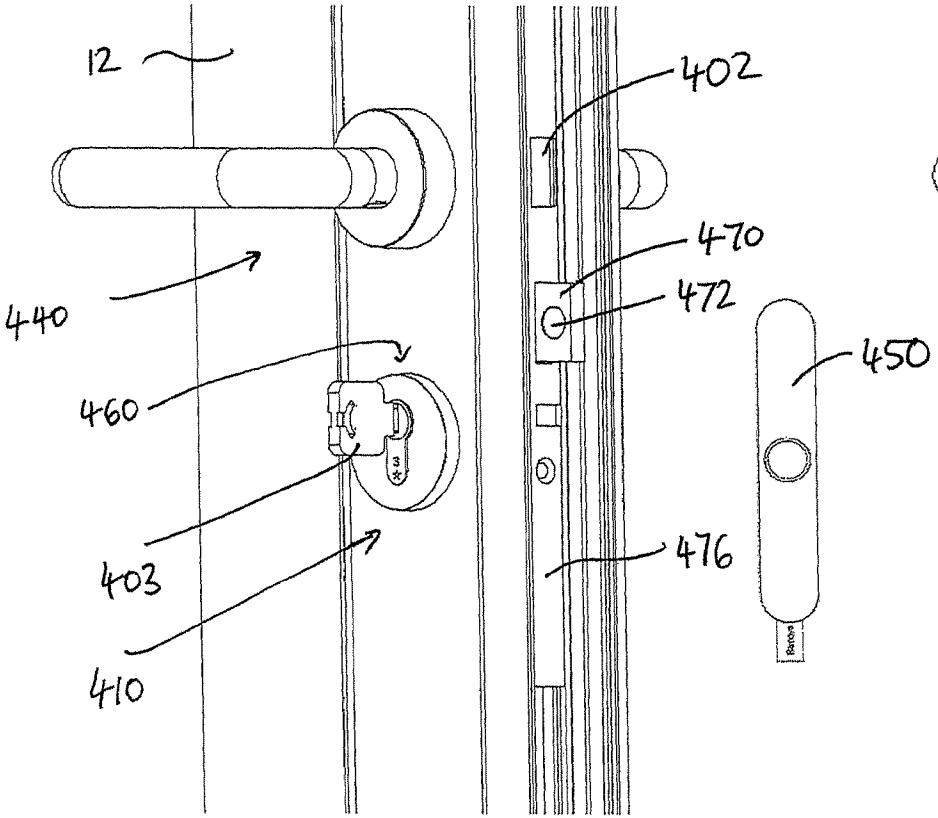
FIG. 30A shows a locking assembly including a handle assembly and lock mechanism which has an improved locking bolt, the locking assembly being mounted on door, the lock mechanism being in a secured configuration.

Referring to FIGS. 30A and 30B, a locking assembly 410 is shown mounted in a door leaf 12, the locking assembly 410 including a handle assembly 440. The handle assembly 440 drives a sprung latch 402. The locking assembly 410 further comprises a locking mechanism 460 which drives a holding means comprising locking bolt 470. The locking bolt 470 is moveable between a locked position (i.e. a secured position) in which it extends from the edge of the door leaf 12 as shown in FIG. 30A and an unlocked position (i.e. an unsecured position) in which it is retained within a recess in the door leaf, as shown in FIG. 30B. In this embodiment, the locking mechanism 460 is operated to move the locking bolt 470 between the locked and unlocked positions by a key 403. Instead of a key operated lock locking mechanism, the locking mechanism may be operated by a thumb-turn. The locking assembly 410 comprises a faceplate 476 mounted to the edge of the door leaf 12. The faceplate 476 has apertures through which the sprung latch 402 extends when in its extended position and through which the locking bolt 470 extends when in its locked position. The locking bolt 470 is receivable in a keep on the door frame (not shown in FIGS. 30A, 30B) when the door leaf is closed and the locking bolt 470 is in its locked position.

The locking assembly 410 further comprises a sensed element and a sensor for sensing the sensed element, one of said sensed element and sensor being mounted to the locking bolt 470 in use. In this embodiment the sensed element is a magnet 472 and the magnet 472 is mounted to the locking bolt 470. The sensor is a magnetometer which is mounted with other electronic components such as a battery or means for connection to a power source on a PCB in a sensor unit 450. The sensor unit 450 is for mounting to the door frame (not shown) or other suitable reference structure that the locking bolt moves relative to when it is moving between its locked and unlocked positions. The sensor unit 450 may for example be built in the door frame (i.e. hidden in the door frame) or mounted on the door frame. The locking bolt 470 has a recess shaped and sized to receive the magnet 472. In other embodiments the magnet 472 may be fully housed within (i.e. hidden) in the locking bolt 470.

As the locking bolt 470 is moved from its unlocked position to its locked position, the magnet 472 also moves. The magnetometer in the sensor housing 450 senses the magnetic field generated by the magnet 472 attached to the locking bolt 470. The magnetic field properties sensed by the magnetometer will differ depending on the position of the magnet 472 attached to the locking bolt 470 and the sensed magnetic field properties can be used as a basis for determining whether the locking bolt 470 is in a locked or unlocked position. Communications means such as RF transmission means or other wireless communications means in the sensor unit 450 transmit the output from the magnetometer to a user interface and/or allow it to be used as an input signal in a wider monitoring system.

The locking mechanism 460 can optionally be calibrated as described above in relation to the handle assembly 140. In other words, the system can be calibrated in a system calibration mode to register the locked and unlocked positions of the locking bolt 470 as predetermined positions for the locking bolt 470 to aid in determining their positions during the normal mode of the detection system. When the system is in calibration mode the user is prompted by the system to position the locking bolt in the locked position and is prompted to provide an indication to the system that the leaf is in the locked position. The system then records the magnetic field properties with the magnet 472 at that predetermined position. These calibration steps are also carried out with the locking bolt 470 in the unlocked position. Alternatively the calibration steps can be carried out with the locking bolt in the unlocked position first and then the locked position, as the ordering of calibration in the different predetermined positions does not matter.

The magnetometer in the sensor unit can be used not only to monitor whether the locking bolt is locked or unlocked, but also to monitor the position of the leaf, since the magnet 472 on the locking bolt is carried by the leaf and will change position as the leaf is opened and closed.

Magnet/Sensor in Keep

Referring to FIGS. 31A to 34B, further aspects of a locking assembly of the type shown in FIGS. 30A and 30B are shown. This aspect of the invention involves keeps, also known as strike plates. These are typically plates, usually of metal, which are fixed to a door or window frame and have a hole or holes, the hole or each hole for receiving a door or window holding means such as a lock or latch, for example a bolt or a hook. When the door or window is closed, the locking or latching means extends into the hole or holes in the keep and holds the door or window leaf closed. The metal keep protects the door or window frame against friction from the locking or latching means and increases security in the case of a frame made of a softer material, such as wood.

Figure 31B:
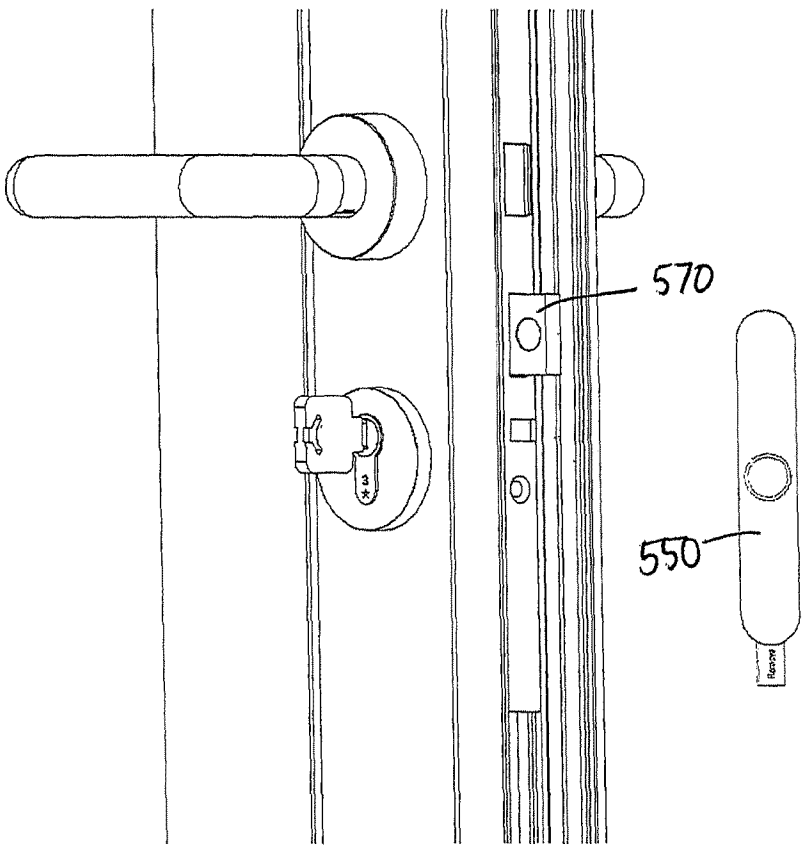
FIG. 31B shows the locking assembly of FIG. 31A with the lock mechanism in a secured configuration.
Figure 31A:
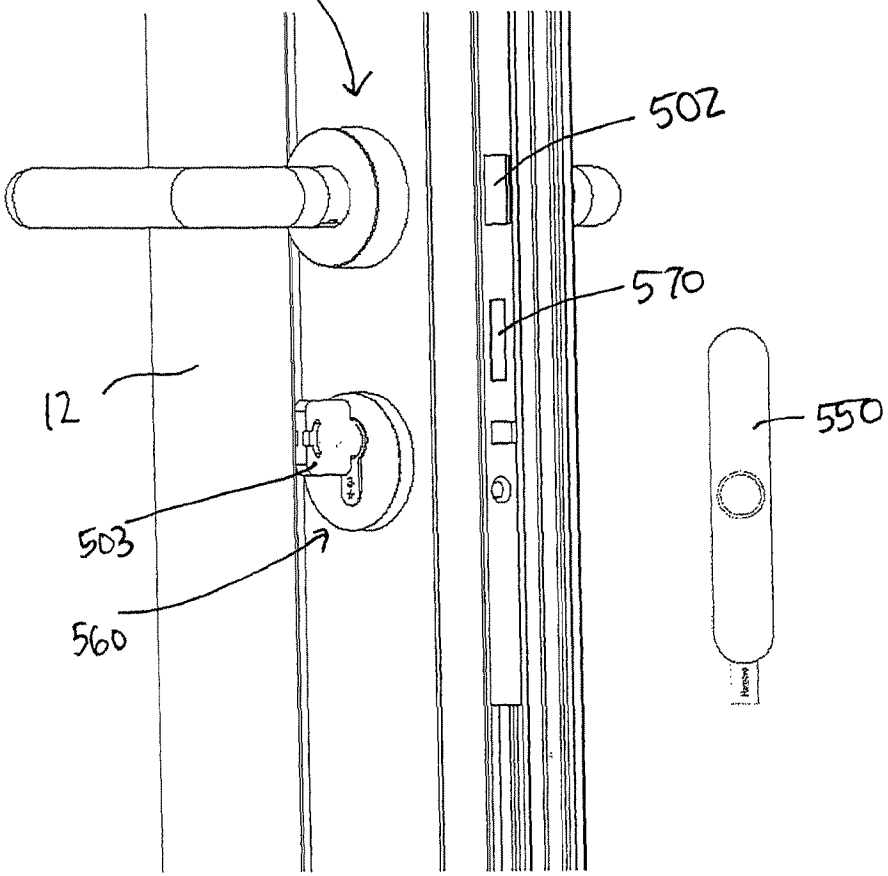
FIG. 31A shows a locking assembly mounted on a door, the locking assembly including a handle assembly and lock mechanism like that of FIGS. 30A and 30B but with an improved keep, the lock mechanism being in an unsecured configuration.
Figure 32B:
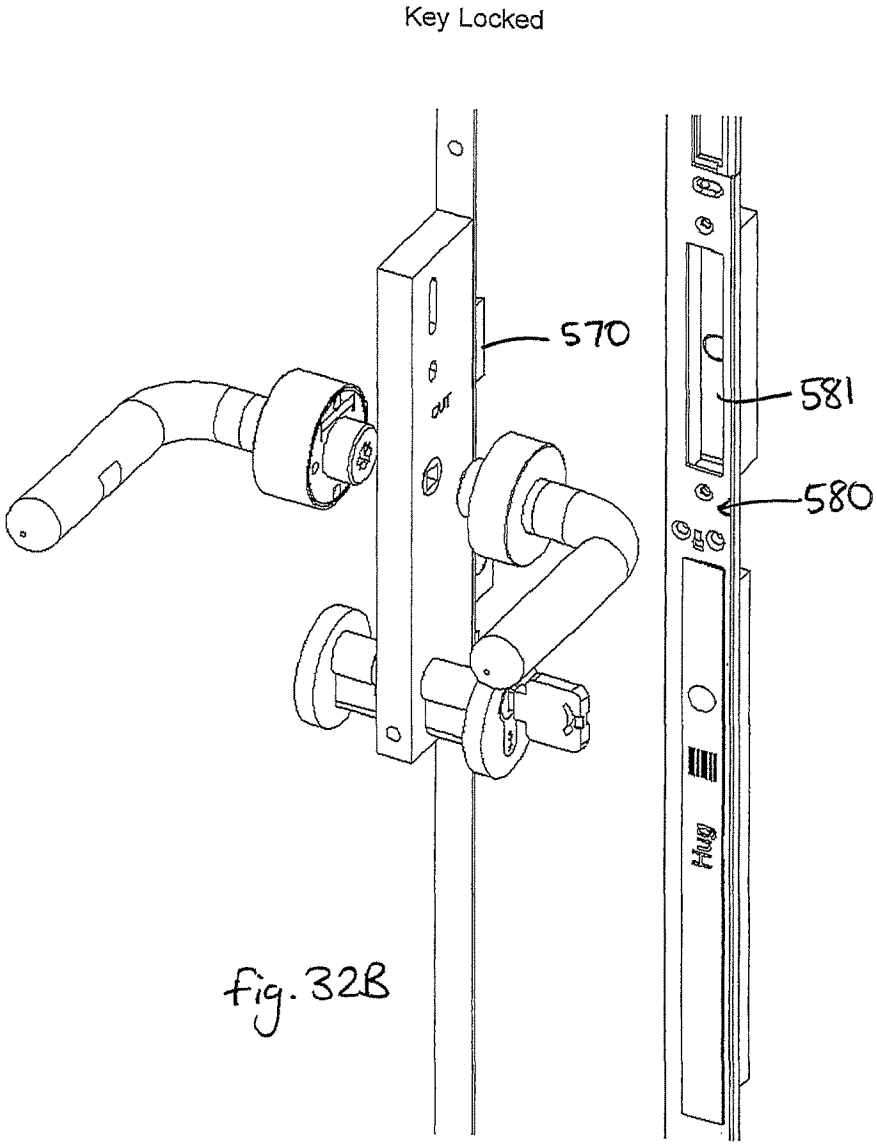
FIG. 32B shows the locking assembly of FIG. 32A with the lock mechanism in a secured configuration.
Figure 32A:
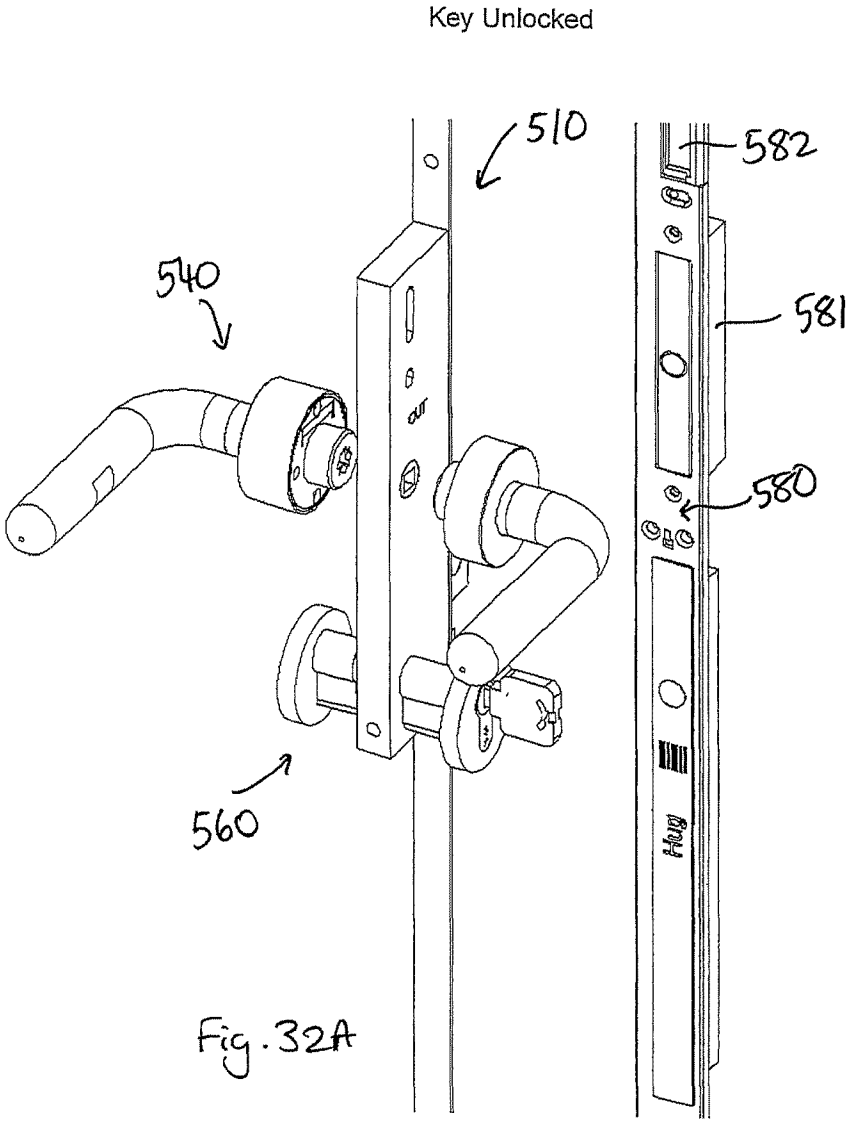
FIG. 32A shows the locking assembly of FIG. 31A unmounted, with certain parts exploded and with the keep visible, the lock mechanism being in an unsecured configuration.

FIGS. 31A to 34B show a locking assembly 510. The locking assembly 510 includes a locking mechanism 560, which in this embodiment is driven by a key 503 (although it may be driven by other means, such as a thumb turn). The locking mechanism 560 drives a holding means comprising a locking bolt 570. The locking bolt 570 is moveable between a locked position (i.e. a secured position) in which it extends from the edge of the door leaf 12 as shown in FIG. 31B and an unlocked (i.e. an unsecured position) in which it is retained within a recess in the door leaf, as shown in FIG. 31A. The locking bolt 570 is receivable in a corresponding recess 581 in a keep 580 which is mounted in use on the door frame (the keep being visible in FIGS. 32A to 34B). The locking assembly 510 also includes a handle assembly 540. The handle assembly drives a sprung latch 502, which is receivable in a corresponding recess 582 in the keep 580.

Figure 33B:
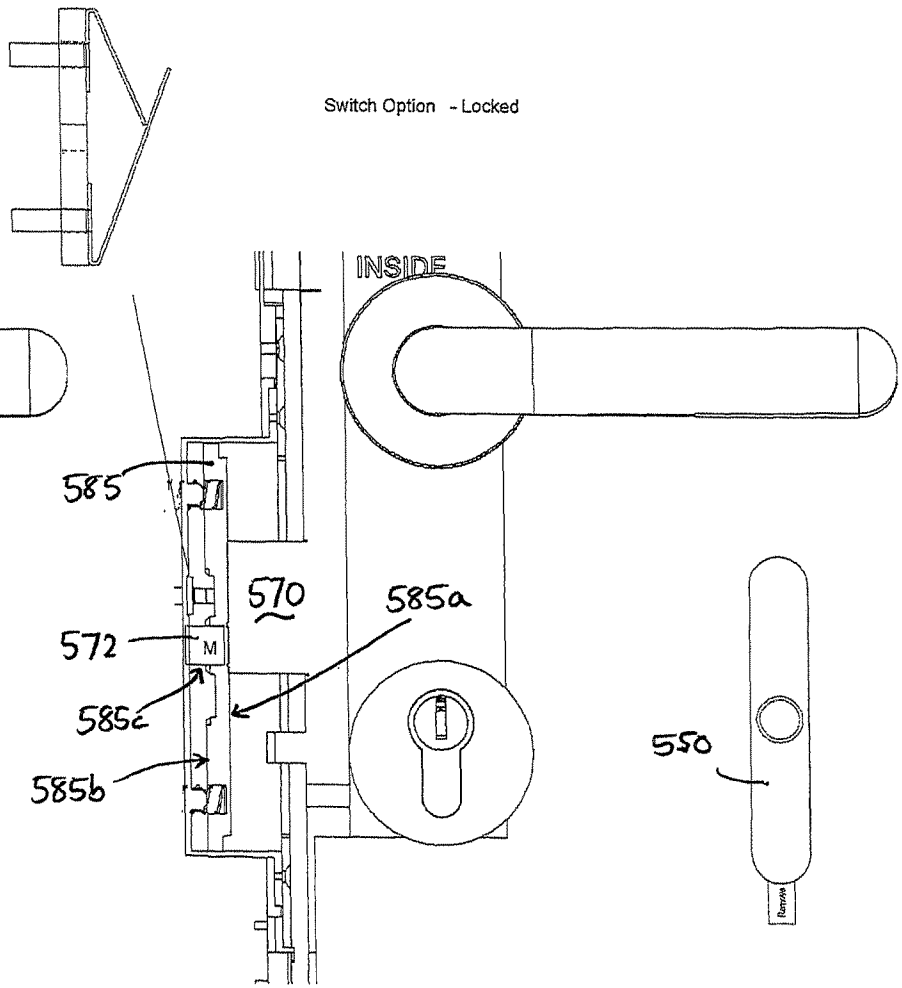
FIG. 33B shows the assembly of FIG. 33A, the lock mechanism being in a secured configuration.
Figure 33A:
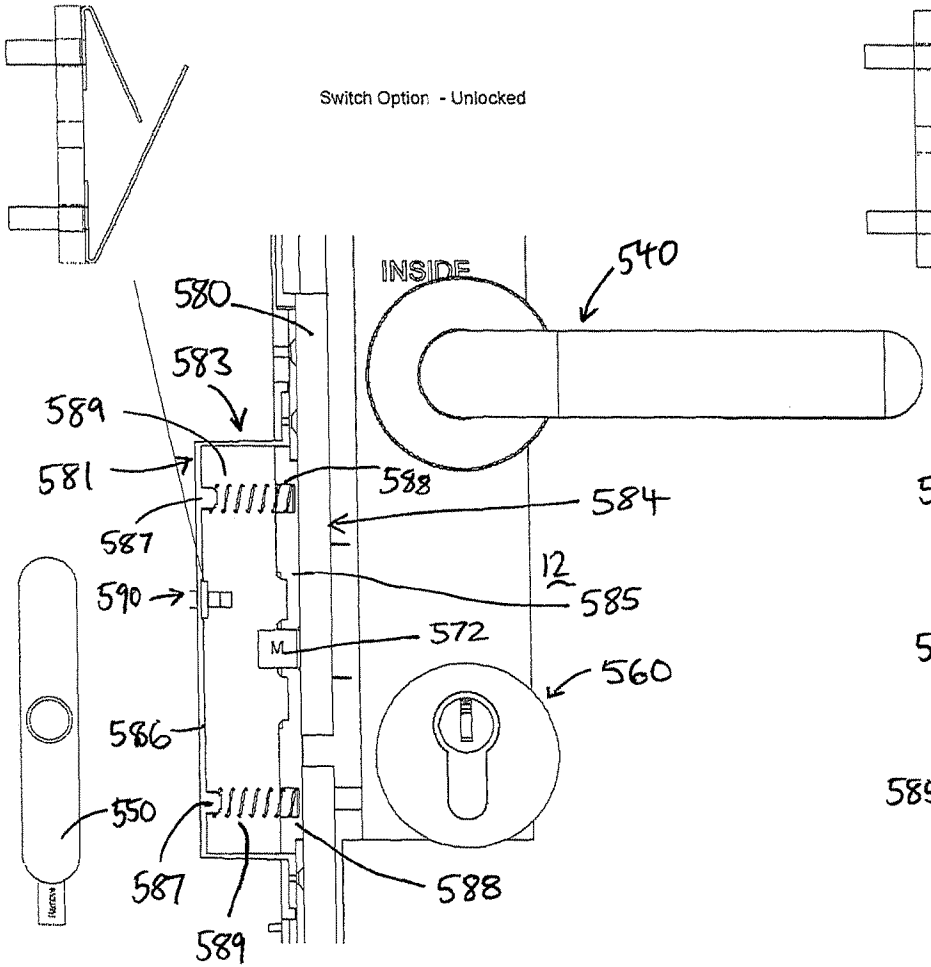
FIG. 33A shows a partial cross-sectional view of the assembly of FIG. 31A from one side of the door, with the keep in cross-section and part of the switch shown enlarged, the lock mechanism being in an unsecured configuration.

Referring to FIGS. 33A and 33B, the recess 581 in the keep 580 for receiving the locking bolt 570 has a recess housing 583 and an opening 584 arranged to face away from the frame for receiving the locking bolt 570 therein when the locking bolt 570 is in the locked position. The recess 581 has a moveable element 585 mounted therein. The moveable element 585 is a plate, which is moveable between a first position shown in FIG. 33A (an extended position) and a second position shown in FIG. 33B (a recessed position relative to the leaf edge). The plate 585 is caused to move from the first position to the second position when the locking bolt 570 moves from its unlocked to its locked position. The plate 585 is sprung mounted in the recess 581. The inside of the recess housing has a base 586 opposite the recess opening, the base 586 having first and second upstanding pins 587 extending from it (other numbers of upstanding pins may be used). Received around each pin 587 is a helical compression spring 589, the other end of each spring 589 being received in a corresponding blind bore in the plate 585. Each arrangement of a pin, blind bore and spring provides biasing means which urges the plate 585 away from the frame. The plate 585 is therefore biased towards its first position.

The locking assembly 510 also includes sensing means for sensing whether the moveable element is in the first position or the second position. In a first embodiment relating to keep 580, the locking assembly 510 has a sensed element and a sensor for sensing the sensed element, one of said sensed element and sensor being mounted to the plate 585 in use. In this embodiment the sensed element is a magnet 572 and the magnet 572 is mounted to the plate 585. The sensor is a magnetometer which is mounted with other electronic components such as a battery or means for connection to a power source in a sensor unit 550, like sensor unit 450 in the previous embodiment. The sensor unit 550 may be mounted to any suitable reference structure that the plate 585 is moveable relative to, such as the door frame. The plate 585 has an outer surface 585*a* that faces away from the frame and an under surface 585*b* opposing the outer surface 585*a*. The magnet 572 is mounted in a recessed area 585*c* in the under surface 585*b*, although it may be mounted at any suitable location on the plate 585. The recessed area 585*c* is shaped and sized to receive the magnet 572. The magnet 572 may be affixed to the plate 585 using any suitable fixing means such as screw means or glue.

As the locking bolt 570 is moved from its unlocked to its locked position, the locking bolt 570 pushes the plate 585 from its first position as shown in FIG. 33A to its second position as shown in FIG. 33B. The magnet 572, mounted to the plate 585, also moves. The magnetometer in the sensor unit 550 senses the magnetic field generated by the magnet 572 attached to the plate 585. The magnetic field properties sensed by the magnetometer will differ depending on the position of the magnet 572 attached to the plate 585 and the sensed magnetic field properties can be used as a basis for determining whether the plate 585 is in a locked or unlocked position. Communications means such as RF transmission means or other wireless communications means in the sensor unit 550 transmit the output from the magnetometer to a user interface and/or allow it to be used it as an input signal in a wider monitoring system.

The locking mechanism 560 can optionally be calibrated as described above in relation to the locking bolt 470. In other words, the system can be calibrated in a system calibration mode to register the first and second positions of the plate 585 as predetermined positions for the plate 585 to aid in determining their positions during the normal mode of the detection system. When the system is in calibration mode the user is prompted by the system to position the locking bolt 570 in the locked position (wherein the plate 585 will be in the second position) and the user is prompted to provide an indication to the system that the leaf is in the locked configuration. The system then records the magnetic field properties with the magnet 572 at that predetermined position. These calibration steps are also carried out with the locking bolt 570 in the unlocked position and the plate 585 in the first position. The calibration steps could of course be carried out in the reverse order, with the system being registered in its unlocked configuration first, then the locked configuration.

In a further embodiment relating to keep 580 also shown in FIGS. 31A to 34B, the sensing means for sensing whether the plate 585 is in the first position or second position is a switch for detecting at least one position of the moveable element. The switch 590 is shown in FIGS. 33A to 34B (although in practice only one of the magnet 572 or switch 590 would be employed to determine the position of the plate 585). The switch 590 is a push switch. The switch 590 is mounted on the base 586 of the recess housing 583. The switch 590 is activated (i.e. it completes a sensing circuit) when the plate 585 is moved to the second position, engaging the switch 590.

Figure 34B:
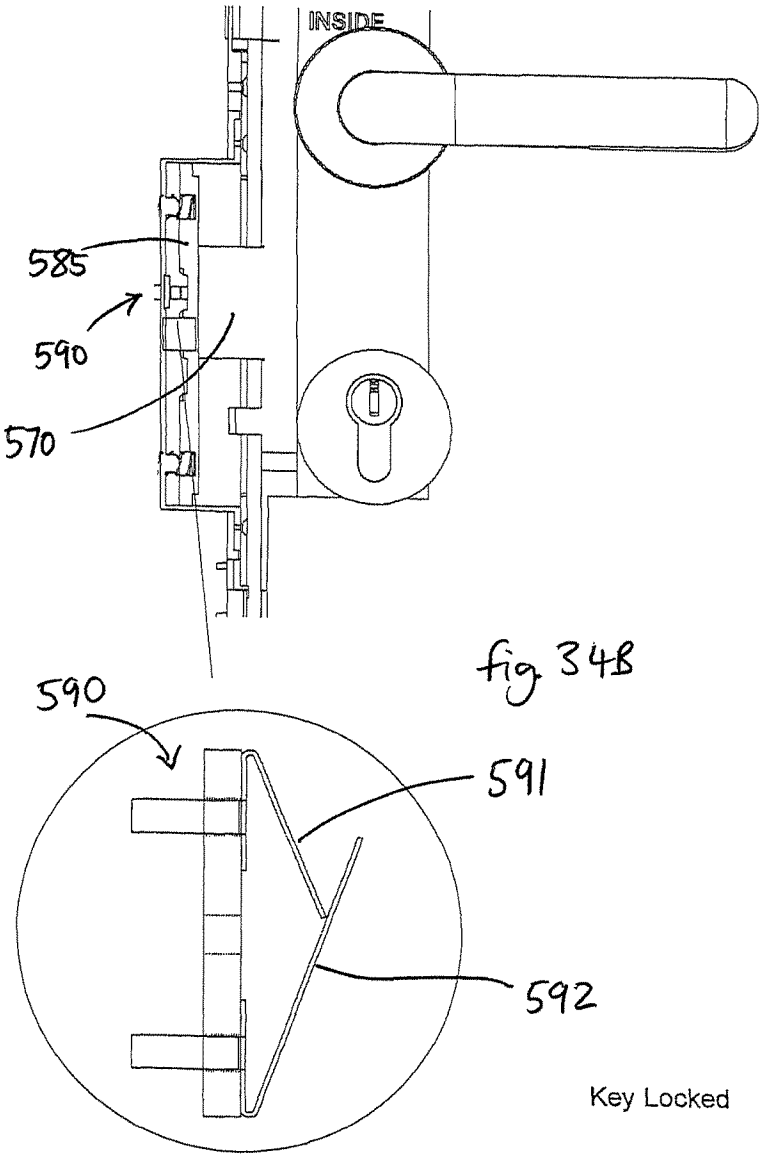
FIG. 34B shows the assembly of FIG. 33B with part of the switch shown further enlarged.

Enlarged views of the switch 590 are shown in FIGS. 33A to 34B. Referring to FIG. 34A, the switch has first and second resilient armatures 591, 592. Each of the first and second resilient armatures is a moveable armature 591, 592. One of the armatures 591 is a positive contact and one is a negative contact for connection in a sensing circuit, the circuit including connection to a power source, such as a battery or a mains power source. The switch 590 has a body 593, the first and second resilient armatures 591, 592 being mounted thereto. Each of the armatures 591, 592 has a first portion 591*a*, 592*a* mounted to the body 593 and a free portion 591*b*, 592*b* that extends outwards from the body 593 and towards the other of the first and second armatures. The free portion 592*b* of the second armature 592 is longer than the free portion 591*b* of the first armature. The switch has a first switched state in which the armatures 591, 592 are not contacting one another, the free portion 592*b* of the second armature overlying the free portion 591*b* of the first armature, as shown in FIG. 34A. The switch has a second switch state in which the first and second armatures 591, 592 are contacting one another, as shown in FIG. 34B. The switch 590 may have a housing 594 (not shown in the enlarged views of the switch) encasing the armatures 591, 592. The under surface 585*b* of the plate has a recessed area 585*c* for contacting the switch housing 594 when the plate 585 is in the second position.

Figure 34A:
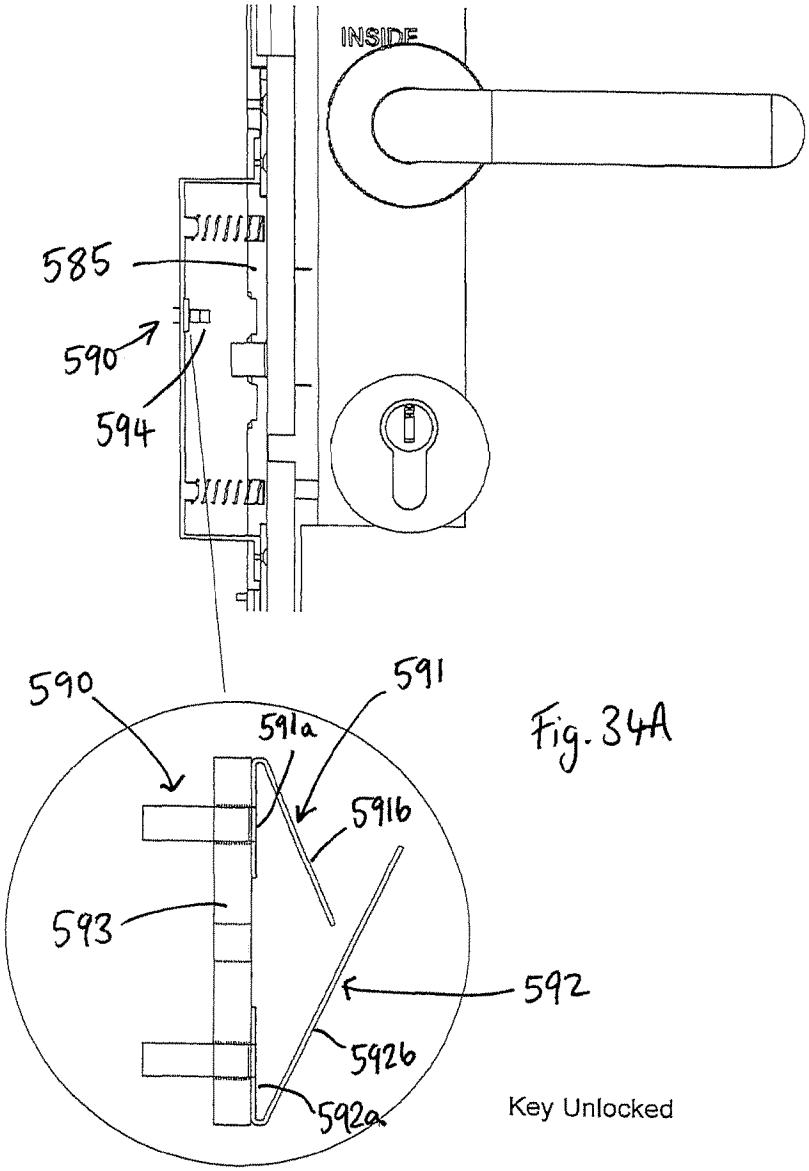
FIG. 34A shows the assembly of FIG. 33A with part of the switch shown further enlarged.

As the locking bolt 570 is moved from its unlocked position to its locked position, the locking bolt 570 pushes the plate 585 from its first position as shown in FIG. 34A to its second position as shown in FIG. 34B and in turn activates switch 590 by means of the plate 585 contacting the switch 590. The plate 585 pushes at least the second armature 592, causing it to contact the first armature 591 as shown in FIG. 34B, completing the sensing circuit (if the switch has a housing encasing the armatures 591, 592, the housing allows a pushing force on the switch to be transmitted to the armatures 591, 592). The switch 590 therefore provides an output to the system indicating that the locking bolt 570 is in its locked position. When the switch 590 is unactivated, this provides an output to the system that the locking bolt is in its unlocked position. An indication of the status of the locking bolt (locked or unlocked) can therefore be provided to a display means or user interface.

The sensing circuit may be associated with communication means for transmitting the output from the switch 590 as an input in a wider monitoring system.

The first and second moveable armatures 591, 592 allow for the switch 590 to be activated when the plate 585 is at a range of continuous positions, to allow for variability in the location of the plate 585 when in its second position (e.g. to account for thermal expansion/contraction in the door assembly). The plate 585 may push merely the second armature 592 into contact with the first armature 591, or may push both the first and second armatures 592, 591 towards the body 593, but in both cases, if the first armature 592 is moved by a minimum amount, the first and second armatures 591, 592 will contact one another, completing the circuit, allowing for detection that the locking bolt 570 has been moved to the locked position.

The keep 580 may include more than one switch 590, e.g. two switches, instead of just one switch 590. In embodiments with two switches, both switches are activated when the plate 585 is in its second position.

Anti Lock and Handle Drop (SAG)

The friction in the lock assembly 110 should maintain the locking drive rail 170 in its locked position, however the weight of the system may cause the locking drive rail to drop out of the locked position towards the unlocked position. The magnet 172 mounted to move with the locking drive rail 170 such that it moves up and down the faceplate 176 has a further advantage of retaining the locking drive rail 170 in the locked position via magnetic attraction between the magnet 172 and the faceplate 176 or other ferrous parts of the window system, preventing the locking drive rail 170 from dropping under gravity. The magnet 172 may therefore may be advantageously mounted to the locking drive rail 170 in a lock assembly 110 for the anti-drop effect without the use of a corresponding sensor (e.g. magnetometer) unit for sensing position of the magnet.

Drive Pin to Activate Sensor Switch

Alternative apparatus for determining whether a window or door leaf is open/closed or locked/unlocked will now be described.

Figure 26:
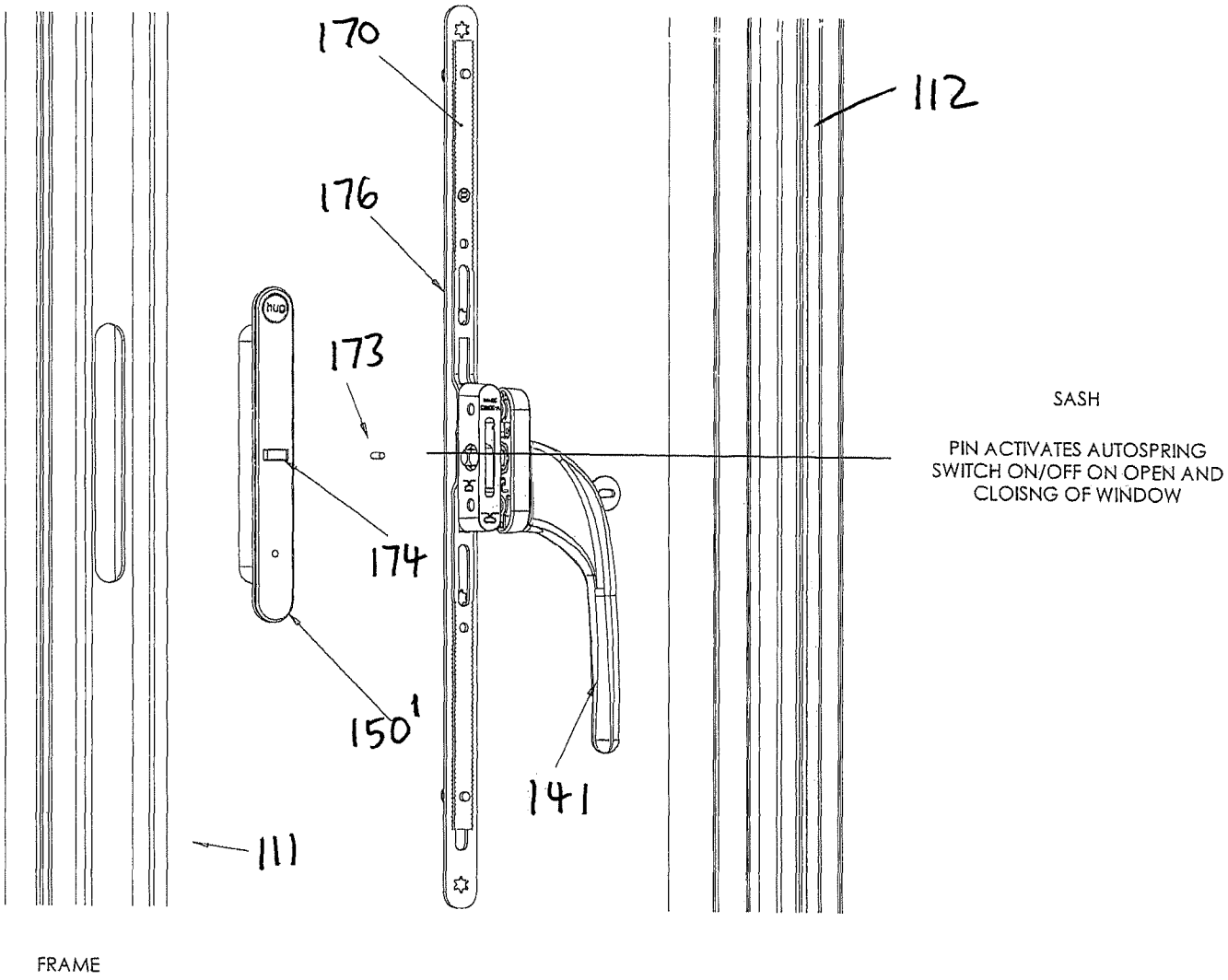
FIG. 26 shows an espagnolette assembly exploded from a sash and frame with a drive pin and associated switch.

Referring to FIG. 26 the faceplate 176 of a locking assembly has a drive pin 173 mounted thereto such that it projects from the face of the faceplate 176 that faces away from the sash 112 (in FIG. 26, the drive pin 173 is shown exploded from the assembly). A switch 174 for association with the drive pin 173 is shown. In this embodiment the switch 174 is a push/rocker switch. The switch 174 is located on the sensor unit 150' on the outer face which faces away from the frame 111 when installed on the frame. The push/rocker switch 174 is pushed into a first position when the drive pin 173 is passed over as the window or door leaf is closed, this indicates that the window or door leaf in the shut position. When the window or door leaf is pushed open the push/rocker switch moves into a second position this indicates that the window or door leaf is in the open position. RF communications in the sensor unit 150' transmits the output to a user interface or uses it as an input signal in a wider monitoring system.

Figure 27:
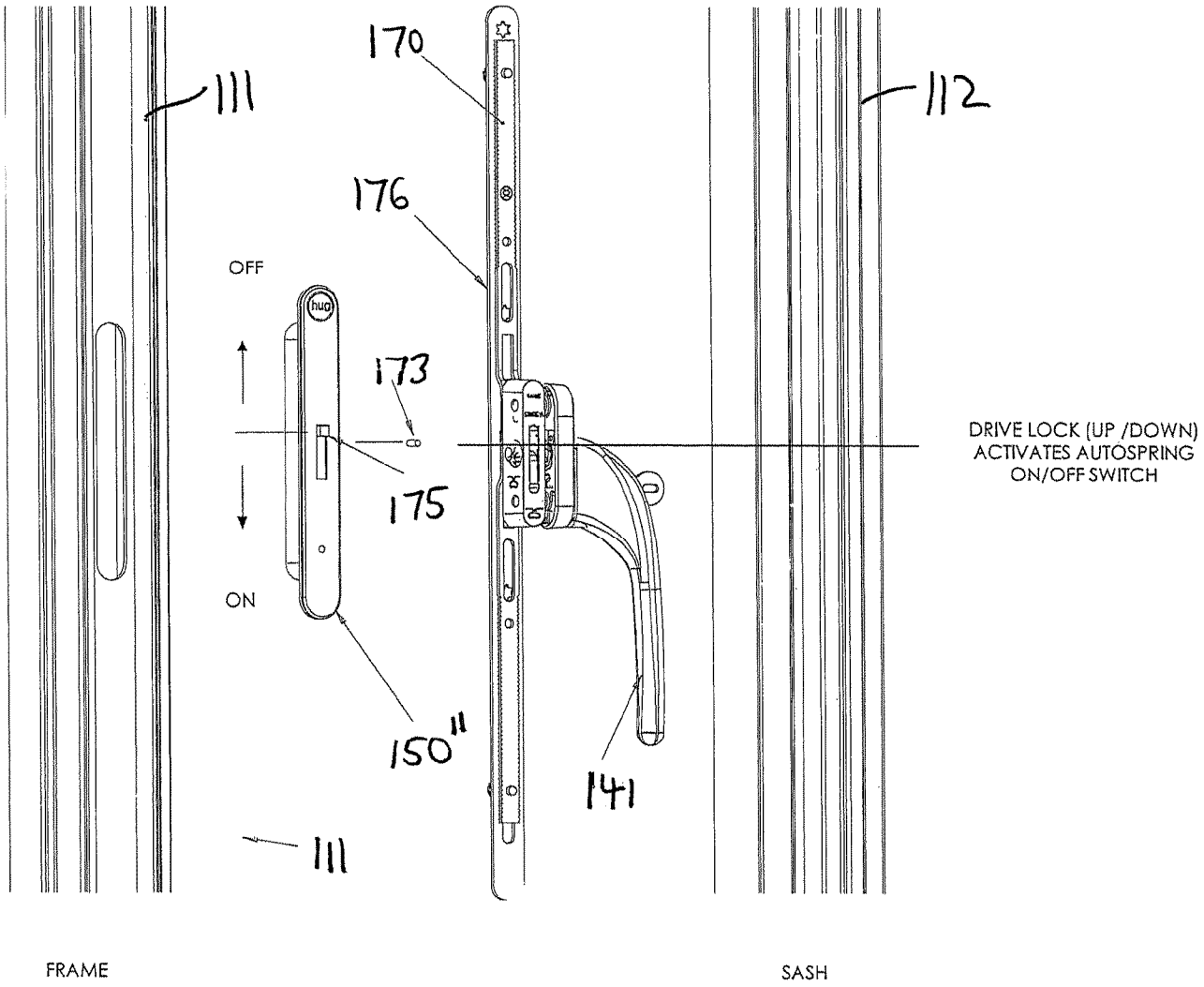
FIG. 27 shows an espagnolette assembly like that of FIG. 26 but with an alternative type of switch.

Referring to FIG. 27 a further example of a switch 175 for association with the drive pin 173 is shown. In this embodiment, rather than being mounted to the faceplate 176, the drive pin 173 is mounted to the locking drive rail 170, directly or indirectly. The drive pin 173 is mounted such that it projects beyond the faceplate 176. The drive pin 173 moves up and down as the locking drive rail 170 moves up and down upon movement of the handle grip 141 between its closed and open positions. Associated with the drive pin 173 is a switch mounted to the frame 111. In this embodiment the switch 175 is a slide switch. Like the embodiment of FIG. 26, the switch 175 is located on the sensor unit 150". The slide switch 175 is pushed into a first position when the drive pin is driven upwards and into a second position when the drive pin is driven downwards and the system operates similarly to the embodiment of FIG. 26 in that communication means in the sensor unit 150" transmits the output to a user interface or uses it as an input signal in a wider monitoring system.

Anti-Skip Block and Lock and Clip

Figure 17:
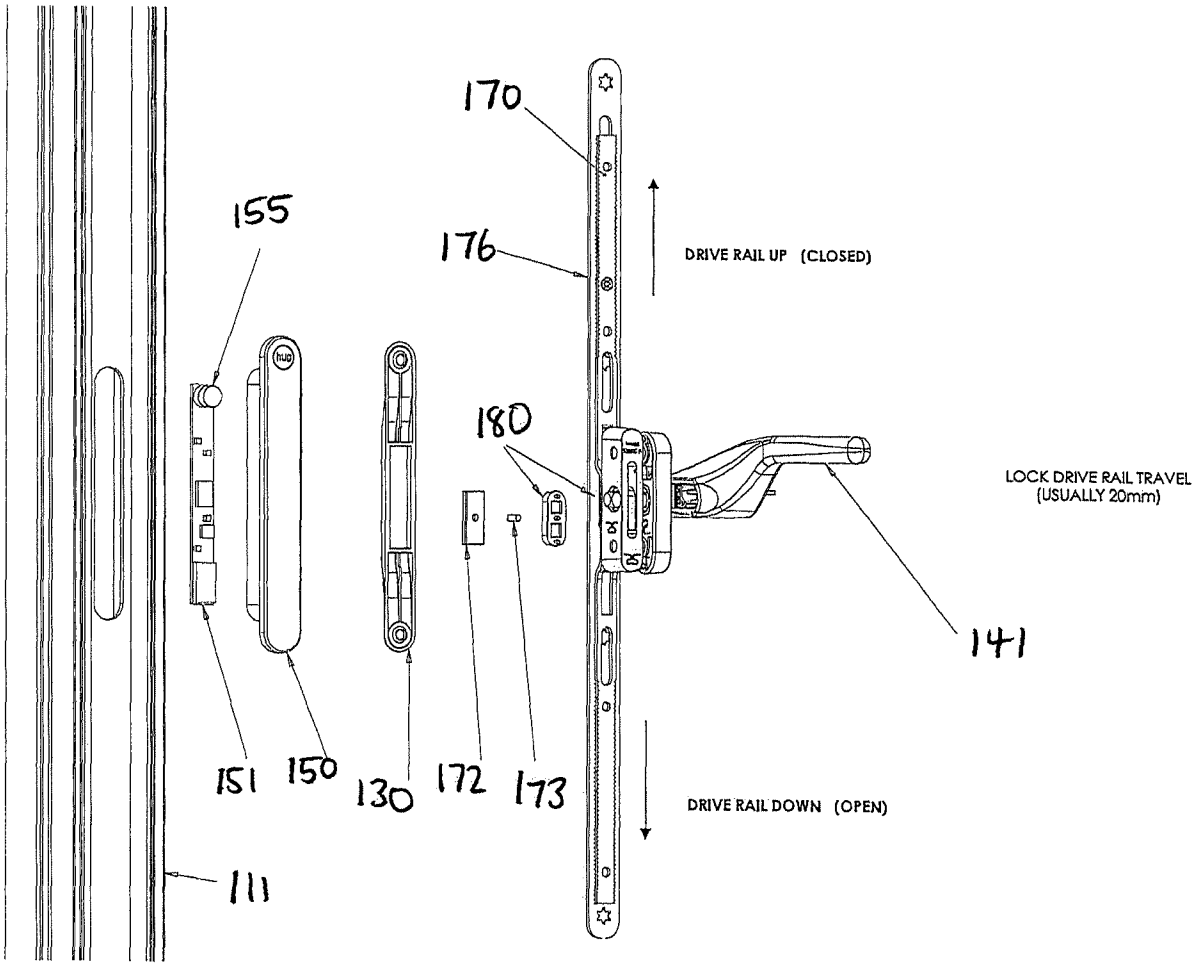
FIG. 17 shows the assembly of FIG. 16A with the handle in an open position and the sensor unit, magnet, drive pin and block exploded.
Figure 18:
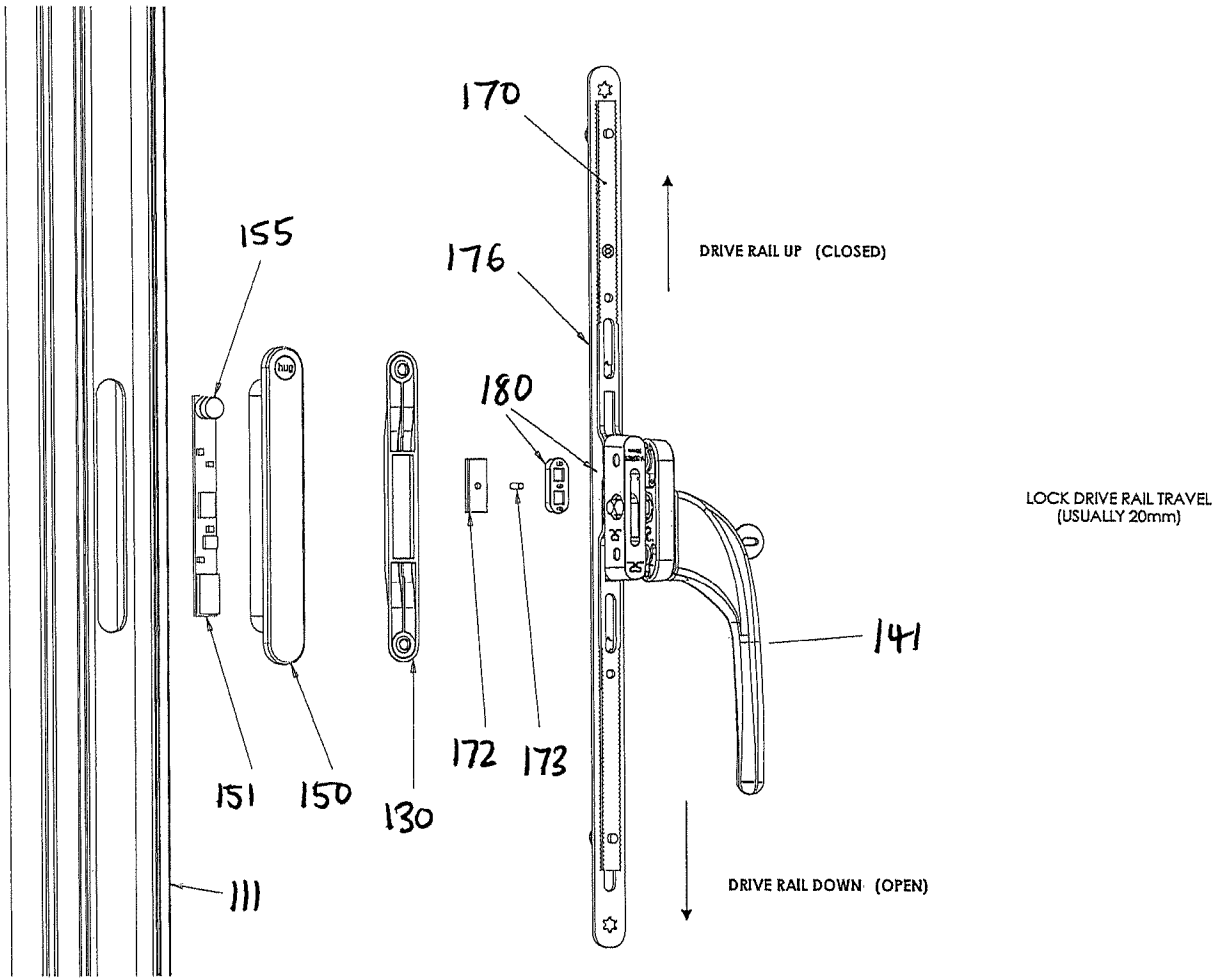
FIG. 18 shows the assembly of FIG. 17 with the handle in a closed position.
Figure 24:
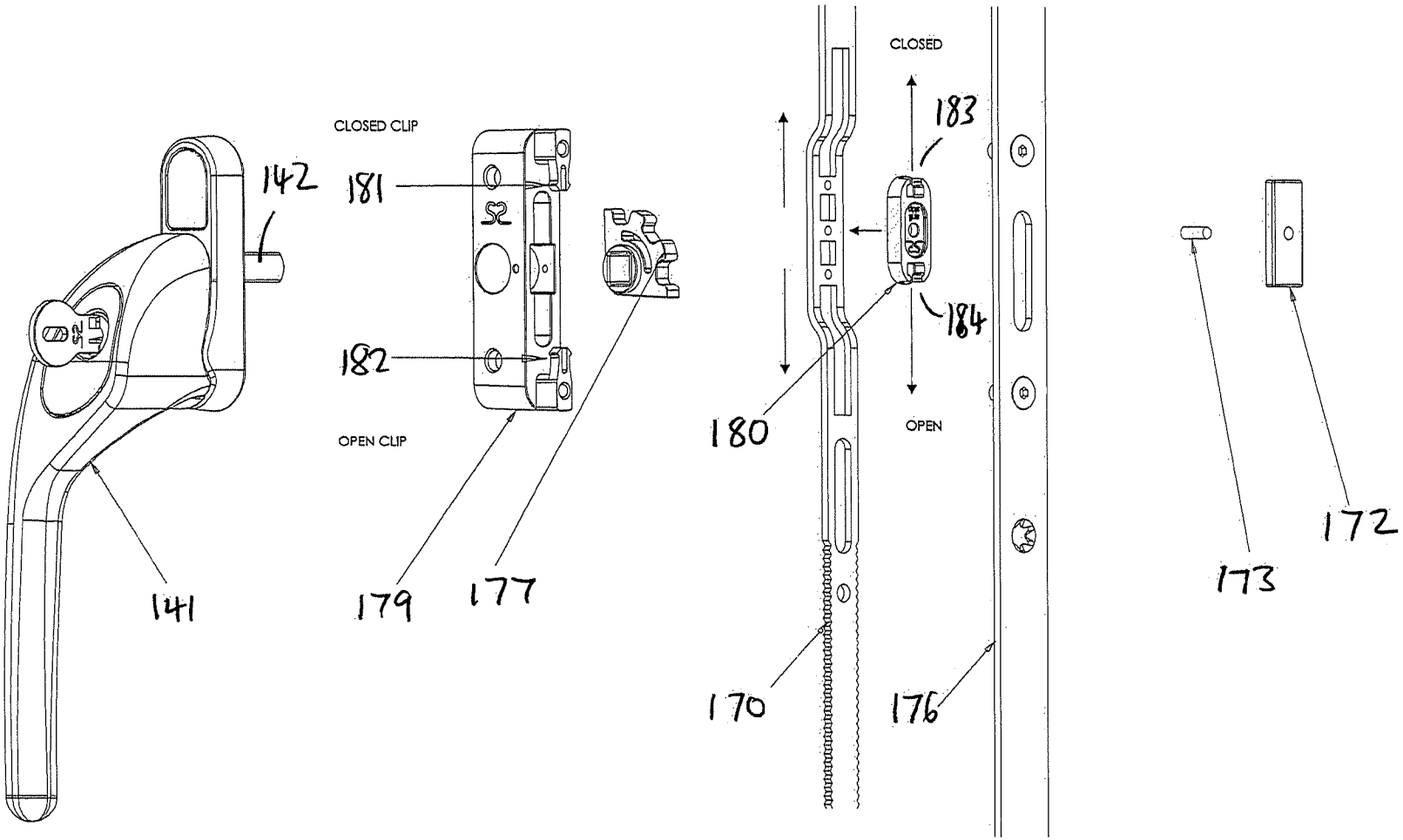
FIG. 24 shows a perspective exploded view of an espagnolette assembly for a window having an anti-skip block, magnet and drive pin mountable to the locking drive rail.

Referring to FIGS. 17 and 24, a further embodiment according to a locking assembly of invention will now be described. In this embodiment the locking drive rail 170 has a block 180 mounted to it. The block 180 has first and second ends and a longitudinal axis that aligns with the longitudinal axis of the locking drive rail 170 when assembled thereto. The block 180 is mounted between the moveable locking drive rail 170 and a face plate 176 which carries the locking drive rail 170 in use, such that the block 180 moves with the locking drive rail 170 as the locking drive rail 170 moves between its locked and unlocked positions upon rotation of the handle grip 141. The mechanism that drives the locking drive rail 170 to move linearly relative to the sash and face plate 176 comprises a rack and pinion rotary drive arrangement. The pinion 177 has a square aperture to receive the spindle 142 and has the form of a quadrant/sector of a pinion gear and carries on it a small number of large gear teeth to engage with a rack portion that is formed on an arched central region of the locking drive rail 170. The assembly has a pinion housing 179 that accommodates the pinion 177 and which is mounted non-movably relative to the sash in use.

The block 180 is an anti-skip block that stabilises the assembly, preventing gear skipping/the pinion from slipping out of planar arrangement with the rack part 178 of the locking drive rail 170. The pinion housing 179 has a first end and a second end and a longitudinal axis running between which is parallel with the longitudinal axis of the locking drive rail 170 when the assembly is assembled. The pinion housing 179 has first and second male drive barbed elements 181,182 projecting from it, spaced apart from one another and pointing towards each other and aligned with the longitudinal axis of the pinion housing 179. The block 180 has corresponding first and second female recesses 183,184 disposed on the first and second ends of the block 180 respectively. Each female recess 183,184 is shaped to receive a male drive barbed element 181,182 therein. The assembly is arranged such that when the locking drive rail is in the locked position, the first recess 183 (the upper recess) on the block 180 engages the corresponding upper male element 181 on the pinion housing 179 and when the locking drive rail is in the unlocked position the second recess 184 (the lower recess) on the block 180 engages the corresponding lower make element 182 on the pinion housing 179. Engagement of the corresponding male and female elements is via the male drive barbed element being received in the corresponding recess via a snap-fit action. A small amount of additional force is needed compared to a conventional locking assembly to put the locking drive rail into the locked position or to move it out of the locked position (and similarly for the unlocked position) due to the snap fit engagement of the corresponding male and female elements on the block 180 and pinion housing 179. The user is able to feel via the handle grip 141 once the block 180 has been put into engagement with the pinion housing 179 in the locked or in the unlocked position and this provides a tactile indication to the user that the locking mechanism has been moved fully into its locked or unlocked position.

Instead of having recesses in its first and second ends, the block 180 may have male barbed elements projecting longitudinally from its first and second ends, in which case the pinion housing 179 will have female recesses arranged on it to receive the male barbed elements of the block 180. Instead of having interengaging elements for engaging with corresponding elements on the block 180 disposed on the pinion housing 179, they may be disposed elsewhere on the sash or mounted to the sash in some other way. Other interengaging clips may be employed instead of male barbed elements and corresponding recesses.

Euro Cylinder Smart Trigger (Manual and Electronic)

Figure 21:
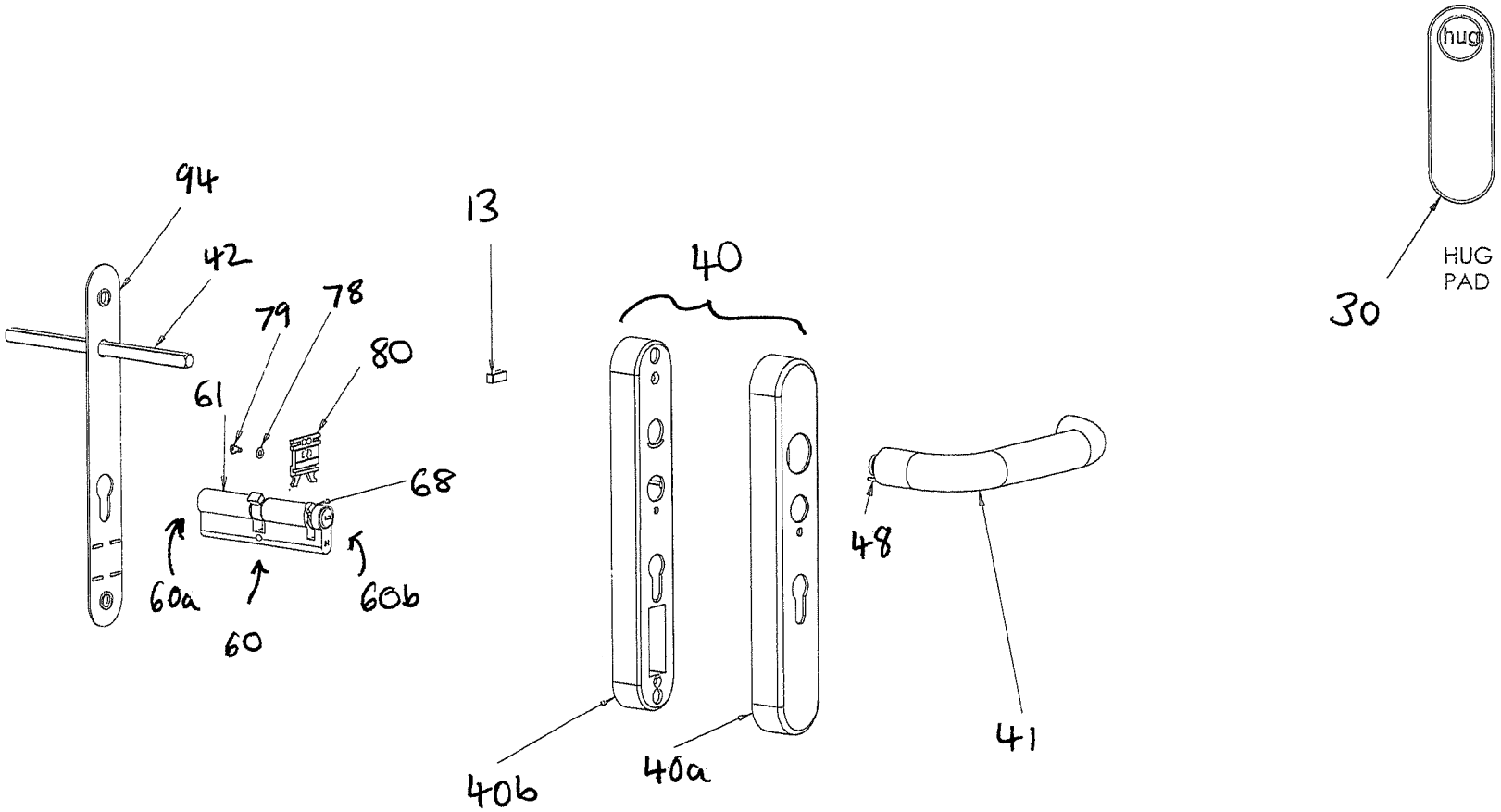
FIG. 21 shows a perspective exploded view of a handle assembly with cylinder lock and a lock status indicator means.
Figure 22C:
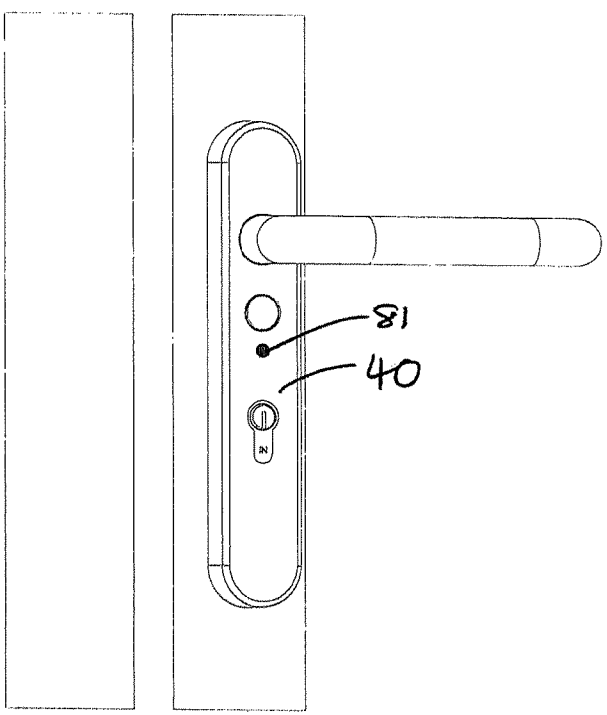
FIG. 22C shows the assembly of FIG. 22B but with the door in an open position.
Figure 22B:
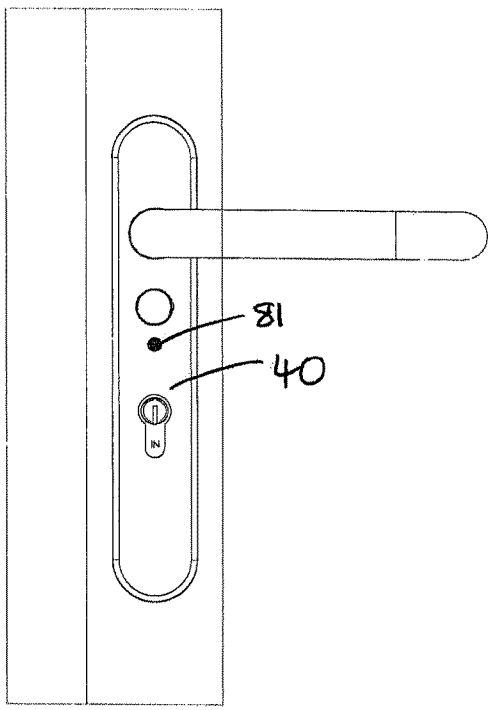
FIG. 22B shows the assembly of FIG. 22A but with the cylinder lock in an unlocked state.
Figure 22A:
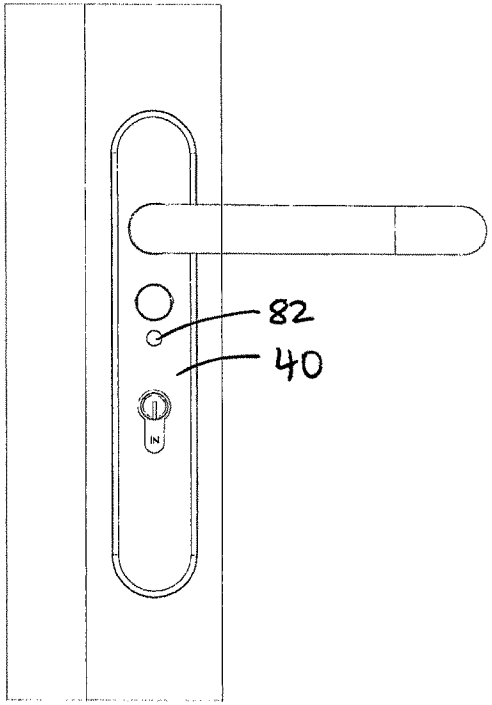
FIG. 22A shows a front view of the handle assembly of FIG. 21 from the internal side mounted to a door with the door in a closed position and with the cylinder lock in a locked state.

Referring to FIG. 21, a cylinder lock 60 is shown. The particular cylinder lock shown in the figures is a Euro Profile cylinder, although it will be appreciated that the present invention is not limited to a Euro Profile cylinder lock. The cylinder lock 60 has two ends, the longitudinal profile of the cylinder lock extending therebetween. Where the cylinder lock 60 is to be installed in an external leaf (as in the lock shown in the figures), one end 60*a* is an external end, to face externally when installed, and the other end 60*b* is an internal end, to face internally when installed. The lock cylinder 60 is part of a lock assembly for locking a leaf such as a door. This lock assembly is also part of a larger assembly which also comprises a handle grip 41 mounted to a handle casing 40. The handle casing 40 is for mounting to a door by means of suitable fixings. The handle casing 40 comprises an outer cover plate 40*a* and an inner cover plate 40*b* which is arranged between the outer cover plate 40*a* and the leaf when assembled. The assembly includes washers 19 suitably located behind each of the outer and inner cover plates 40*a*, 40*b* and a circlip 18 for location around the handle spindle 42. The cylinder lock 60 may be a single or double cylinder lock, as will be described later.

Figure 25:
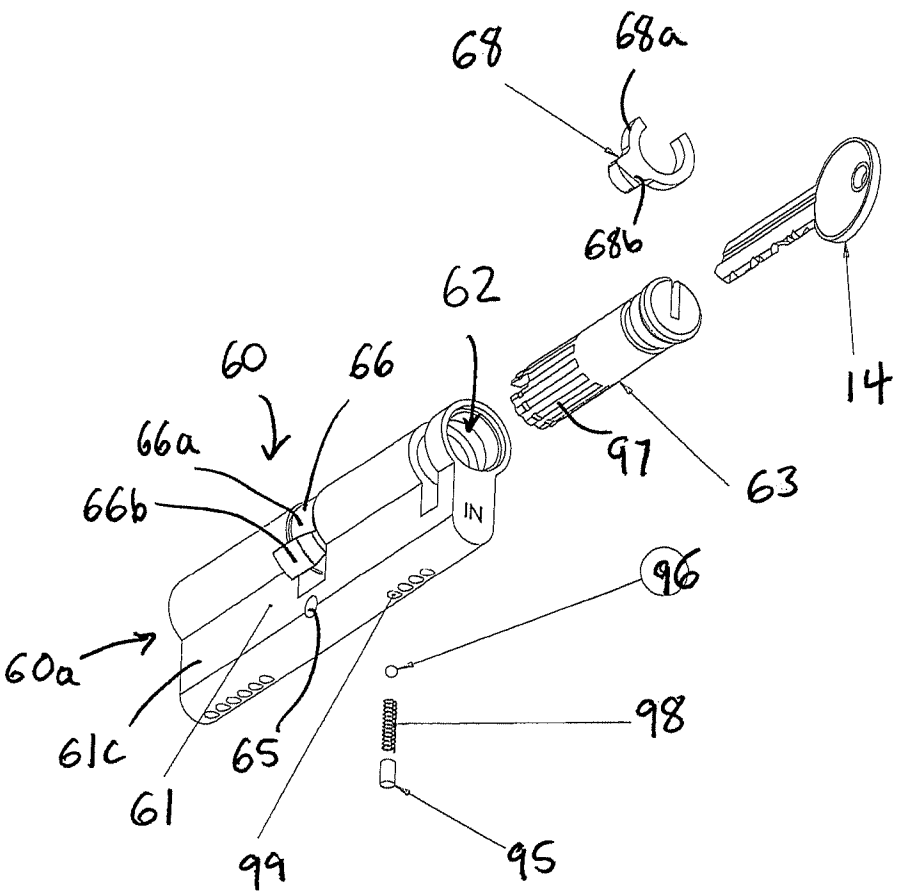
FIG. 25 shows an exploded view of the cylinder lock of the assembly of FIG. 3.

Referring to FIG. 25, the cylinder lock 60 comprises a housing 61 which defines a first bore 62 within which is mounted a first rotatable lock driving member 63. The first rotatable lock driving member 63 is a lock drum comprising a pin tumbler locking mechanism, defining a keyhole and actuable by a key as known in the art and which will not be described further. Referring to FIG. 25, a key 14 can thereby rotate the first rotatable lock driving member 63. Instead of a key operated lock drum, the rotatable lock driving member 63 may be hand-operated, for example comprising a "thumb-turn" mechanism, as is well-known in the art.

The cylinder lock has a mounting hole 65 provided in a transverse direction through the cylinder lock 60 to receive securing means, such as a bolt, to secure the cylinder lock to a leaf to which it is to be installed.

The cylinder lock 60 includes a first cam 66 co-axial with and connectable to the first rotatable lock driving member 63 for rotation therewith. The first cam 66 has a generally cylindrical body 66*a* and has a radially projecting protrusion as a cam lever 66*b*. Rotation of the first rotatable lock driving member 63 causes the first cam 66 to rotate, thereby actuating a locking bolt/latch (not shown) or other locking mechanism for locking the leaf. The first cam 66 is located partway between the internal end 60*b* and the external end 60*a* of the cylinder lock 60, preferably about midway between.

The cylinder lock 60 further includes a second cam 68, which is co-axial with and connected to the first rotatable lock driving member 63 such that rotation of the first rotatable lock driving member 63 drives rotation of the second cam 68. The second cam 68 has a C-shaped body portion 68*a* and a radially projecting protrusion 68*b*. The C-shaped body portion 68*a* of the second cam 68 is received around the first rotatable lock driving member 63 when assembled. It will be understood that the body portion 68*a* of the second cam 68 may be shaped other than a C-shape, but in the particular lock cylinder shown in the figures the C-shape body portion 68*a* allows the second cam 68 to be attachable to the first rotatable lock driving member 63 via a snap action, allowing the second cam 68 to be easily installed and removed from the cylinder lock 60, such that it can be provided as an optional feature for the lock assembly. In the particular cylinder lock shown in the figures, the second cam 68 is located between the first cam 66 and the internal end 60*b* of the cylinder lock, but it may be located between the first cam 66 and the external end 60*a* of the cylinder lock.

Euro Cylinder Smart Trigger Locking Status (Manual)

The second cam 68 is a lock status indicator cam adapted to be operatively associated with lock status indicating means for indicating the locked or unlocked state of the cylinder lock, as will be further described. Referring to FIG. 23A, the lock status indicating means comprises a cam follower which in this instance is an indicator slider 80 which is moveable in response to movement of the second cam 68. Referring to FIG. 21, the indicator slider 80 is slidably mounted to the inner cover plate 40*b* via a screw 79 or other suitable mounting means and a washer 78 is arranged between the screw 79 and the indicator slider 80. Referring to FIG. 23, the screw 91 is received in an elongate slot 83 in the indicator slider 80, such that the indicator slider 80 is slidable relative to the handle casing 40.

Referring to FIGS. 23A to 23E, the indicator slider 80 has indicia 81, 82 thereon to indicate the locked or unlocked state of the cylinder lock. The indicia comprise a first indicium 81 which indicates locked status and a second indicium 82 which indicates unlocked status. In the embodiment in the figures the indicia are areas on the indicator slider of different colour, the locked indicium 81 being a dark colour and the unlocked indicium 82 being a light colour. The handle casing 40 has a viewing aperture 84 through which the locked or unlocked indicia of the indicator slider 80 are visible, depending on the lock status. The viewing aperture 84 is about the same size as each of the indicia 81, 82, so that only one indicium is visible at a time through the viewing aperture 84 when the lock is in the locked or unlocked states.

The indicator slider 80 is configured to convert rotary motion of the second cam 68 to linear movement of the indicator slider 80 to switch the indicia that is visible through the viewing aperture 84, depending on the lock status. The indicator slider 80 has a body portion 80*a* with a recess 80*b* therein. In this embodiment the recess 80*b* has opposing inner sides 85, 86 which slant outward from one another toward the edge of the indicator slider 80, forming V-shaped inner sides. The elongate slot 83 has a longitudinal axis which is parallel with the direction of sliding of the indicator slider. The recess 80*b* may be other shapes than V-shaped.

The movement of the first rotatable lock driving member 63 from an unlocked condition to a locked condition and vice versa causes the second cam 68 to rotate, which causes the indicator slider 80 to translate linearly in one direction or the other, depending on the direction of rotation of the indicator slider. In operation, as the first rotatable lock driving member 63 is rotated to convert the lock from a locked to unlocked condition, the second cam 68 is rotated clockwise and the second cam 68 engages a first inner side 85 of the recess 80*b*, which causes the indicator slider 80 to slide to the right, when viewed from the internal side of the door, as shown in FIG. 23A. Only the unlocked indicium 82 is then visible through the viewing aperture 84 in the handle casing 40. As the first rotatable lock driving member 63 is rotated to convert the lock from the unlocked condition to the locked condition, the second cam 68 is rotated anticlockwise and the second cam 68 engages a second inner side 86 of the recess 80*b*, which causes the indicator slider 80 to slide to the left when viewed from the internal side of the door (as seen from the external side in FIG. 23B). Only locked indicium 81 is then visible through the viewing aperture 84 in the handle casing 40. It will be understood that assembly in the embodiment in the figures is a left handed lock and door handle assembly, however a right handed lock and door handle assembly can be provided.

The slider 80 has a pair of notches 87 on either side such that the translational movement of the slider 80 from side to side is not impeded by fixings that are present in the handle assembly as required for other parts of the assembly.

Euro Cylinder Smart Trigger Locking Status (Electronic)

Alternatively or in addition to the purely mechanical lock status indicating means provided by the indicator slider 80, the assembly may have electronic lock status indicating means. An advantage of electronic lock status indicating means is that the lock status can be transmitted to a remote user display means such as a user interface, such that a user can check the lock status remotely. The electronic lock status indicating means can also be used as a secondary detection system for interacting with the leaf position detection means described above, the output of the electronic lock status means being an input for controlling the power mode of the leaf position detection means for example. The embodiment shown in the FIG. 1 has both a mechanical and electronic lock status indicating means, however in some embodiments it has one or the other. The electronic lock status indicating means may be sensor means for sensing direction of movement of the second cam 68, such as a direction sensor to sense radially projecting protrusion 68*b* of the second cam sweeping past the direction sensor.

Figure 7B:
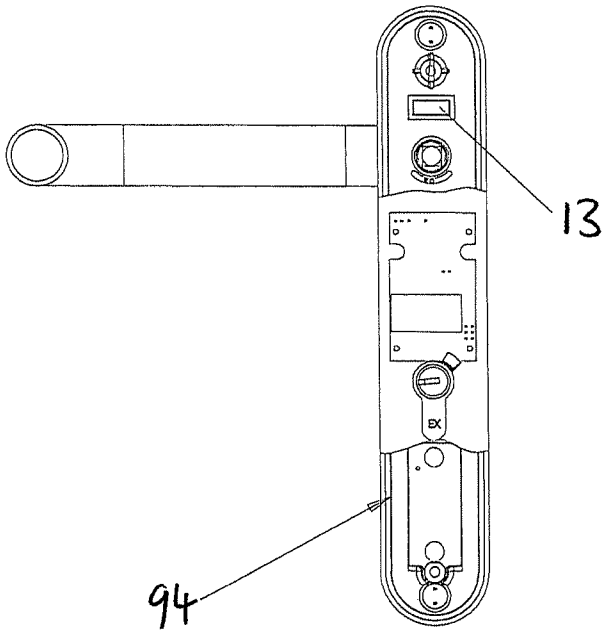
FIG. 7B shows the handle assembly of FIG. 7A from the external side, the back plate of the handle assembly shown partially cut away.
Figure 7A:
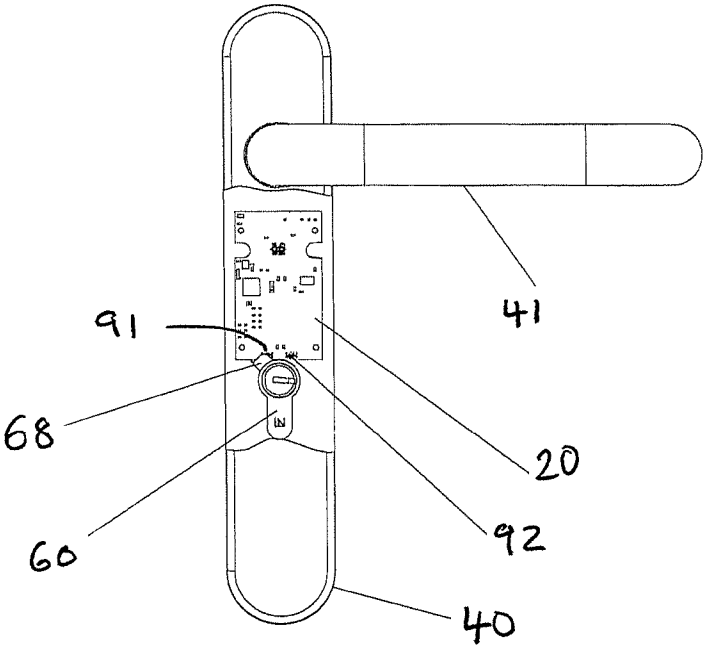
FIG. 7A shows the handle assembly of FIG. 6A from the internal side, the casing of the handle assembly shown partially cut away to reveal the cylinder lock and electronic lock status indicating means.

In the embodiment shown in FIG. 7A the electronic lock status indicating means comprises first and second sensors 91, 92 which are adapted to sense the movement of the second cam 68 as it moves past the sensors 91, 92. In this embodiment the first and second sensors 91, 92 are switches, such as rocker switches, that are activated if the second cam 68 rotates over the switch, however it will be understood that they can be other types of switches/sensors that can sense directional movement of the second cam 68 that indicates the euro cylinder is moving from a locked to a unlocked state. The first and second switches 91, 92 are mounted to a printed circuit board (PCB) 20, which in this embodiment is the same PCB that comprises the sensor unit for the leaf position detection means described above, but of course the sensors for the second cam 68 do not need to share the same PCB as the components relating to the leaf position detection means. The PCB 20 is mounted in the assembly between the handle casing 40 and a back plate 94 which is to be placed flush against the face of the leaf to which the assembly is mounted. The PCB 20 is placed such that the radially projecting protrusion 68*b* of the second cam 68 passes over the first and second switches 91, 92 as it rotates when the lock is being converted between locked and unlocked states. In this embodiment, the second cam 68 engages the first and second switches 91, 92 as it passes over them, however in other embodiments the second cam 68 may not directly engage the first and second sensors/switches, but may merely be detected as it moves past them. The first and second switches 91, 92 are arranged adjacent to each other such that as the second cam 68 rotates in a first direction, it activates one of the switches, then the other sequentially and when the second cam 68 rotates in the other direction it activates the switches in the opposite order. The PCB 20 includes processor means adapted to provide an output indicating the direction of rotation of the second cam 68 depending on which order the switches 91, 92 were activated, which thus indicates the locked or unlocked state of the lock. In this embodiment, in operation, as the first rotatable lock driving member 63 is rotated to convert the lock from a locked to unlocked condition, the second cam 68 is rotated clockwise and the second cam 68 engages the first switch 91 and then the second switch 92.

Based on the activation of the switches in the order first switch 91 then second switch 92, an output is generated indicating the lock as in the unlocked status. As the first rotatable lock driving member 63 is rotated to convert the lock from an unlocked to a locked condition, the second cam 68 is rotated anticlockwise and the second cam 68 engages the second switch 92 and then the first switch 91 and an output is generated indicating the lock as in the locked status.

Referring to FIG. 8B, the PCB 20 includes wireless transmission means 56, which in this embodiment are RF transmission means, to send the lock status signal to a receiver means such that the lock status can be used as part of a wider monitoring system and/or displayed on user display means such as a smartphone, remote control or other device which can receive data, preferably also having a user interface.

The lock cylinder shown in the figures is a double cylinder lock, but it may alternatively be a single cylinder lock. With the double cylinder lock shown in the figures, the lock can be operated from either side of the leaf. The lock housing 61 has a second bore (not visible in the figures) at the opposite end of the housing 61 from the first bore 62 for receiving a second rotatable lock driving member. The second rotatable lock driving member is co-axial with and connectable in use to the first cam 66, such that the second rotatable lock driving member can drive the first cam. In order to provide the ability for the first cam 66 to be operated from both sides of the leaf, the first cam 66 is selectively connected to the first and second rotatable lock driving members by a clutch. Such clutches are known in the art and are typically slidable along the cylinder between a position in which a load path is formed between the first cam 66 and the first rotatable lock driving member 63 and an alternative position in which a load path is formed between the first cam 66 and the second rotatable lock driving member.

In the present lock cylinder 60 the second cam 68 is not connected in use to the second rotatable lock driving member such that the second cam 68 will only be rotated by rotation of the first rotatable lock driving member 63, not by rotation of the second rotatable lock driving member. However it will be understood that the second cam 28 may be connected in use to the second rotatable lock driving member such that the second cam 68 will be rotated by rotation of the second rotatable lock driving member as well as by rotation of the first rotatable lock driving member. In the present lock cylinder 60 the first rotatable lock driving member 63 with second cam 68 connected thereto is mounted in the internal end 60*b* of the lock, so that the lock status indicating means will indicate the locked or unlocked status of the first rotatable lock driving member 63 which is on the internal side of the leaf so that the user can easily see the locked/unlocked status of the first rotatable lock driving member when they are indoors. The housing 61 may be a single housing with first and second bores for receiving the first and second rotatable lock driving members or it may be a housing formed of two housing parts which are connectable to one another by suitable connection means. Either way, the first cam 66 is received in a central gap in the housing 61, preferably midway between the ends of the housing 61 and between the first and second bores for receiving the first and second rotatable lock driving members. In embodiments where the lock cylinder is a single cylinder lock with a single rotatable lock driving member, the first cam 66 may be near the end of the housing remote from the means for user activation of the rotatable lock driving member (i.e. remote from the key hole or thumbturn mechanism).

The second cam 68 can be mounted at any point along the barrel of the first rotatable lock driving member 63 and the housing 61 includes a gap to accommodate the second cam 68. If a mechanical lock status indicator means is employed with visible lock status indicator, then the second cam 68 is preferably located nearer to the end where it would be desirable to check the lock status from (i.e. the internal side of an external door) than to the other end of the lock housing so that the lock status indicating means can be easily viewed.

The double cylinder lock of the present embodiment may include a third cam (not shown in the figures), co-axial with and connected to the second rotatable lock driving member for rotation therewith, the third cam being a lock status indicator cam adapted to be operatively associated with second lock status indicating means for indicating the locked or unlocked state of the cylinder lock following operation of the first cam by the second rotatable lock driving member.

The incorporation of a second cam as a lock status indicator cam into a standard profile cylinder lock has a benefit that a cylinder lock incorporating lock status indicator means can be retrofitted in existing door/handle assemblies. The cylinder locks of the present invention can be provided in different predetermined lengths to match different standardised door widths.

Euro Cylinder Operational Sensor

Referring to FIG. 25 the cylinder lock 60 also includes a ball bearing 96 which is arranged to be biased into engagement with one of a plurality of detents 97 arranged on the outside of the first rotatable lock driving member 63. When the first rotatable lock driving member 63 is rotated, it rotates relative to the ball bearing 96 such that the ball bearing is forced to engage in successive adjacent detents 97 as the first rotatable lock driving member 63 is rotated, which provides an audible sound. Each detent 97 is an elongate recessed channel having an axis parallel with the rotational axis of the first rotatable lock driving member 63. The lock housing 61 has a base portion 61*c* running between its external 61*a* internal end 61*b*, adjacent the first and second bores for receiving rotatable lock driving members. The lock housing 61 has at least one throughbore 99 in its base 61*c* for receiving the ball bearing 96. The ball bearing 96 is biased into engagement with the first rotatable lock driving member 63 by a spring 98, which is received between the ball bearing 96 and a pin 95 which plugs the other end of the throughbore 99. The cylinder lock 60 may have more than one throughbore 99, each for receiving a ball bearing 96, however one is sufficient to provide the audible sound on rotation of the first rotatable lock driving member. The cylinder lock may have a similar arrangement of a throughbore receiving a ball bearing for engagement with detents in a second rotatable lock driving member on the other side of the cylinder lock.

Lock Child Safety Latch and Lock NIB

A child security latch for the handle assembly 10 will now be described referring to FIGS. 19A, 19B and 20A to 20F. The handle assembly 10 is designed for use with a spindle 42 which drives a latch means on the door which is engageable with a retainer or catch on an adjacent door jamb to latch the door in its closed position. The latch means can be withdrawn to permit opening of the door by turning of the spindle 42, which is driven by a handle grip 41 coupled to the spindle 42 such that rotation of the handle grip 41 rotates the spindle 42.

Referring to FIG. 20B, the handle assembly 10 comprises a handle grip 41 mounted to a casing 40. The casing 40 is for mounting to a door or window (not shown) by means of suitable fixings (not shown).

The handle grip 41 is pivotally mounted to the casing 40 via a nose portion 44 which is received by the casing 40. The handle grip 41 is moveable between a closed position (as shown in FIGS. 20A, 20B) in which the latch means maintains the door in a closed position and an open position (as shown in FIGS. 20C, 20D) in which the latch means is unlatched to allow opening of the door.

Referring to FIG. 19, the casing 40 comprises an outer cover plate 40*a* and an inner cover plate 40*b* which is arranged between the outer cover plate 40*a* and the door when assembled. The outer cover plate 40*a* and inner cover plate 40*b* each have a bore 45 therein in which is received the nose portion 44 of the handle grip 41. The spindle 42 is a drive shaft with square cross-section which couples to the handle grip 41, used for driving the latch means (not shown) or the like to latch the door in its closed position. One end of the spindle 42 is received in a corresponding bore in the nose portion 44 of the handle grip 41, such that the spindle 42 is rotated by movement of the handle grip 41 relative to the casing 40.

Referring to FIG. 20B, the handle assembly 10 has a push button 46 which can be depressed by the user in order to release the handle and allow it to be pivoted from its closed position to an open position which will permit movement of the door to an open position. The push button 46 is therefore a release button which, when operated, releases the handle from its closed position, permitting it to be moved to its open position. The outer cover plate 40*a* has an aperture 47 in which the front portion of the push button 46 is received. The front portion of the push button 46 is exposed through the aperture 47 in the outer cover plate 40*a*, allowing the push button 46 to be depressible by the user.

Figure 19B:
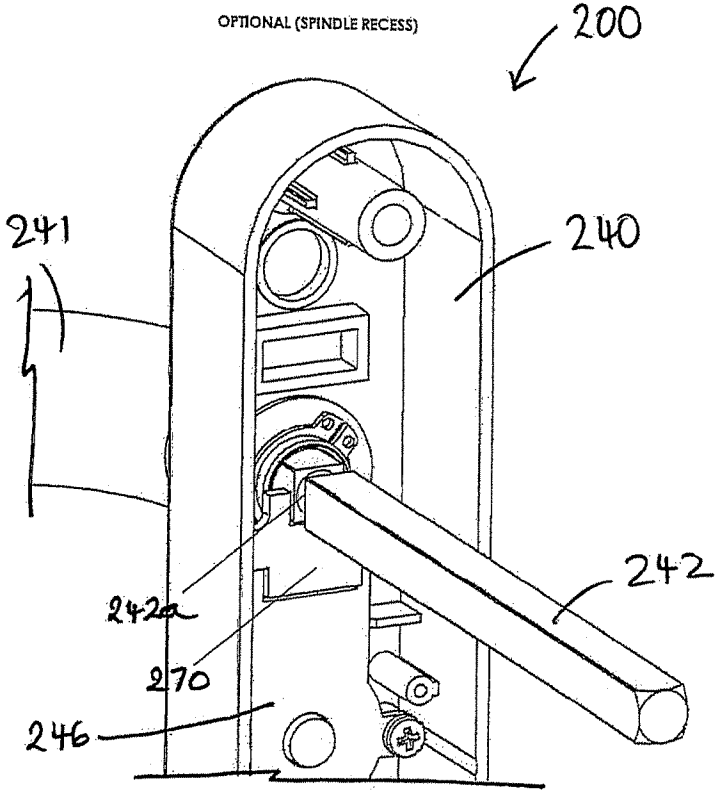
FIG. 19B shows a close-up view of the stop member of the assembly of FIG. 19A.
Figure 19A:
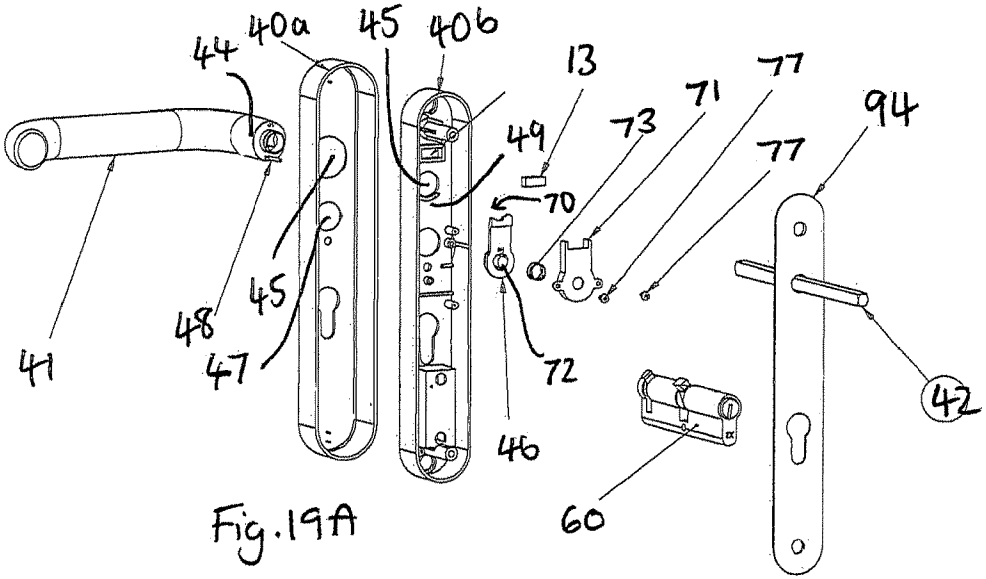
FIG. 19A shows an exploded perspective view from the external side of handle assembly with child security latch.

Referring to FIG. 19A, the push button 46 includes a stop member 70 which, in this embodiment, is integral with the push button 46, but they may be separate elements which are operatively coupled to one another. Extending from the nose portion 44 of the handle grip 41 is a pin 48. When assembled, the pin 48 extends through the spindle bore 45 in the outer cover plate 40*a*, and protrudes through an arcuate shaped pin slot 49 in the inner cover plate 40*b*. As shown in FIG. 20A, the stop member 70 can engage with the pin 48 when the handle is in its closed position. Referring to FIG. 19B, the stop member 70 has a recess 70*a* shaped to receive the pin 48. Adjacent to the recess 70*a* in the stop member 70 is a shoulder 70*b* which blocks the handle from being pivoted from its closed position to its open position, by blocking movement of the pin towards the door jamb. The recess 70*a* has an arcuate ramped surface 70*c* to accommodate some play in movement of the door handle upwards slightly from its closed position. The stop member 70 also comprises a recess 70*d* distanced from recess 70*a*, the recess 70*d* having a shoulder 70*e*.

The stop member 70 with integral push button 46 is mounted between the inner cover plate 40*b* and a push button retainer plate 71 which is fixed to the inner cover plate 40*b* using suitable fixings, which in this embodiment are screws 77. Between the push button retainer plate 71 and the door is a back plate 94. Extending from the inner side of the push button 46 is a short cylindrical protrusion 72 around which a coil spring 73 is received in order to bias the push button 46 (and hence also the stop member 70) away from the push button retainer plate 71. When the push button 46 is in its normal position, biased away from the door, the stop member 70, which is integral with the push button 46, is in a blocking position, as the stop member 70 is positioned in the path that the pin 48 would travel if the handle were moved from its closed position to an open position, thus preventing the handle from being moved from its closed position to an open position. The push button 46 may be depressed by the user, moving it translationally to a recess position, thus moving the stop member 70 to a non-blocking position, wherein it is depressed relative to the handle casing 40 sufficiently to move the stop member 70 out of the path of travel of the pin 48. The stop member's 70 blocking position is shown in FIG. 20E and its non-blocking position is shown in FIG. 20F.

When the handle assembly 10 is assembled and the handle grip 41 is in its closed position as shown in FIGS. 20A, 20B and 20E, the pin 48 engages with the shoulder 70*b* of the stop member 70, blocking the pin 48 from moving towards the door jamb and therefore preventing the handle grip 41 from being moved from its closed position to an open position. In operation, in order to move the handle to an open position the push button 46 is depressed by the user by pressing on the push button 46. This moves the push button 46 translationally away from the handle grip 41, thus moving the stop member 70 from its blocking position to its non-blocking position. When in its non-blocking position, the stop member 70 is no longer in the way of the path of travel of pin 48 so that the handle grip 41 can now be moved from its closed position to an open position. If the user applies force to the handle grip 41 to move it from its closed position to its open position while depressing the push button 46, then the handle grip 41 can move from its closed position to an open position. As the handle is moved from its closed position to an open position, the pin's movement is guided by the arcuate pin slot 49. The user does not need to keep the push button 46 depressed continuously during movement of the handle grip 41; as long as the push button 46 is depressed at the start of movement of the handle from the closed position to an open position, the stop member 70 will be moved out of the way of the pin 48 and once the pin 48 has started to move along the arcuate slot 49 towards the door jamb, the pin 48 will then prevent the stop member 70 from returning to its blocking position. The pin 48 can travel until it reaches the extremity of the arcuate pin slot 49 closest to the door jamb, as shown in FIG. 20C; this corresponds with the fully open position of the handle grip 41. Movement of the handle from its closed position to an open position will actuate a latch of a door to allow opening of the door. If the user releases the push button 46 such that it is no longer depressed when the handle is in the open position, the stop member 70 will return to its blocking position and the pin 48 will be received in recess 70*d* in the stop member 70. Shoulder 70*e* blocks the handle from moving from its open position to its closed position by blocking movement of the pin 48 away from the door jamb. This retains the handle in the open position, such that the latch of the door is retained in its unlatched position until the user depresses the push button 46 so that the door leaf cannot close shut until the user depresses the push button 46. If the user then depresses the push button 46, moving it translationally to its recess position, moving stop member 70 to a non-blocking position, the stop member 70 is depressed relative to the handle casing 40 sufficiently to move stop member 70 out of the path of travel of the pin 48 away from the door jamb. This allows the handle to return to its closed position.

The handle may be biased in its closed position such that it is urged to return to its closed position when force on the handle is removed. Alternatively, the handle may require force to return it from an open position to the closed position. As the handle is moved from an open position back to its closed position, the pin 48 will travel back along the arcuate pin slot 49, away from the door jamb. Once the handle grip 41 reaches the closed position, the stop member 70 will return to its blocking position, due to the action of the biasing spring 73.

The handle assembly 10 inhibits children from being able to open the door to which it is installed as, unlike normal internal doors, the handle requires the button 46 to be depressed in order to be able to move the handle away from the closed position. Therefore, a child expecting the handle to operate like a normal internal door handle will be unable to open the door, even if the door is not locked. The handle assembly secondary function is to prevent the door from accidentally shutting close.

Figure 19C:
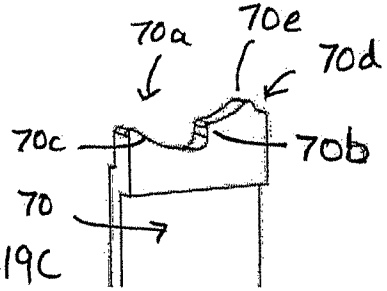
FIG. 19C shows a rear view of an alternative handle assembly embodiment with child security latch.

In an alternative embodiment shown in FIG. 19C the push button may be extended to fit around the spindle and prevent the spindle from rotating unless the push button is depressed. The handle assembly 200 shown in FIG. 19C is similar to that of FIG. 19A. Like the embodiment of FIG. 19A, the FIG. 19C embodiment has a handle grip 241 mounted to a casing 240. The assembly has a push button 246, accessible to be depressed from the front of the assembly, with integral stop member 270. The top edge of the stop member 270 differs from that of the FIG. 19A embodiment in that instead of the pin receiving recesses 70*a* and 70*d*, it has a single recess 270*a* in its top edge. The recess 270*a* is square shaped to receive the square cross-section of the handle spindle 242 (but the recess may be shaped differently if the spindle cross-section is a different shape). As with the previous embodiment, the spindle 242 is driven by movement of the handle grip 241 to rotate to actuate a door latch (not shown). The spindle 242 also differs from the previous embodiment in that it has a cut-out portion 242*a* that has a smaller diameter than the remainder of the spindle 242*a*. The cut-out portion 242*a* of the spindle is located at the point on the spindle where it extends from the rear of the handle casing 240.

Like the previous embodiment, the stop member 270 has a normal position, biased away from the door and a recessed position that it is moved to when the push button 246 is depressed by a user. When the stop member 270 is in its normal position, the square cross-section of the part of the spindle 242 between the casing 240 and the cut-out portion 242*a* of the spindle is received in the recess 270*a* of the stop member 270 and the upright sides of the recess 270*a* block the spindle 242 from rotating, thus preventing the handle from being moved from its closed position to an open position (the normal position of the stop member 270 is therefore a blocking position). When the push button 242 is depressed by the user, it moves translationally towards the door, moving stop member 270 to a non-blocking position in which the recess 270*a* of the stop member 270 aligns with the cut-out portion 242*a* of the spindle. The small diameter of the spindle 242 at the cut-out portion 242 is free to rotate within the recess 270*a* and the handle can therefore be moved from its closed to its open position whilst the push button 246 is being depressed by the user. In this embodiment, the handle can only be moved whilst the push button 246 is being depressed. This inhibits children from being able to open the door, even if it is unlocked.

It will be understood that the various handle assemblies described herein can be mounted to a leaf or a frame to allow opening and closing of the leaf relative to the frame, although more commonly a handle assembly will be mounted to the leaf. It will be understood that the various locking assemblies including locking drive rails can be mounted such that locking drive rail is slidably mounted to the leaf or to the frame, although more commonly a locking drive rail will be mounted to the leaf.

Various of the window and door security features disclosed herein can be used in combination with one another as appropriate. It should be noted that embodiments of the inventions have been described invention have been described herein by way of example only, and that modifications can be made within the scope of the claims. It should be further noted that each of the many advantageous features described above may be employed in isolation, or in combination with any one or more other features.

The invention claimed is:

1. A system for detecting the position of at least one moveable element of a window or door assembly, the window or door assembly having a leaf and a frame, the leaf being moveable relative to the frame between a closed position and an open position, the window or door assembly having a latch mechanism moveable between a secured configuration and an unsecured configuration to allow opening and closing of the leaf, said moveable element moving relative to a reference structure and relative to the leaf during operation of the latch mechanism, the moveable element being mounted to the leaf such that the moveable element moves with the leaf when the leaf is moved between the leaf's open and closed positions, the system comprising:

at least one magnetic field generator;

at least one sensor for sensing a magnetic field, the at least one sensor being configured such that the magnetic field sensed changes as the at least one moveable element moves, one of said magnetic field generator and sensor being mounted to the moveable element in use and the other being mounted to a reference structure that the moveable element is moveable relative to, the at least one sensor comprising a three axis magnetometer that is able to detect the position of the magnetic field generator in three coordinate axes;

the moveable element moving in three coordinate axes as the leaf moves between the leaf's closed and open positions and the latch mechanism moves between its secured and unsecured configurations; and the system further comprising a processor means configured to receive output signals associated with the sensed magnetic field from the sensor and to determine the position of the at least one moveable element, such that the position of the moveable element can be determined in order to determine both the position of the leaf and whether the latch mechanism is in a secured or an unsecured configuration;

wherein the system is configured to operate in a calibration mode and a normal mode, wherein in the calibration mode the system is configured to register at least an output value from the at least one sensor when the at least one moveable element is at a first predetermined position as a corresponding first reference value and wherein in the normal mode the processor means is configured to use at least the first reference value in determining the position of the at least one moveable element.

2. A system according to claim 1, wherein the system includes memory for storing output values provided by the at least one sensor.

3. A system according to claim 1, wherein in the calibration mode the system is configured to register an output from the at least one sensor when the leaf is at the closed position.

4. A system according to claim 3, wherein in the calibration mode the system is configured to register an output value from the at least one sensor when the leaf is at a slightly open or night vent position.

5. A system according to claim 1, wherein the system further comprises a handle assembly to allow opening and closing of the leaf, the handle assembly comprising a handle casing from which extends a handle grip wherein one of the at least one magnetic field generator and at least one sensor is mounted within the handle casing and the other of the at least one magnetic field generator and at least one sensor is mounted to the reference structure.

6. A system according to claim 1, wherein the at least one moveable element is configured to move upon movement of a handle that is moveable between open and closed positions to allow opening and closing of a leaf of the window or door.

7. A system according to claim 1, wherein the system further comprises a locking mechanism having a lock drive assembly that can be driven between a locked position and an unlocked position, one of said at least one magnetic field generator and at least one sensor being mounted to the lock drive assembly in use and the other being mounted to the reference structure in use.

8. A system according to claim 7, wherein in the calibration mode the system is configured to register an output from the at least one sensor when the lock drive assembly is in a locked position.

9. A system according to claim 7, wherein in the calibration mode the system is configured to register an output from the at least one sensor when the lock drive assembly is in an unlocked position.

10. A system according to claim 1, wherein in the calibration mode the system is configured to register a first output from the at least one sensor when the leaf is in the closed position and when the latch mechanism is in the unsecured configuration and a second output from the at least one sensor when the leaf is in the closed position and the latch mechanism is in the secured configuration.

11. A system according to claim 10, wherein the latch mechanism is operated using a handle assembly having a handle grip, the handle grip being moveable between a closed position, in which the latch mechanism is in its secured configuration, and an open position, in which the latch mechanism is in its unsecured configuration, and wherein in the calibration mode the system is configured to register a first output from the at least one sensor when the leaf is in the closed position and the handle is in the open position and a second output from the at least one sensor when the leaf is in the closed position and the handle is in the closed position.

12. A system according claim 1, wherein one of the at least one magnetic field generator and at least one sensor is configured for mounting to the leaf, the processor means being configured to determine a position of the moveable element relative to the reference structure, at least when the leaf is in the closed position, and the processor means also being configured to determine a position of the leaf relative to the frame.

13. A system according to claim 1, wherein said at least one moveable element which moves during operation of the latch mechanism is a handle for actuating the latch mechanism, the handle having a handle grip which is mountable pivotally via a pivot axis to the leaf or frame such that the handle grip can be rotated about the pivot axis between a closed position and an open position, one of said at least one magnetic field generator and sensor being configured for mounting to the handle grip in use.

14. A system according to claim 13, the handle assembly further comprising a spindle connected to the handle grip such that as the handle grip is rotated, the spindle rotates, the handle assembly further comprising a cam and a cam follower, the cam being mounted around the spindle in use such that as the spindle rotates, the cam rotates, wherein the cam follower is moveable due to rotation of the cam, the cam follower comprising or having mounted thereto either said magnetic field generator or said sensor.

15. A system according to claim 1, wherein one of said at least one magnetic field generator and at least one sensor is configured for mounting to a locking drive rail of a locking mechanism that is part of the latch mechanism and the other of said at least one magnetic field generator and at least one sensor is configured for mounting to the reference structure in use.

16. A system according to claim 1, wherein said at least one moveable element which moves during operation of the latch mechanism is a holding means, the holding means being moveable between a secured position and an unsecured position, one of said at least one magnetic field generator and sensor being configured for mounting to the holding means in use.

17. A system according to claim 16, wherein said holding means is adapted for cooperating with a keep in use to secure the leaf to the frame.

18. A system according to claim 16, wherein said holding means is a locking bolt for cooperating with a keep in use to secure the leaf to the frame.

19. A system for detecting the position of at least one moveable element of a window or door assembly, the window or door assembly having a leaf and a frame, the leaf being moveable relative to the frame between a closed position and an open position, the window or door assembly having a latch mechanism moveable between a secured configuration and an unsecured configuration to allow opening and closing of the leaf, said moveable element moving relative to a reference structure and relative to the leaf during operation of the latch mechanism, the moveable element being mounted to the leaf such that the moveable element moves with the leaf when the leaf is moved between open and closed positions, the system comprising:

at least one magnetic field generator;

at least one sensor for sensing a magnetic field, the at least one sensor being configured such that the magnetic field sensed changes as the at least one moveable element moves, one of said magnetic field generator and sensor being mounted to the moveable element in use and the other being mounted to a reference structure that the moveable element is moveable relative to, the at least one sensor comprising a three axis magnetometer that is able to detect the position of the magnetic field generator in three coordinate axes, wherein the moveable element of the window or door assembly that said magnetic field generator or sensor is mounted to is selected from one of a handle, latch means, a locking bolt, and a locking drive rail;

the moveable element moving in three coordinate axes as the leaf moves between its closed and open positions and the latch mechanism moves between its secured and unsecured configurations; and the system further comprising processor means configured to receive output signals associated with the sensed magnetic field from the sensor and to determine the position of the at least one moveable element, such that the position of the moveable element can be determined in order to determine both the position of the leaf and whether the latch mechanism is in its secured or unsecured configuration;

wherein the system is configured to operate in a calibration mode and a normal mode, wherein in the calibration mode the system is configured to register at least an output value from the at least one sensor when the at least one moveable element is at a first predetermined position as a corresponding first reference value and wherein in the normal mode the processor means is configured to use at least the first reference value in determining the position of the at least one moveable element.

* * * * *